US009482055B2

(12) United States Patent
Huang

(10) Patent No.: US 9,482,055 B2
(45) Date of Patent: Nov. 1, 2016

(54) METHODS FOR MODELING, DESIGNING, AND OPTIMIZING THE PERFORMANCE OF DRILLING TOOL ASSEMBLIES

(75) Inventor: Sujian Huang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 2232 days.

(21) Appl. No.: 10/888,446

(22) Filed: Jul. 9, 2004

(65) Prior Publication Data

US 2005/0096847 A1 May 5, 2005

Related U.S. Application Data

(63) Continuation-in-part of application No. 09/689,299, filed on Oct. 11, 2000, now Pat. No. 6,785,641.

(60) Provisional application No. 60/485,642, filed on Jul. 9, 2003.

(51) Int. Cl.

| | |
|---|---|
| ***G06G 7/48*** | (2006.01) |
| ***E21B 10/16*** | (2006.01) |
| ***E21B 44/00*** | (2006.01) |

(52) U.S. Cl.

CPC ..... *E21B 10/16* (2013.01); *E21B 44/00* (2013.01)

(58) Field of Classification Search

CPC ..... E21B 10/16; E21B 44/00
USPC ..... 703/10; 702/9
See application file for complete search history.

(56) References Cited

U.S. PATENT DOCUMENTS

| | | | |
|---|---|---|---|
| 1,209,299 | A | 12/1916 | Hughes |
| 1,263,802 | A | 4/1918 | Reed |
| 1,394,769 | A | 10/1921 | Sorensen |
| 3,303,894 | A | 2/1967 | Varney |
| 4,031,974 | A | 6/1977 | Peterson |
| 4,187,922 | A | 2/1980 | Phelps |
| 4,343,371 | A | 8/1982 | Baker, III et al. |
| 4,408,671 | A | 10/1983 | Munson |
| 4,475,606 | A | 10/1984 | Crow |
| 4,578,675 | A | 3/1986 | MacLeod |
| 4,630,692 | A | 12/1986 | Ecer |
| 4,630,694 | A | 12/1986 | Walton et al. |

(Continued)

FOREIGN PATENT DOCUMENTS

| | | |
|---|---|---|
| BE | 1013217 A6 | 10/2001 |
| EP | 0550254 | 7/1993 |

(Continued)

OTHER PUBLICATIONS

Brakel et al., "Prediction of Wellbore Trajectory Considering Bottomhole Assembly and Drill-Bit Dynamics", Jun. 1989, SPE Drilling Engineering, pp. 109-118.*

(Continued)

*Primary Examiner* — Dwin M Craig
*Assistant Examiner* — Juan Ochoa

(57) ABSTRACT

A method for designing a drilling tool assembly, having a drill bit disposed at one end includes defining initial drilling tool assembly design parameters; calculating a dynamic response of the drilling tool assembly; adjusting a value of a drilling tool assembly design parameter; and repeating the calculating and the adjusting until a drilling tool assembly performance parameter is optimized.

15 Claims, 36 Drawing Sheets

(56) References Cited

U.S. PATENT DOCUMENTS

| | | | | |
|---|---|---|---|---|
| 4,694,918 | A | 9/1987 | Hall | |
| 4,794,534 | A | 12/1988 | Millheim | |
| 4,815,342 | A | 3/1989 | Brett | |
| 4,862,974 | A | 9/1989 | Warren | |
| 4,867,015 | A | 9/1989 | Kane et al. | |
| 4,903,245 | A | 2/1990 | Close et al. | |
| 4,932,484 | A | 6/1990 | Warren | |
| 4,982,802 | A | 1/1991 | Brett | |
| 5,010,789 | A | 4/1991 | Brett | |
| 5,035,293 | A | 7/1991 | Rives | |
| 5,042,596 | A | 8/1991 | Brett | |
| 5,131,478 | A | 7/1992 | Brett | |
| 5,131,479 | A | 7/1992 | Boulet et al. | |
| 5,178,222 | A | 1/1993 | Jones | |
| 5,216,917 | A | 6/1993 | Detournay | |
| RE34,435 | E | 11/1993 | Warren et al. | |
| 5,318,136 | A | 6/1994 | Rowsell et al. | |
| 5,368,114 | A | 11/1994 | Tandberg et al. | |
| 5,456,141 | A | 10/1995 | Ho | |
| 5,605,198 | A | 2/1997 | Tibbitts | |
| 5,613,093 | A | 3/1997 | Kolb | |
| 5,663,512 | A | 9/1997 | Schader et al. | |
| 5,733,664 | A | 3/1998 | Kelley et al. | |
| 5,787,022 | A | 7/1998 | Tibbitts | |
| 5,794,720 | A | 8/1998 | Smith et al. | |
| 5,803,196 | A | 9/1998 | Fielder | |
| 5,842,149 | A * | 11/1998 | Harrell et al. | 702/9 |
| 5,864,058 | A | 1/1999 | Chen | |
| 5,868,213 | A | 2/1999 | Cisneros et al. | |
| 5,881,310 | A | 3/1999 | Airhart et al. | |
| 5,903,743 | A | 5/1999 | Kolb | |
| 5,937,958 | A | 8/1999 | Mensa-Wilmot et al. | |
| 5,950,747 | A | 9/1999 | Tibbitts | |
| 5,992,542 | A | 11/1999 | Rives | |
| 5,999,891 | A | 12/1999 | Rey-Fabret et al. | |
| 6,021,377 | A | 2/2000 | Dubinsky et al. | |
| 6,021,859 | A | 2/2000 | Tibbitts | |
| 6,095,262 | A | 8/2000 | Chen | |
| 6,109,368 | A * | 8/2000 | Goldman et al. | 175/39 |
| 6,131,673 | A | 10/2000 | Goldman et al. | |
| 6,151,960 | A | 11/2000 | Taylor et al. | |
| 6,186,251 | B1 | 2/2001 | Butcher | |
| 6,213,225 | B1 | 4/2001 | Chen | |
| 6,213,255 | B1 | 4/2001 | Neuwirth | |
| 6,241,034 | B1 | 6/2001 | Steinke et al. | |
| 6,269,893 | B1 | 8/2001 | Beaton | |
| 6,276,465 | B1 | 8/2001 | Cooley et al. | |
| 6,290,006 | B1 | 9/2001 | Crawford | |
| 6,298,930 | B1 | 10/2001 | Sinor | |
| 6,349,595 | B1 | 2/2002 | Civolani et al. | |
| 6,374,704 | B1 | 4/2002 | Scott et al. | |
| 6,374,926 | B1 | 4/2002 | Goldman et al. | |
| 6,386,297 | B1 | 5/2002 | Cooley et al. | |
| 6,389,360 | B1 | 5/2002 | Alft et al. | |
| 6,401,839 | B1 | 6/2002 | Chen | |
| 6,408,953 | B1 | 6/2002 | Goldman et al. | |
| 6,412,577 | B1 | 7/2002 | Chen | |
| 6,424,919 | B1 | 7/2002 | Moran et al. | |
| 6,435,058 | B1 | 8/2002 | Matthias | |
| 6,516,293 | B1 | 2/2003 | Huang | |
| 6,527,068 | B1 * | 3/2003 | Singh et al. | 175/431 |
| 6,536,543 | B2 | 3/2003 | Meiners | |
| 6,629,572 | B2 | 10/2003 | Womer et al. | |
| 6,695,073 | B2 | 2/2004 | Glass | |
| 6,711,969 | B2 | 3/2004 | Meiners | |
| 6,729,420 | B2 | 5/2004 | Mensa-Wilmot | |
| 6,732,052 | B2 | 5/2004 | Macdonald et al. | |
| 6,732,817 | B2 | 5/2004 | Dewey et al. | |
| 6,772,066 | B2 | 8/2004 | Cook et al. | |
| 6,935,442 | B2 | 8/2005 | Boulet et al. | |
| 6,986,395 | B2 | 1/2006 | Chen | |
| 7,003,439 | B2 | 2/2006 | Aldred et al. | |
| 7,020,597 | B2 | 3/2006 | Oliver et al. | |
| 7,027,925 | B2 | 4/2006 | Terentyev et al. | |
| 7,032,689 | B2 * | 4/2006 | Goldman et al. | 175/39 |
| 7,035,778 | B2 | 4/2006 | Goldman et al. | |
| 7,085,696 | B2 * | 8/2006 | King | 703/10 |
| 7,139,689 | B2 | 11/2006 | Huang | |
| 7,172,037 | B2 * | 2/2007 | Dashevskiy et al. | 175/25 |
| 7,181,380 | B2 | 2/2007 | Dusterhoft et al. | |
| 7,245,101 | B2 * | 7/2007 | Dadd | 318/561 |
| 7,261,167 | B2 | 8/2007 | Goldman et al. | |
| 7,357,196 | B2 * | 4/2008 | Goldman et al. | 175/24 |
| 7,464,013 | B2 | 12/2008 | Huang et al. | |
| 7,539,625 | B2 | 5/2009 | Klumpen et al. | |
| 7,555,414 | B2 | 6/2009 | Calhoun et al. | |
| 7,603,264 | B2 | 10/2009 | Zamora et al. | |
| 7,630,914 | B2 | 12/2009 | Veeningen et al. | |
| 7,653,563 | B2 | 1/2010 | Veeningen et al. | |
| 7,693,695 | B2 | 4/2010 | Huang et al. | |
| 2003/0051918 | A1 | 3/2003 | Chen | |
| 2003/0196835 | A1 | 10/2003 | Singh et al. | |
| 2004/0059554 | A1 | 3/2004 | Goldman et al. | |
| 2004/0085988 | A1 | 5/2004 | Gardner et al. | |
| 2004/0222025 | A1 | 11/2004 | Beaton | |
| 2004/0236553 | A1 | 11/2004 | Chen et al. | |
| 2004/0254664 | A1 | 12/2004 | Centala et al. | |
| 2005/0015229 | A1 | 1/2005 | Huang | |
| 2005/0080595 | A1 | 4/2005 | Huang | |
| 2005/0133272 | A1 | 6/2005 | Huang et al. | |
| 2006/0162968 | A1 | 7/2006 | Durairajan et al. | |
| 2006/0167669 | A1 | 7/2006 | Cariveau et al. | |
| 2006/0176668 | A1 | 8/2006 | Otsuki et al. | |
| 2007/0032958 | A1 | 2/2007 | Chen | |
| 2007/0093996 | A1 | 4/2007 | Cariveau et al. | |
| 2007/0106487 | A1 | 5/2007 | Gavia et al. | |
| 2008/0262810 | A1 | 10/2008 | Moran et al. | |

FOREIGN PATENT DOCUMENTS

| | | | |
|---|---|---|---|
| EP | 0728912 | A2 | 8/1996 |
| EP | 0972908 | A2 | 1/2000 |
| EP | 1146200 | A1 | 10/2001 |
| GB | 2216661 | | 10/1989 |
| GB | 2241266 | A | 8/1991 |
| GB | 2300208 | A | 10/1996 |
| GB | 2339815 | A | 2/2000 |
| GB | 2346628 | A | 8/2000 |
| GB | 2 360 304 | A | 9/2001 |
| GB | 2 367 843 | | 4/2002 |
| GB | 2367843 | A | 4/2002 |
| GB | 2379699 | A | 3/2003 |
| GB | 2424975 | | 10/2006 |
| SU | 295857 | | 2/1971 |
| SU | 398733 | | 9/1973 |
| SU | 420749 | | 3/1974 |
| SU | 436147 | | 7/1974 |
| SU | 515867 | | 5/1976 |
| SU | 933932 | | 6/1982 |
| SU | 1461855 | A1 | 2/1989 |
| SU | 1654515 | A1 | 7/1991 |
| SU | 1691497 | A1 | 11/1991 |
| WO | 9736084 | | 10/1997 |
| WO | WO 00/12859 | | 3/2000 |
| WO | WO 00/12860 | | 3/2000 |
| WO | WO-01/33027 | | 5/2001 |
| WO | WO-01/33027 | A2 | 5/2001 |
| WO | WO-02/077407 | A1 | 10/2002 |
| WO | 05008020 | | 1/2005 |
| WO | 2005090750 | | 9/2005 |

OTHER PUBLICATIONS

Dykstra et al., "Improving Drilling Performance by Applying Advanced Dynamics Models", SPE/IADC paper 67697, SPE/IADC Drilling Conference, Amsterdam, The Netherlands, Feb. 27-Mar. 1, 2001, pp. 1-18.*

Glowka, David A., "Use of Single-Cutter Data in the Analysis of PDC Bit Designs: Part 1—Development of a PDC Cutting Force Model"; JPT, Aug. 1989 (pp. 797-799, 844-849).

Glowka, D.A., "Use of Single-Cutter Data in the Analysis of PDC Bit Designs: Part 2—Development and Use of the PDCWEAR Computer Code", JPT, Aug. 1989 (pp. 850-859).

(56) References Cited

OTHER PUBLICATIONS

International Search Report dated Nov. 22, 2004, (6 pages).
PCT International Search Report dated Nov. 22, 2004 (4 pages).
David A. Glowka, et al. "Progress in the Advanced Synthetic-Diamond Drill Bit Program"; ASME International pp. 87-95.
David A. Glowka, "Use of Single-Cutter Data in the Analysis of PCD Bit Designs: Pat 1—Development of a PCD Cutting Force Model" JPT, Aug. 1898 (9 pages).
Certification and Notarization dated Nov. 12, 2003 from Universe Technical Translation.
Translation of Description of Invention No. 933932 dated Jun. 7, 1982 (2 pages).
D. Ma, et al. "Dynamics of Roller Cone Bits", Journal of Energy Resources Technology, Dec. 1985, vol. 107 (pp. 543-548).
D. Ma, et al. "A New Way to Characterize the Gouging-Scraping Action of Roller Cone Bits", Society of Petroleum Engineers, 1989 (24 pgs.).
Boris L. Steklianov, "Increasing the Efficiency of Rock-Cutting Tools on the Basis of Comparative Analysis of the Kinetic Characteristics of Their Cutting Structure"; NDERI, 1990 (24 pages).
B. L. Steklyanov, et al.; "Improving the effectiveness of Drilling Tools"; KhM-3 Oil Industry Machine Building; (1991) pp. 1-35.
Dekun Ma, et al.; "The Computer Simulation of the Interaction Between Roller Bit and Rock"; International Meeting on Petroleum Engineering; PR China; Nov. 14-17, 1995; pp. 309-317.
Ma Dekun, et al., "The Operational Mechanics of The Rock Bit", Petroleum Industry Press, 1996, pp. 1-243.
Society of Petroleum Engineers Paper No. 56439, "Field Investigation of the Effects of Stick-Slip, Lateral and Whirl Vibrations on Roller Cone Bit Performance", S.L. Chen, et al., presented Oct. 3-6, 1999, (10 pages).
Society of Petroleum Engineers Paper No. 71053, "Development and Application of a New Roller Cone Bit with Optimized Tooth Orientation", S. L. Chen, et al., presented May 21-23, 2001 (15 pages).
Society of Petroleum Engineers Paper No. 71393, "Development and Field Applications of Roller Cone Bits with Balanced Cutting Structure", S. L. Chen, et al., presented Sep. 30-Oct. 3, 2001 (11 pages).
Hancke, et al., G.P. A Control System for Optimizing Deep Hole Drilling Conditions, IECON 1991 International Conference on Industrial Electrionics, Control and Instrumentation, 1991, pp. 2279-2284.
Ertunc, et al., H. M. Real Time Monitoring of Tool Wear Using Multiple Modeling Method, IEEE International Electric Machines and Drives Conference, IEMDC 2001, pp. 687-691.
Hancke, G. P. The Effective Control of a Deep Hole Diamond Drill, Conference. REcord of the IEEE Industry Applications Society Annual Meeting, 1991, pp. 1200-1205.
Howie, et al., W. L. A Smart Bolter for Improving Entry Stability, Conference Record of the IEEE Industry Applications Society Annual Meeting, 1989, pp. 1556-1564.
United Kingdom Combined Search and Examination Report dated Aug. 9, 2005 (6 pages).
SPE Society of Petroleum Engineers of AME; 59$^{th}$ Annual Technical Conference and Exhibition, Houston, Texas, Sep. 16-19, 1984 (24 pages).
T.M. Warren et al.; "Laboratory Drilling Performance of PDC Bits"; SPE Drilling Engineering, Jun. 1988; pp. 125-135 (11 pages).
T.M. Warren et al.; "Drag-Bit Performance Modeling"; SPE Drilling Engineering, Jun. 1989; pp. 119-127 (9 pages).
Examination Report issued in Application No. GB0600583.9 dated May 22, 2006 (3 pages).
SPE/IADC 67697, "Improving Drilling Performance by Applying Advanced Dynamics Models"; M.W. Dykstra, et al.; Prepared for presentation at Drilling Conference held in Amsterdam, The Netherlands, Feb. 27-Mar. 1, 2001; 18 pages.
David A. Glowka, et al. "Progress in the Advanced Synthetic-Diamond Drill Bit Program"; ASME International; Dated Nov. 22, 1995 (pp. 87-95).
D.A. Glowka, Use of Single-Cutter Data in the Analysis of PDC Bit Designs: Part 2—Development and Use of the PDCWEAR Computer Code; Dated Aug. 1989 (10 pages).
Robert L. McIntyre, "Surface Mine Rotary Drilling", Smith-Gruner; Dated Oct. 28, 1985 (3 pages).
RockBit International, "The Leader in High-Speed Drill Bit Technology" ; Dated 1995 (24 pages).
Brakel et al.; Prediction of Wellbore trajectory considering bottomhold assembly and drill-bit dynamics; SPE Drilling Engineering; Jun. 1989; pp. 109-118. (excerpts provided in Office Action attached).
PCT International Search Report issued in PCT Application No. PCT/US05/17943 filed Feb. 14, 2006 (4 pages).
PCT Written Opinion issued in PCT Application No. PCT/US05/17943 dated Feb. 14, 2006 (4 pages).
Examination Report for Canadian Application No. 2,536,684 dated Aug. 29, 2008, (3 pages).
U.S. Non-Final Office Action dated Apr. 17, 2009, for related U.S. Appl. No. 11/137,713, (21 pages).
Office Action for related Canadian Application No. 2,536,684, dated May 5, 2009. (3 pages).
Non-Final Office Action for related U.S. Appl No. 11/495,149 dated Oct. 8, 2009. (20 pages).
"Drilling Index—a New Approach to Bit Performance", Perrin et al. SPE/IADC Drilling Conference Mar. 4-6, 1997. Amsterdam, Netherlands (7 pages).
Search and Examination Report for related Great Britian Application No. GB0912772 dated Nov. 9, 2009. (7 pages).
Jerold A. Baird et al. "Analyizing the Dynamic Behavior of Downhole Equipement During Drilling"; Dated Jan. 1, 1984 (pp. 1-5).
Robert Clayton et al. "New Bit Design Cutter Technology Extend PDC Applications to Hard Rock Drilling" Dated Dec. 2005 (pp. 1-9).
Office Action issued in related U.S. Appl. No. 11/495,149; Dated Oct. 5, 2010 (18 pages).
"Performance Gains for Rotary Steerable Through Specialized Bit Design", Lenamond et al.; AADE 2005 National Technical Conference and Exhibition. Apr. 5-7, 2005 (14 pages).
Notice of Allowance issued in related U.S. Appl. No. 11/365,065; Dated Oct. 21, 2010 (14 pages).
Office Action issued in related U.S. Appl. No. 11/137,713; Dated Nov. 19, 2010 (23 pages).
Office Action issued in related U.S. Appl. No. 11/137,713; Dated May 19, 2011 (21 pages).
Office Action issued in related U.S. Appl. No. 11/495,149; Dated Feb. 13, 2012 (17 pages).
"Classification of PDC bits According to their Steerability", S. Menand. Feb. 19-21, 2003 (13 pages).
"Well Design Using a Computer Model". Mohamed Wael Helmy. Copyright 1998 Society of Petroluem Engineers (5 pages).
"An Expert System for Drill Bit Selection". M.J. Fear. Copyright 1994, IADC/SPE Drilling Conference (14 pages).
"Application of Rotary Steerable System/PDC Bits in Hard Interbedded Formations: A Multidisciplinary Team Approach to Performance Improvement". Harald Fiksdal. Copyright 2000, IADC/SPE Drilling Conference (16 pages).
RockBit International, "System Designed to Speed Continuous Coring Operations", 1996, 5 pages.
RockBit International, "If You've Ever Doubted RBI's Ability to Drill at a Lower Cost Per Foot, Ask the Folks Drilling this Well", 4 pages, 1994.
Sandvik Rock Bits, "Sandvik in the World of Oil and Gas", 8 pages, 2005.
Yigit et al., "Coupled Torsional and Bending Vibrations of Drillstrings Subject to Impact with Friction", Journal of Sound and Vibration, 1988, pp. 167-181.
GasTIPS, Technology Developments in Natural Gas Exploration, Production and Processing, Spring 2003, vol. 9, No. 2, 36 pages.
Pessier et al., "Rolling Bits Bits with Novel Gauge Cutting Structure, Drill Faster, More Efficiently", SPE 30473 SPE Annual Technical Conference & Exhibition, Oct. 1995, pp. 241-250.

(56) References Cited

OTHER PUBLICATIONS

Sheppard et al., "The Forces at the Teeth of a Drilling Rollercone Bit: Theory and Experiment", SPE 18042, 63rd Annual Technical Conference and Exhibition of the Society of Petroleum Engineers, Oct. 1998, pp. 253-260.
Umez-Eronini, "Rotary Drill Bit/Rock Model with Cutter Offset", Journal of Energy Resources Technology, vol. 105, Sep. 1983, pp. 356-361.
Tucker et al., "An Integrated Model for Drill-String Dynamics", Journal of Sound and Vibration, vol. 224, Jul. 1999, pp. 123-165.
Tucker et al., "On the Effective Control of Torsional Vibrations in Drilling Systems", Journal of Sound and Vibration, vol. 224, Jul. 1999, pp. 101-122.
Brett et al., "Planning and Practical Problem Solving Using and Engineering Simulator", SPE 13206, 59th Annual Technical Conference and Exhibition, 1984, pp. 1-12.
Hibbs, Jr. et al., "Wear Mechanisms for Polycrystalline Diamond Compacts as Utilized for Drilling in Geothermal Environments—Final Report", May 1983, 287 pages.
Burgess et al., "Measuring the Wear of Milled Tooth Bits Using MWD Torque and Weight-on-Bit", SPE/IADC 13475, SPE/IADC 1985 Drilling Conference, Mar. 1985, pp. 453-462.
Reynolds, "Economic Analysis of Drilling Plans and Contractors by Use of a Drilling Systems Approach" SPE 13466, Journal of Petroleum Technology, Jul. 1986, pp. 787-793.
Technical Toolboxes, "DDC Drillstring Vibration Model", Jun. 4, 2004, 11 pages.
Ma et al., "Kinematics of the Cone Bit", Society of Petroleum Engineers Journal, Jun. 1985, pp. 321-329.
Menand et al., "How Bit Profile and Gauges Affect Well Trajectory", SPE 82412, SPE Drilling & Completion, Mar. 2003, pp. 34-41.
Aslaksen et al., "Integrated FEA Modeling Offers System Approach to Drillstring Optimization", IADC/SPE 99018, IADC/SPE Drilling Conference, Feb. 21-23, 2006, Miami Florida, USA, 16 pages.
Pastusek et al., "A Fundamental Model for Prediction of Hole Curvature and Build Rates With Steerable Bottomhole Assemblies", SPE95546, 2005 SPE Annual Technical Conference and Exhibition, Oct. 2005, 7 pages.
Certification and Notarization dated Nov. 12, 2003 from Universe Technical Translation for English Translations of SU-933932; SU-295857; SU-398733; SU-420749; SU-420749; SU-229371; SU-436147; and SU-515867 (1 page).
Glowka, "Development of a Method for Predicting the Performance and Wear of PDC Drill Bits", prepared by Sandi National Laboratories, Albuquerque, NM 87185, Sep. 1987, 206 pages.

* cited by examiner

METHODS FOR MODELING, DESIGNING, AND OPTIMIZING THE PERFORMANCE OF DRILLING TOOL ASSEMBLIES

CROSS-REFERENCE TO RELATED APPLICATIONS

This application claims the benefit under 35 U.S.C. §120 as a continuation-in-part of U.S. application Ser. No. 09/689,299 U.S. Pat. No. 6,785,641, filed Oct. 11, 2000 and titled "Simulating the Dynamic Response of a Drilling Tool Assembly and Its Performance Optimization," which is incorporated herein by reference in its entirety. This application also claims the benefit under 35 U.S.C. §119(e) of U.S. Provisional Application No. 60/485,642 filed Jul. 9, 2003 and titled "Methods for Modeling, Designing, and Optimizing Fixed Cutter Bits," which is also incorporated herein by reference in its entirety.

Further, U.S. Publication No. 2005-0133272 entitled "Methods for Modeling, Displaying, Designing, And Optimizing Fixed Cutter Bits," filed on Jul. 9, 2004, U.S. Publication No. 2005-0080595 entitled "Methods for Designing Fixed Cutter Bits and Bits Made Using Such Methods," filed on Jul. 9, 2004, and U.S. Publication No. 2005-0015229 entitled "Methods For Modeling Wear Of Fixed Cutter Bits And For Designing And Optimizing Fixed Cutter Bits," filed on Jul. 9, 2004 are incorporated herein by reference in their entireties.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

STATEMENT REGARDING FEDERALLY SPONSORED RESEARCH

Not applicable.

BACKGROUND OF THE INVENTION

1. Field of the Invention

The invention relates generally to drilling through earth formations, and more specifically to simulating the drilling performance of a drilling tool assembly in drilling a wellbore through earth formations. The invention also relates to methods for modeling the dynamic response of a drilling tool assembly, methods for designing a drilling tool assembly, and methods for optimizing the performance of a drilling tool assembly.

2. Background Art

FIG. 1 shows one example of a conventional drilling system for drilling through earth formation. The drilling system includes a drilling rig 10 used to turn a drilling tool assembly 12 which extends downward into a wellbore 14. The drilling tool assembly 12 includes a drill string 16, and a bottomhole assembly (BHA) 18, attached to the distal end of the drill string 16.

The drill string 16 comprises several joints of drill pipe 16*a* connected end to end through tool joints 16*b*. The drill string 16 transmits drilling fluid (through its hollow core) and transmits rotational power from the drill rig 10 to the BHA 18. Additional components may also be included as part of the drilling tool assembly, including components such as subs, pup joints, etc.

The BHA 18 is generally considered to include at least a drill bit 20. Typical BHAs may include additional components disposed between the drill string 16 and the drill bit 20. Examples of additional BHA components include drill collars, stabilizers, measurement-while-drilling (MWD) tools, logging-while-drilling (LWD) tools, subs, hole enlargement devices (e.g., hole openers and reamers), jars, accelerators, thrusters, downhole motors, and rotary steerable systems.

In general, drilling tool assemblies 12 may include other drilling components and accessories, such as special valves, including kelly cocks, blowout preventers, and/or safety valves. Additional components included in a drilling tool assembly 12 may be considered a part of the drill string 16 or a part of the BHA 18 depending on their locations in the drilling tool assembly 12.

The drill bit 20 of the BHA 18 may be any type of drill bit suitable for drilling earth formation. Two common types of earth boring bits used for drilling earth formations are fixed-cutter bits and roller cone bits. One example of a fixed-cutter bit is shown in FIG. 2. One example of a roller cone bit is shown in FIG. 3.

Referring to FIG. 2, fixed-cutter bits (also called drag bits) 21 typically comprise a bit body 22 having a threaded connection at one end 24 and a cutting head 26 formed at the other end. The head 26 of the fixed-cutter bit 21 typically comprises a plurality of blades 28 arranged about the rotational axis of the bit and extending radially outward from the bit body 22. Cutting elements 29 are embedded in the blades 28 to cut through earth formation as the bit is rotated on the earth formation. Cutting elements 29 of fixed-cutter bits, such as the one shown in FIG. 2, typically comprise polycrystalline diamond compacts (PDC) or specially manufactured diamond or other superabrasive material cutters. These bits are typically referred to as PDC bits.

Referring to FIG. 3, roller cone bits 30 typically comprise a bit body 32 having a threaded connection at one end 34 and one or more legs (typically three) extending from the other end. A roller cone 36 is mounted on each of the legs and is able to rotate with respect to the bit body 32. On each cone 36 of the bit 30 are a plurality of cutting elements 38, typically arranged in rows about the surface of the cone 36 to contact and cut through formation encountered by the bit. Roller cone bits 30 are designed such that as a drill bit rotates on earth formation in a wellbore, the cones 36 of the bit 30 roll on the bottom surface of the wellbore (called the "bottomhole") and the cutting elements 38 scrape and crush the formation beneath them. The cutting elements 38 on the roller cone bit 30 may comprise milled steel teeth formed on the surface of the cones 36 or inserts embedded in the cones. Typically, inserts are tungsten carbide inserts or polycrystalline diamond compacts. In the case of roller cone bits or fixed cutter bits hardfacing may be applied to the surface of the cutting elements and the cones or blades of the bit to improve the wear resistance of the cutting structure.

For a drill bit 20 to drill through formation, sufficient rotational moment and axial force must be applied to the bit 20 to cause the cutting elements of the bit 20 to cut into and/or crush formation as the bit is rotated. The axial force applied to the bit is a portion of the weight of the drilling tool assembly. The drilling tool assembly is typically supported at the rig by a suspending mechanism (or hook), and the portion of the weight of the drilling tool assembly supported at the rig 10 by the suspending mechanism is typically referred to as the hook load. The portion of the drilling tool assembly weight applied as an axial force on the bit 20 is typically referred to as the "weight on bit" (WOB). The rotational moment applied to the drilling tool assembly 12 at the drill rig 10 (usually by a rotary table or top drive mechanism) to turn the drilling tool assembly 12 is referred to as the "rotary torque". The speed at which the rotary table or top drive mechanism rotates the drilling tool assembly 12, typically measured in revolutions per minute (RPM), is referred to as the "rotary speed".

During drilling, the actual WOB is not constant. Some of the fluctuation in the force applied to the bit may be the result of the bit contacting the formation having harder and softer portions that break unevenly. However, in most cases, the majority of the fluctuation in the WOB can be attributed to drilling tool assembly vibrations in the wellbore. Drilling tool assemblies can extend more than a mile in length while being less than a foot in diameter. As a result, these assemblies are relatively flexible along their length and may vibrate when driven rotationally by a rotary table. Several modes of vibration are possible for drilling tool assemblies. In general, drilling tool assemblies may experience torsional, axial and lateral vibrations. Although partial damping of vibration may result due to viscosity of drilling fluid, friction of the drill string rubbing against the wall of the wellbore, energy absorbed in drilling the formation, and drilling tool assembly impacting with wellbore wall, these sources of damping are typically not enough to suppress vibrations completely.

Vibrations of a drilling tool assembly have been difficult to predict because different forces may combine to produce the various modes of vibration, and models for simulating the response of an entire drilling tool assembly including a drill bit interacting with formation in a drilling environment have not been available. Drilling tool assembly vibrations are generally undesirable, not only because they are difficult to predict, but also because they can significantly affect the instantaneous force applied on the bit. This can result in the bit not operating as expected. For example, vibrations can result in off-centered drilling, lack of control in the direction of drilling, slower rates of penetration, excessive wear of the cutting elements, or premature failure of the cutting elements and the bit. Lateral vibration of the drilling tool assembly may be a result of radial force imbalances, mass imbalance, and bit/formation interaction, among other things. Lateral vibration results in poor drilling tool assembly performance, overgage hole drilling, out-of-round, or "lobed" wellbores and premature failure of both the cutting elements and bit bearings.

When the bit wears out or breaks during drilling, the entire drilling tool assembly must be lifted out of the wellbore section-by-section and disassembled in an operation called a "pipe trip". In this operation, a heavy hoist is required to pull the drilling tool assembly out of the wellbore in stages so that each stand of pipe (typically pipe sections of about 90 feet) can be unscrewed and racked for the later re-assembly. Because a drilling tool assembly may extend for more than a mile, pipe trips can take several hours and can pose a significant expense to the wellbore operator and drilling budget. Therefore, the ability to design drilling tool assemblies which have increased durability and longevity, for example, by minimizing the wear on the drilling tool assembly due to vibrations, is very important and greatly desired to minimize pipe trips out of the wellbore and to more accurately predict the resulting geometry of the wellbore drilled.

Simulation methods have been previously introduced which characterize either the interaction of a bit with the bottomhole surface of a wellbore under fixed condition or the dynamics of a bottomhole assembly (BHA) with representative factors assumed for the influence of the drill string and the drill bit. However, no prior art simulation techniques have been developed to cover the dynamic modeling of an entire drilling tool assembly which includes the simulated interaction of the drill bit with the bottomhole surface, until the development of methods disclosed in U.S. Pat. No. 6,785,641, filed Oct. 11, 2000 and incorporated herein by reference. Prior to this disclosure, the dynamic response of a drilling tool assembly or the effect of a change in configuration on drilling tool assembly performance could not be accurately predicted. Thus, numerous sensors, measurement devices, and control systems were employed in drilling to determine a more accurate prediction of the drilling response of a given drilling tool assembly, which significantly added to the overall cost of drilling the well.

As disclosed in U.S. Pat. No. 6,785,641, simulation methods for PDC drill bits have been previously disclosed, such as the methods described in SPE Paper No. 15618 by T. M. Warren et. al., entitled "Drag Bit Performance Modeling" and the methods disclosed in U.S. Pat. No. 4,815,342, U.S. Pat. No. 5,010,789, U.S. Pat. No. 5,042,596, and U.S. Pat. No. 5,131,479 to Brett et al. Also disclosed are methods for defining the bit geometry, and methods for modeling forces on cutting elements and methods for determining cutting element wear based. Modeling cutting element/earth formation interaction is also discussed in SPE Paper No. 15617 by T. M. Warren et al., entitled "Laboratory Drilling Performance of PDC Bits".

A method for determining the interaction between a roller cone bit and earth formations during drilling is described in U.S. Pat. No. 6,516,293 to Huang et al. and entitled "Method for Simulating Drilling of Roller Cone Bits and its Application to Roller Cone Bit Design and Performance". This patent is assigned to the assignee of the present invention and incorporated herein by reference.

While prior art simulation methods, such as those described above may be used to determine an interaction of a bit with earth formation independent of a drill string, or may be used to determine the dynamics of a BHA with assumed characteristics for the drill string and bit, no prior art simulation technique covered the dynamic modeling of the entire drilling tool assembly, prior to U.S. Pat. No. 6,785,641, filed Oct. 11, 2000 and titled "Simulating the Dynamic Response of a Drilling Tool Assembly and Its Application to Drilling Tool Assembly Design Optimization and Drilling Performance Optimization," which is incorporated herein by reference. Because previous simulation methods do not take into account the dynamic response of the entire drilling tool assembly to the calculated interaction of cutting elements with earth formation during drilling, accurately predicting the response of a given drilling tool assembly in drilling a particular formation was virtually impossible. Additionally, the change in the dynamic response of a drilling tool assembly when a component of the drilling tool assembly was changed was not well understood.

In view of the above, a method for simulating the dynamic response of an entire drilling tool assembly, which takes into account bit interaction with the bottom surface of the wellbore, drilling tool assembly interaction with the wall of the wellbore, and damping effects of the drilling fluid on the drill string is both needed and desired. Additionally, a more accurate model for predicting and visually displaying the performance of a drilling tool assembly including a fixed cutter drill bit, and for determining optimal drilling tool assembly designs and/or optimal drilling operating parameters for optimal drilling tool assembly performance for a particular drilling operation in particular earth formation is desired.

SUMMARY OF THE INVENTION

One aspect of the invention relates to methods for designing a drilling tool assembly, having a drill bit disposed at one end. A method in accordance with one embodiment of the invention includes defining initial drilling tool assembly design parameters; calculating a dynamic response of the drilling tool assembly; adjusting a value of a drilling tool assembly design parameter; and repeating the calculating and the adjusting until a drilling tool assembly performance parameter is optimized.

One aspect of the invention relates to methods for determining a performance of a drilling tool assembly. A method in accordance with one embodiment of the invention includes generating a geometric model of the drilling tool assembly and a geometric well trajectory model of a earth formation; simulating the drilling tool assembly drilling the earth formation; determining the drilling tool assembly interaction with the earth formation; and determining forces acting on a drill bit in the drilling tool assembly.

One aspect of the invention relates to methods for analyzing a drilling tool assembly design. A method in accordance with one embodiment of the invention includes calculating a response of the drilling tool assembly including a response of a drill bit disposed at one end of the drilling tool assembly; adjusting a value of at least one drilling tool assembly design parameter; and repeating the calculating.

One aspect of the invention relates to methods for determining at least one optimal drilling operating parameter for a drilling tool assembly that includes a drill bit disposed at one end. A method in accordance with one embodiment of the invention includes calculating a dynamic response of the drilling tool assembly; adjusting a value of at least one drilling operating parameter based on the dynamic response; and repeating the calculating and the adjusting until a drilling performance parameter is optimized.

Other aspects and advantages of the invention will be apparent from the following description and the appended claims.

DETAILED DESCRIPTION OF PREFERRED EMBODIMENTS

The present invention provides methods for predicting the dynamic response of a drilling tool assembly drilling an earth formation, methods for optimizing a drilling tool assembly design, methods for optimizing drilling operation parameters, and methods for optimizing drilling tool assembly performance.

Methods for determining the dynamic response of a drilling tool assembly to drilling interaction with an earth formation were initially disclosed in U.S. patent application Ser. No. 09/689,299 by Huang, which is assigned to the assignee of the present invention and incorporated herein by reference. New methods developed for modeling fixed cutter drill bits are disclosed in U.S. Patent Application No. 60/485,642 by Huang, filed on Jul. 9, 2003, titled "Method for Modeling, Designing, and Optimizing Fixed Cutter Bits," assigned to the assignee of the present application and incorporated herein by reference in its entirety. Methods disclosed in the '642 application may advantageously allow for a more accurate prediction of the actual performance of a fixed cutter bit in drilling selected formations by incorporating the use of actual cutting element/earth formation interact data or related empirical formulas to accurately predict the interaction between cutting elements and earth formations during drilling. Embodiments of the invention disclosed herein relate to the use methods disclosed in the '299 combined with methods disclosed in the '642 application and other novel methods related to drilling tool assembly design.

Figure 1:
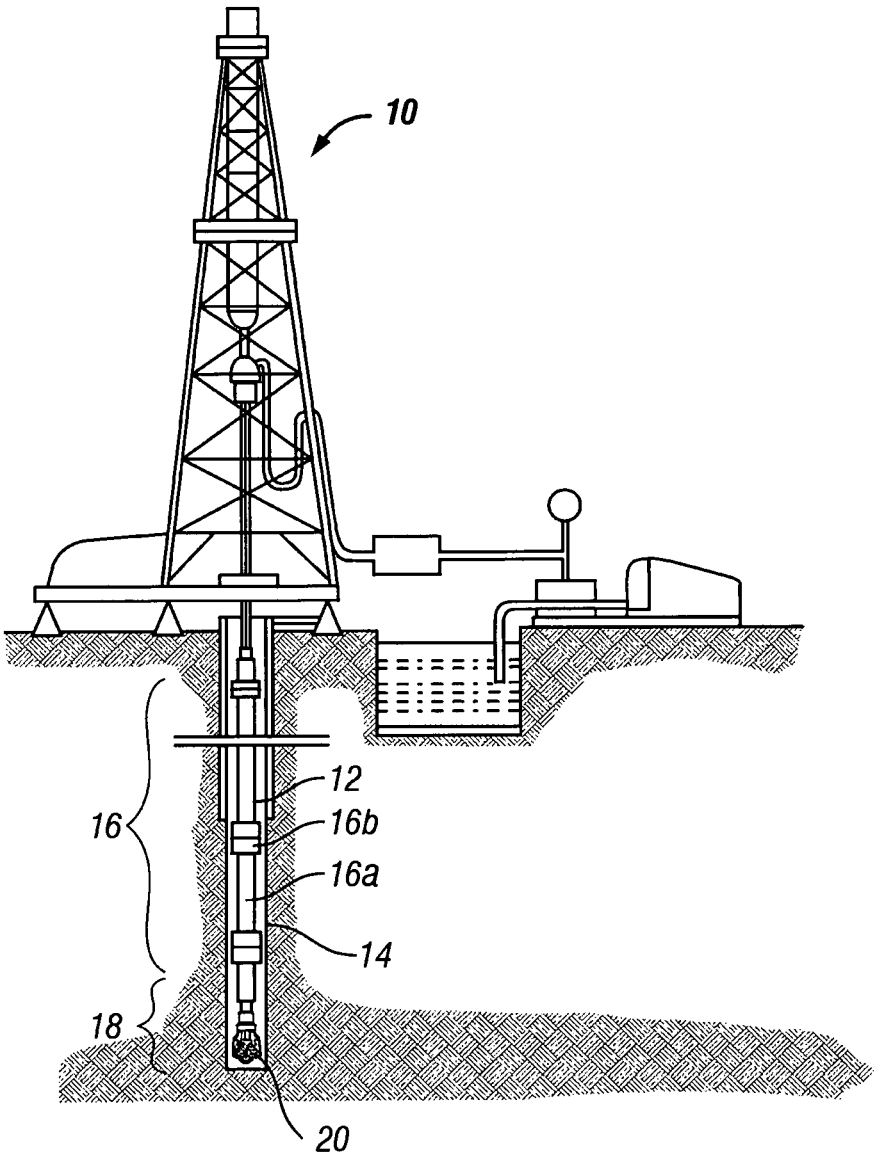
FIG. 1 (Prior Art)
FIG. 1 shows a schematic diagram of a conventional drilling system for drilling earth formations.
Figure 2:
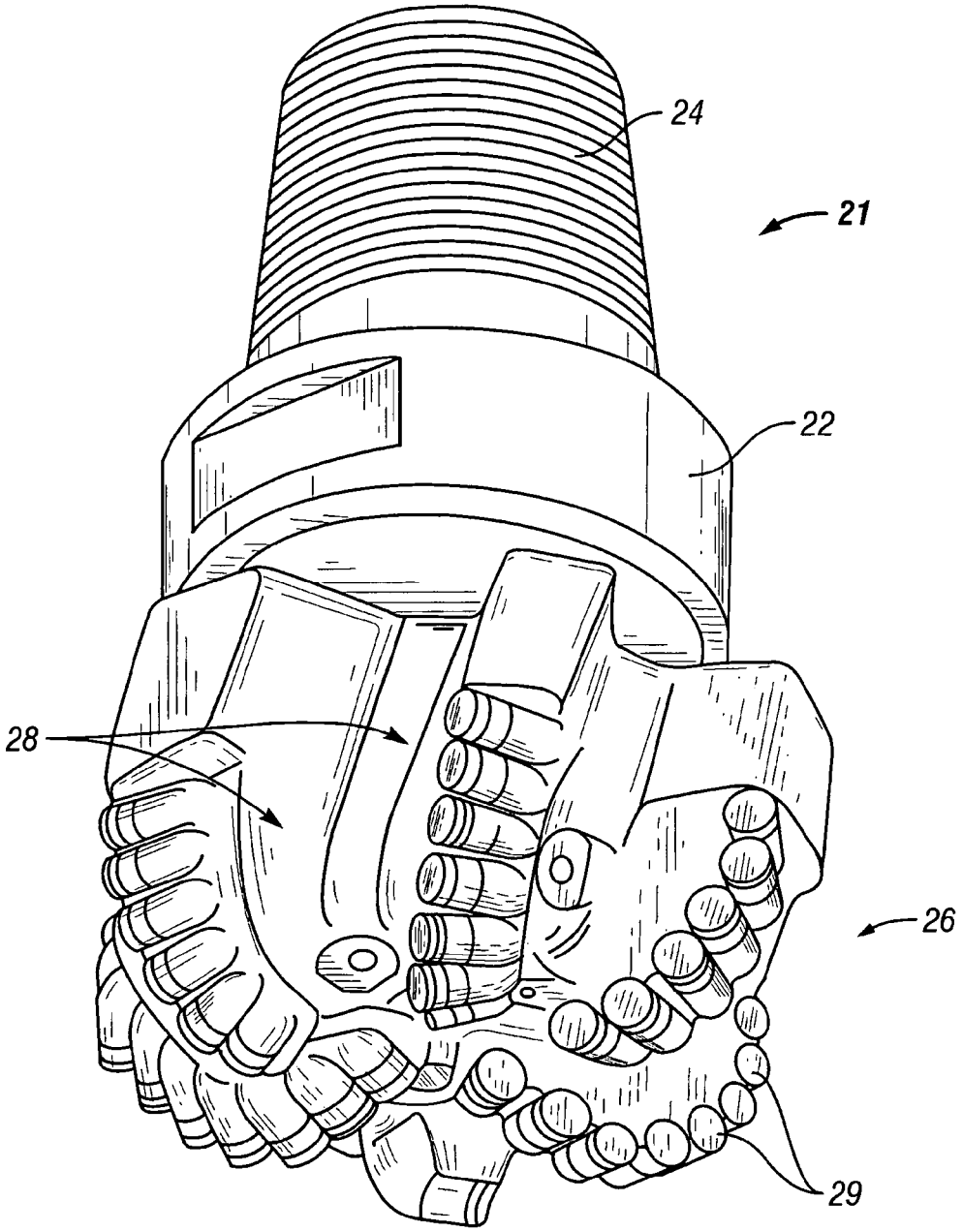
FIG. 2 (Prior Art)
FIG. 2 shows a perspective view of a prior art fixed-cutter bit.
Figure 3:
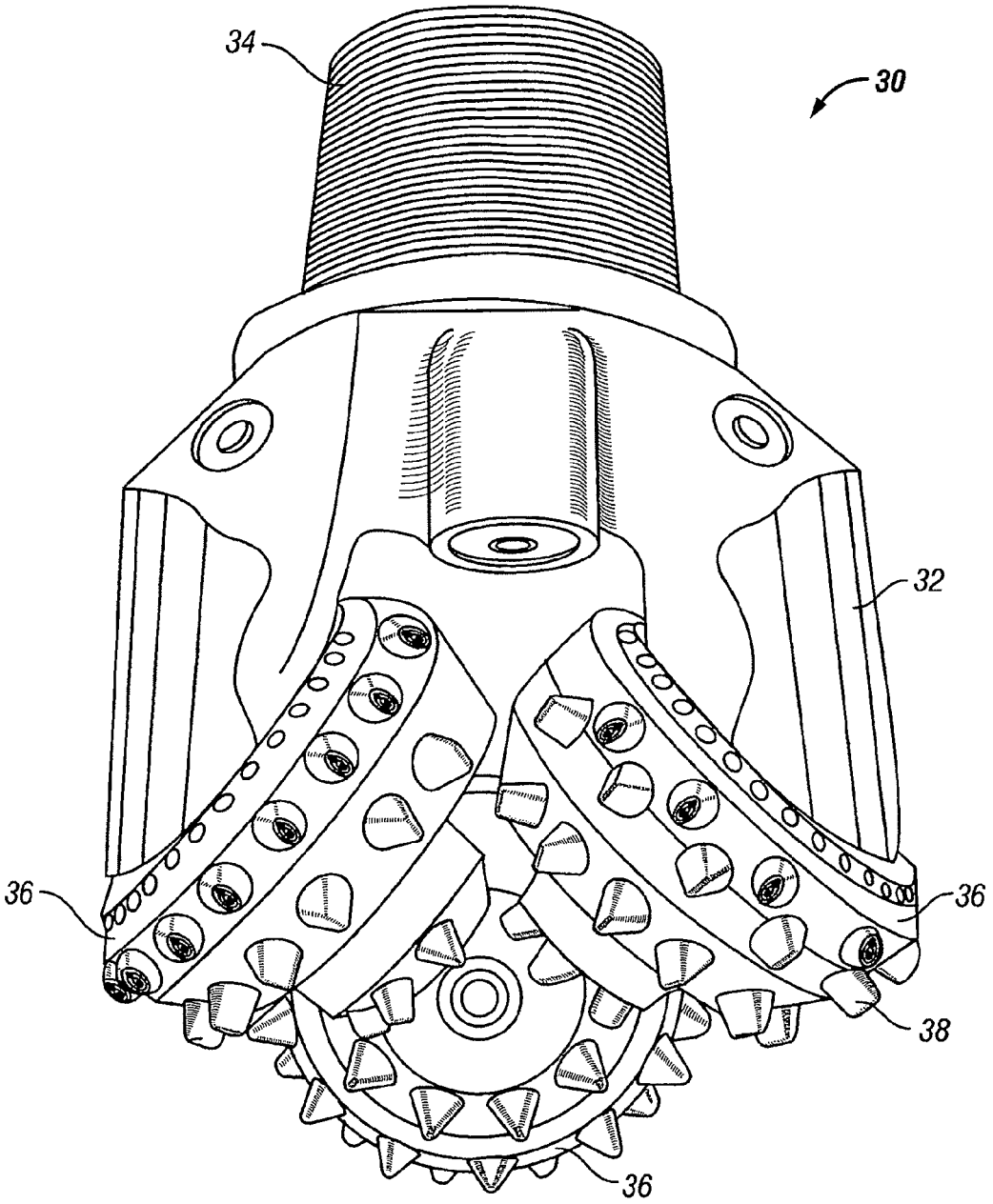
FIG. 3 (Prior Art)
FIG. 3, shows one example of a prior art roller cone drill bit.

FIG. 1 shows one example of a drilling tool assembly that may be designed, modeled, or optimized in accordance with one or more embodiments of the invention. The drilling tool assembly includes a drill string 16 coupled to a bottomhole assembly (BHA) 18. The drill string 16 includes one or more joints of drill pipe. A drill string may further include additional components, such as tool joints, a kelly, kelly cocks, a kelly saver sub, blowout preventers, safety valves, and other components known in the art. The BHA 18 includes at least a drill bit. A BHA 18 may also include one or more drill collars, stabilizers, a downhole motor, MWD tools, and LWD tools, jars, accelerators, push the bit directional drilling tools, pull the bit directional drilling tools, point stab tools, shock absorbers, bent subs, pup joints, reamers, valves, and other components.

While in practice, a BHA comprises at least a drill bit, in embodiments of the invention described below, the parameters of the drill bit, required for modeling interaction between the drill bit and the bottomhole surface, are generally considered separately from the BHA parameters. This separate consideration of the bit allows for interchangeable use of any drill bit model as determined by the system designer.

To simulate the dynamic response of a drilling tool assembly, such as the one shown in FIG. 1, components of the drilling tool assembly need to be mathematically defined. For example, the drill string may be defined in terms of geometric and material parameters, such as the total length, the total weight, inside diameter (ID), outside diameter (OD), and material properties of each of the various components that make up the drill string. Material properties of the drill string components may include the strength, and elasticity of the component material. Each component of the drill string may be individually defined or various parts may be defined in the aggregate. For example, a drill string comprising a plurality of substantially identical joints of drill pipe may be defined by the number of drill pipe joints of the drill string, and the ID, OD, length, and material properties for one drill pipe joint. Similarly, the BHA may be defined in terms of geometrical and material parameters of each component of the BHA, such as the ID, OD, length, location, and material properties of each component.

The geometry and material properties of the drill bit also need to be defined as required for the method selected for simulating drill bit interaction with earth formation at the bottom surface of the wellbore. Examples of methods for modeling drill bits are known in the art, see for example U.S. Pat. No. 6,516,289 to Huang and U.S. Pat. No. 6,213,225 to Chen for roller cone bits and U.S. Pat. No. 4,815,342; U.S. Pat. No. 5,010,789; U.S. Pat. No. 5,042,596; and U.S. Pat. No. 5,131,479, each to Brett et al. for fixed cutter bits, which are each hereby incorporated by reference in their entirety. Other methods for modeling, designing, and optimizing fixed cutter drill bits are also disclosed in U.S. Patent Application No. 60/485,642, previously incorporated herein by reference.

To simulate the dynamic response of a drilling tool assembly drilling through an earth formation, the wellbore trajectory in which the drilling tool assembly is to be confined should also be defined mathematically along with its initial bottomhole geometry. The wellbore trajectory may be straight, curved, or a combination of straight and curved sections at various angular orientations. The wellbore trajectory may be defined in terms of parameters for each of a number of segments of the trajectory. For example, a wellbore defined as comprising N segments may be defined by the length, diameter, inclination angle, and azimuth direction of each segment along with an index number indicating the order of the segments. The material or material properties of the formation defining the wellbore surfaces can also be defined.

Additionally, drilling operation parameters, such as the speed at which the drilling tool assembly is rotated and the rate of penetration or the weight on bit (which may be determined from the weight of the drilling tool assembly suspended at the hook) are also defined. Once the drilling system parameters are defined, they can be used along with selected interaction models to simulate the dynamic response of the drilling tool assembly drilling an earth formation as discussed below.

Method for Simulating

In one aspect, the invention provides a method for determining the dynamic response of a drilling tool assembly during a drilling operation. Advantageously, in one or more embodiments, the method takes into account interaction between an entire drilling tool assembly and the drilling environment. The interaction includes the interaction between the drill bit at the end of the drilling tool assembly and the formation at the bottom of the wellbore. The interaction between the drilling tool assembly and the drilling environment may also include the interaction between the drilling tool assembly and the side (or wall) of the wellbore. Further, interaction between the drilling tool assembly and drilling environment may include the viscous damping effects of the drilling fluid on the dynamic behavior of the drilling tool assembly. In addition, the drilling fluid also provides buoyancy to the various components in the drilling tool assembly, reducing the effective masses of these components.

Figure 4:
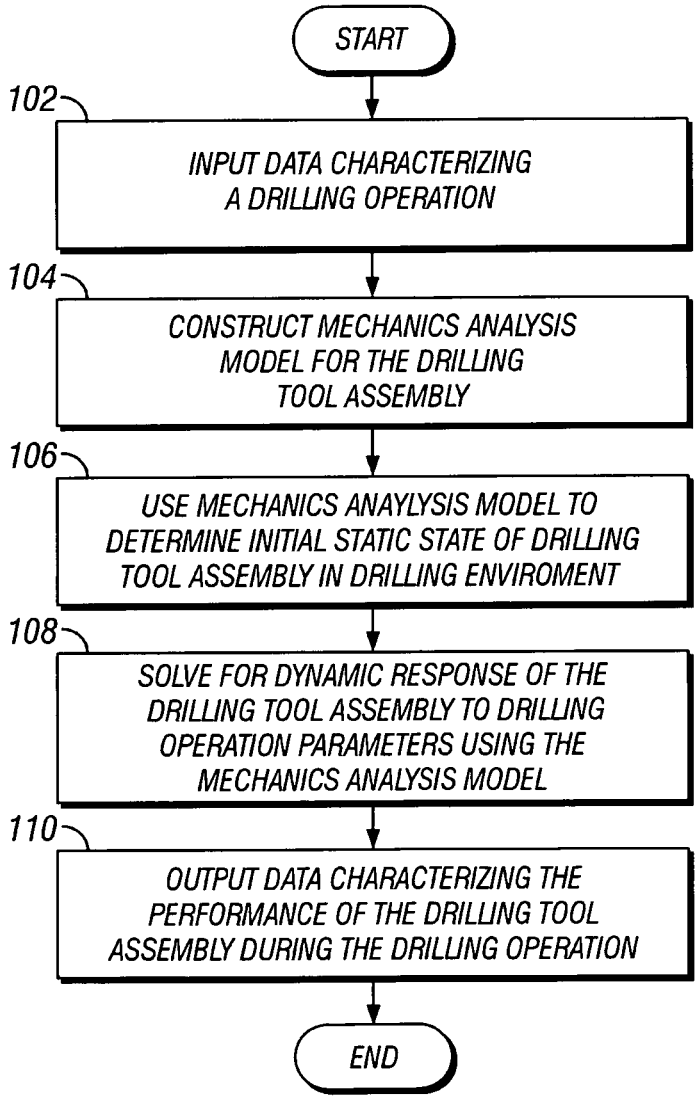
FIG. 4 shows a flow chart of a method for determining the dynamic response of a drilling tool assembly drilling through earth formation.

A flow chart for one embodiment of a method in accordance with an aspect of the present invention is shown in FIG. 4. The method includes inputting data characterizing a drilling operation to be simulated 102. The input data may include drilling tool assembly parameters, drilling environment parameters, and drilling operation parameters. The method also includes constructing a mechanics analysis model for the drilling tool assembly 104. The mechanics analysis model can be constructed using finite element analysis with drilling tool assembly parameters and Newton's law of motion. The method further includes determining an initial static state of the drilling tool assembly in the drilling environment 106 using the mechanics analysis model along with drilling environment parameters. Then, based on the initial static state and operational parameters provided as input, the dynamic response of the drilling tool assembly in the drilling environment is incrementally calculated 108.

Results obtained from calculation of the dynamic response of the drilling tool assembly are then provided as output data. The output data may be input into a graphics generator and used to graphically generate visual representations characterizing aspects of the performance of the drilling tool assembly in drilling the earth formation 110.

Figure 5:
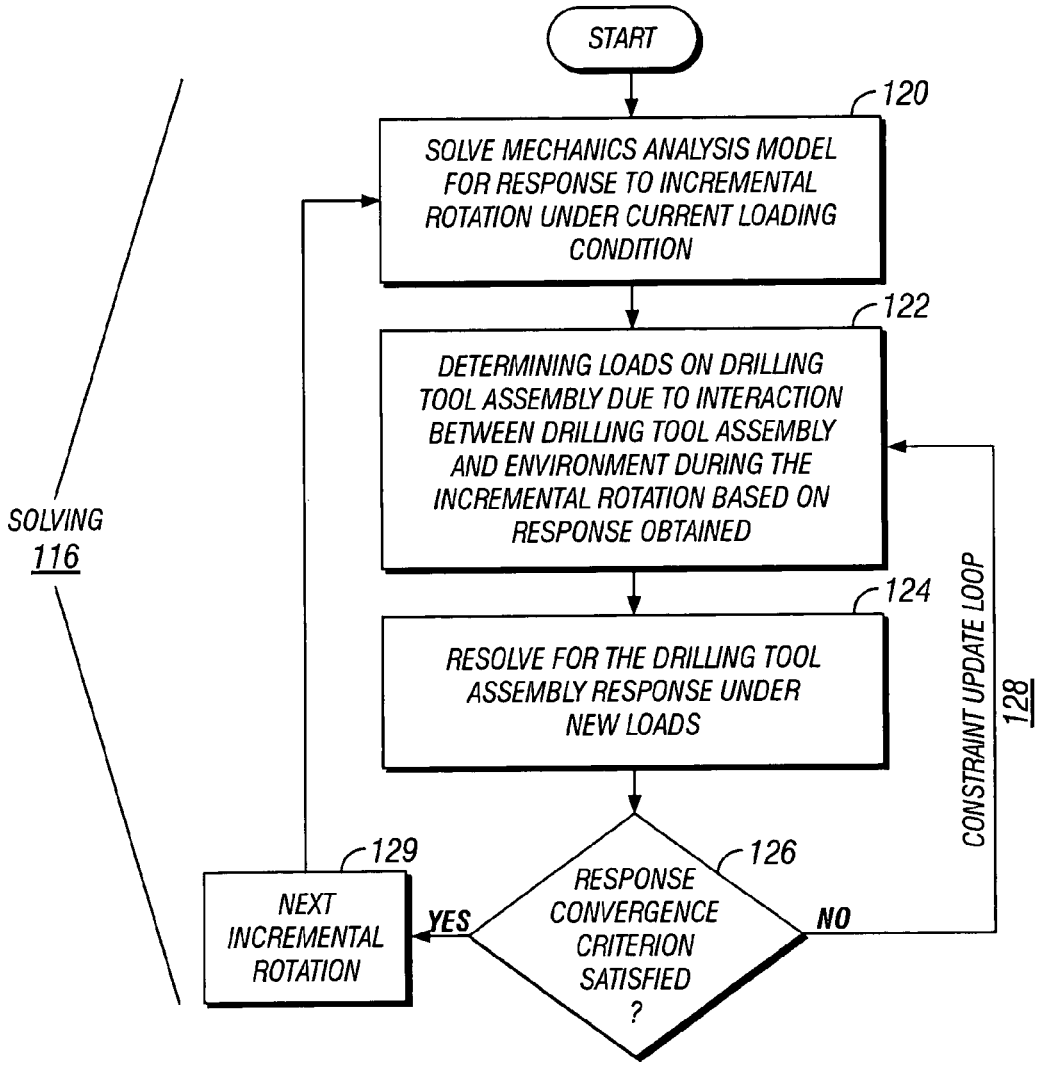
FIG. 5 shows a flow chart of one embodiment of the method predicting the dynamic response of a drilling tool assembly drilling through earth formation in accordance with the method shown in FIG. 4.

In one example, illustrated in FIG. 5, solving for the dynamic response 116 may not only include solving the mechanics analysis model for the dynamic response to an incremental rotation 120, but may also include determining, from the response obtained, loads (e.g., drilling environment interaction forces, bending moments, etc.) on the drilling tool assembly due to interaction between the drilling tool assembly and the drilling environment during the incremental rotation 122, and resolving for the response of the drilling tool assembly to the incremental rotation 124 under the newly determined loads. The determining and resolving may be repeated in a constraint update loop 128 until a response convergence criterion 126 is satisfied.

For example, assuming the simulation is performed under a constant WOB, with each incremental rotation 120, the drill bit is rotated by a small angle and moved downward (axially) by a small distance. During this movement, the interference between the drill bit and the bottom of the hole generates counter force acting against the drill bit (loads). If the load is more than the WOB, then the rotation or downward movement of the drill bit is too much. The parameters (constraints) should be adjusted (e.g., reduced the downward movement distance) and the incremental rotation 120 is again performed. On the other hand, the load after the incremental rotation 120 is less than the WOB, then the incremental rotation 120 should be performed with a larger angular or axial movement. These steps (incremental rotation, load calculation, comparison with a criterion, adjustment of constraints) are repeated until the computed load from the incremental rotation is within a selected criterion (step 126). Once a convergence criterion is satisfied, the entire incremental solving process 116 may be repeated for successive increments 129 until an end condition for simulation is reached.

During the simulation, the constraint forces initially used for each new incremental calculation step may be the constraint forces determined during the last incremental rotation. In the simulation, incremental rotation and calculations are repeated for a select number of successive incremental rotations until an end condition for simulation is reached. A flow chart of another embodiment of the invention is shown in FIGS. 7A-B.

Figures 1, 7A:
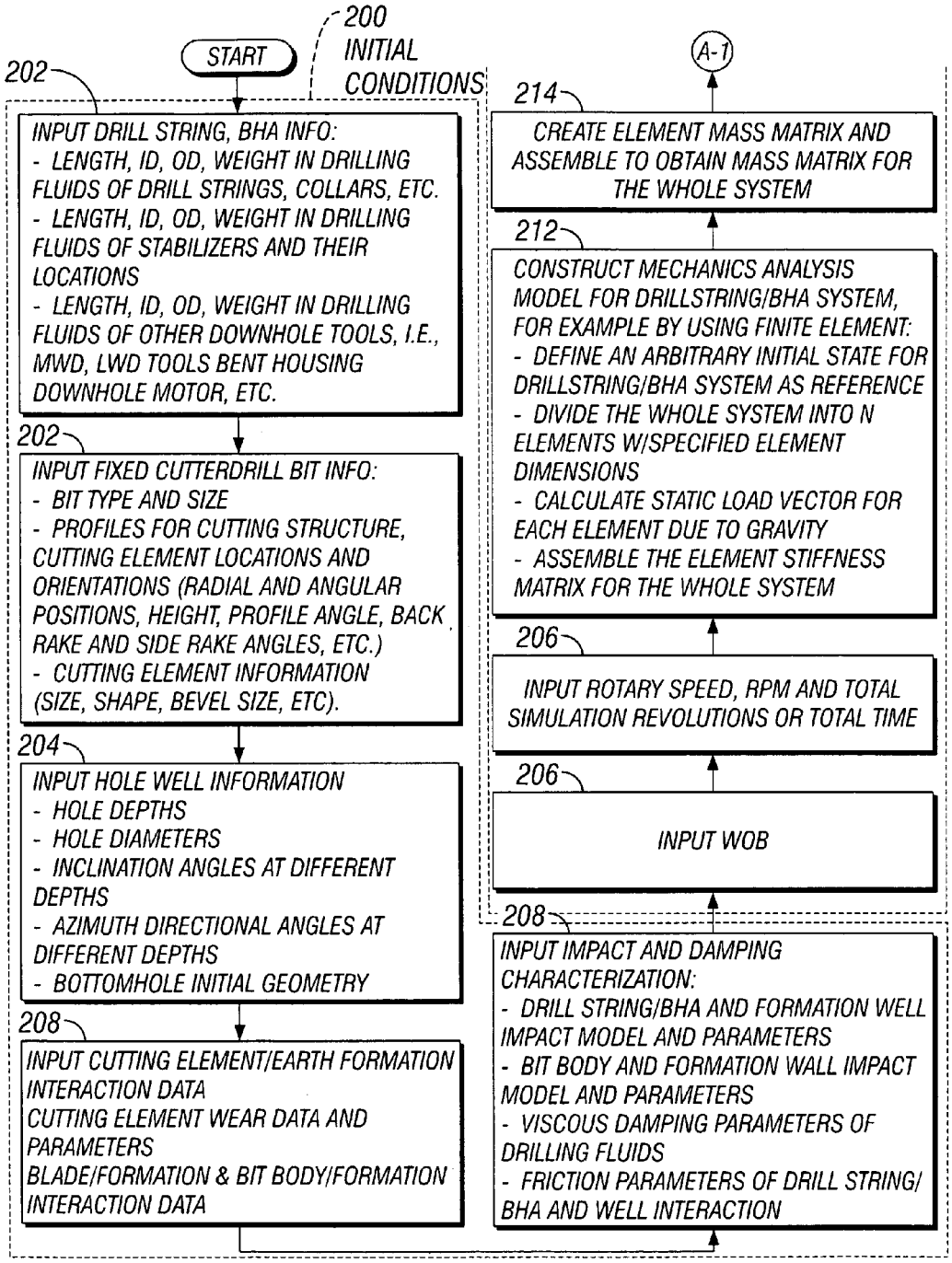
FIGS. 7A-7C shows a flow chart for one embodiment a method in accordance with embodiments of the present invention
Figures 2, 7A:
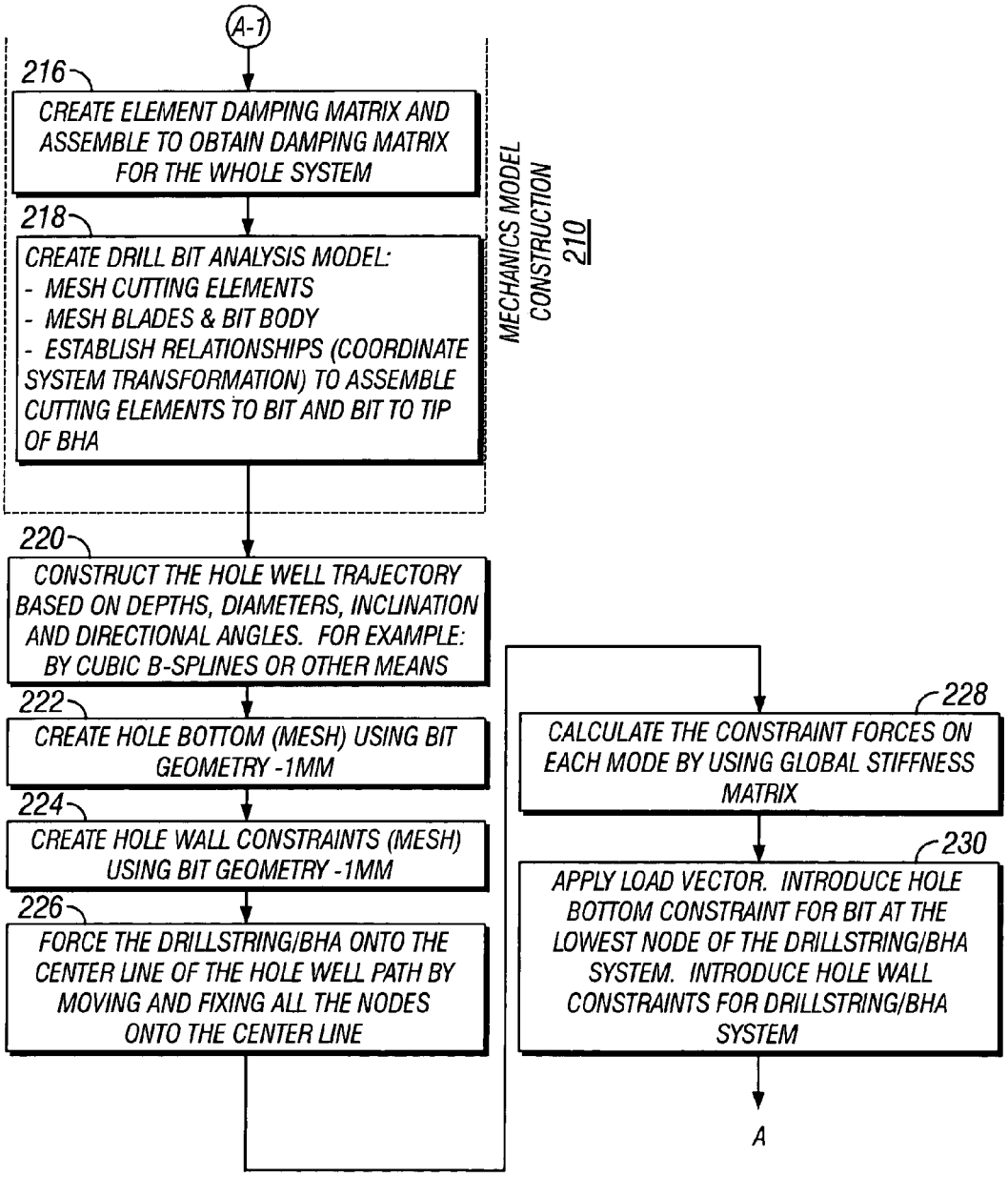
Figures 1, 7B:
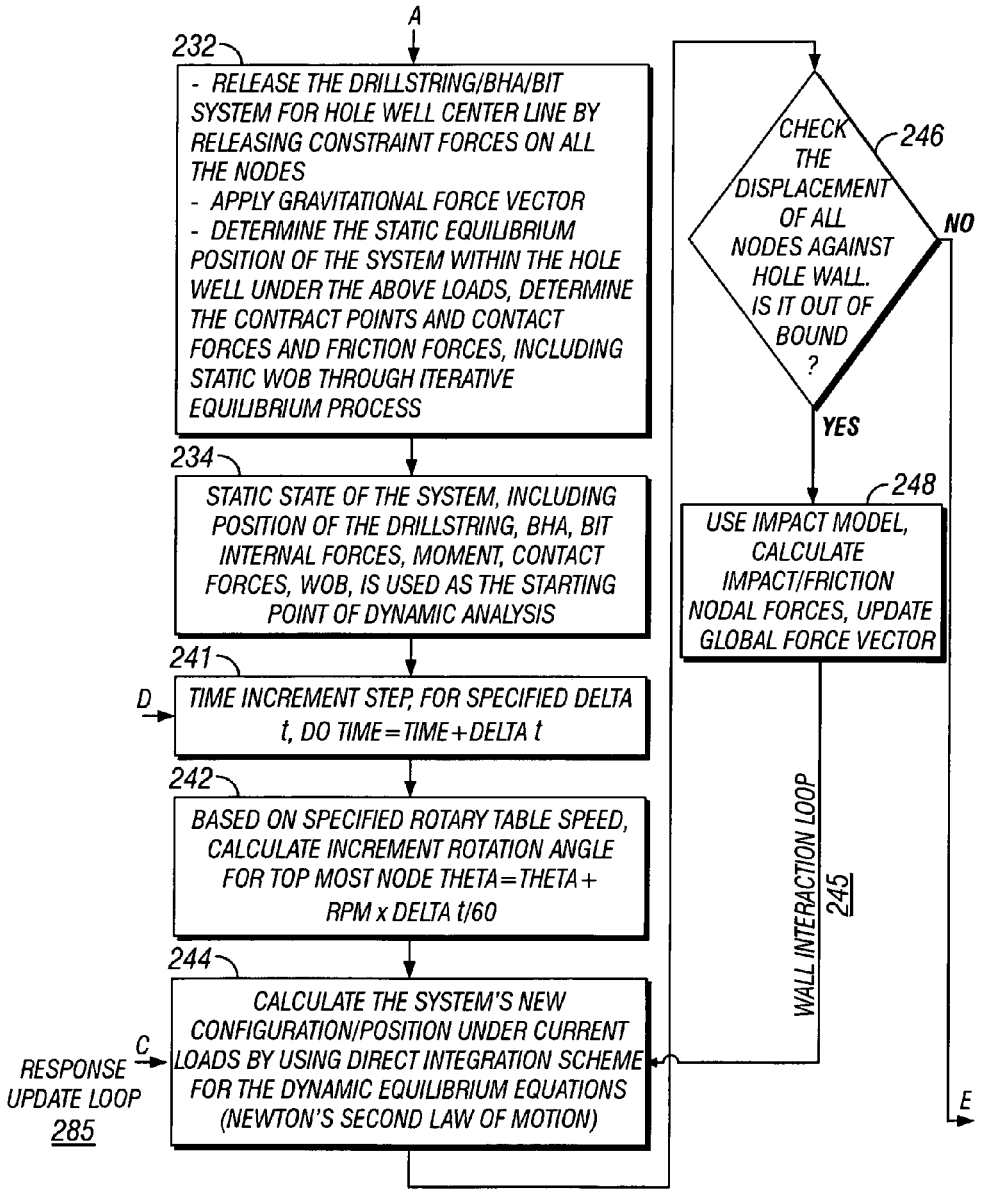
Figures 2, 7B:
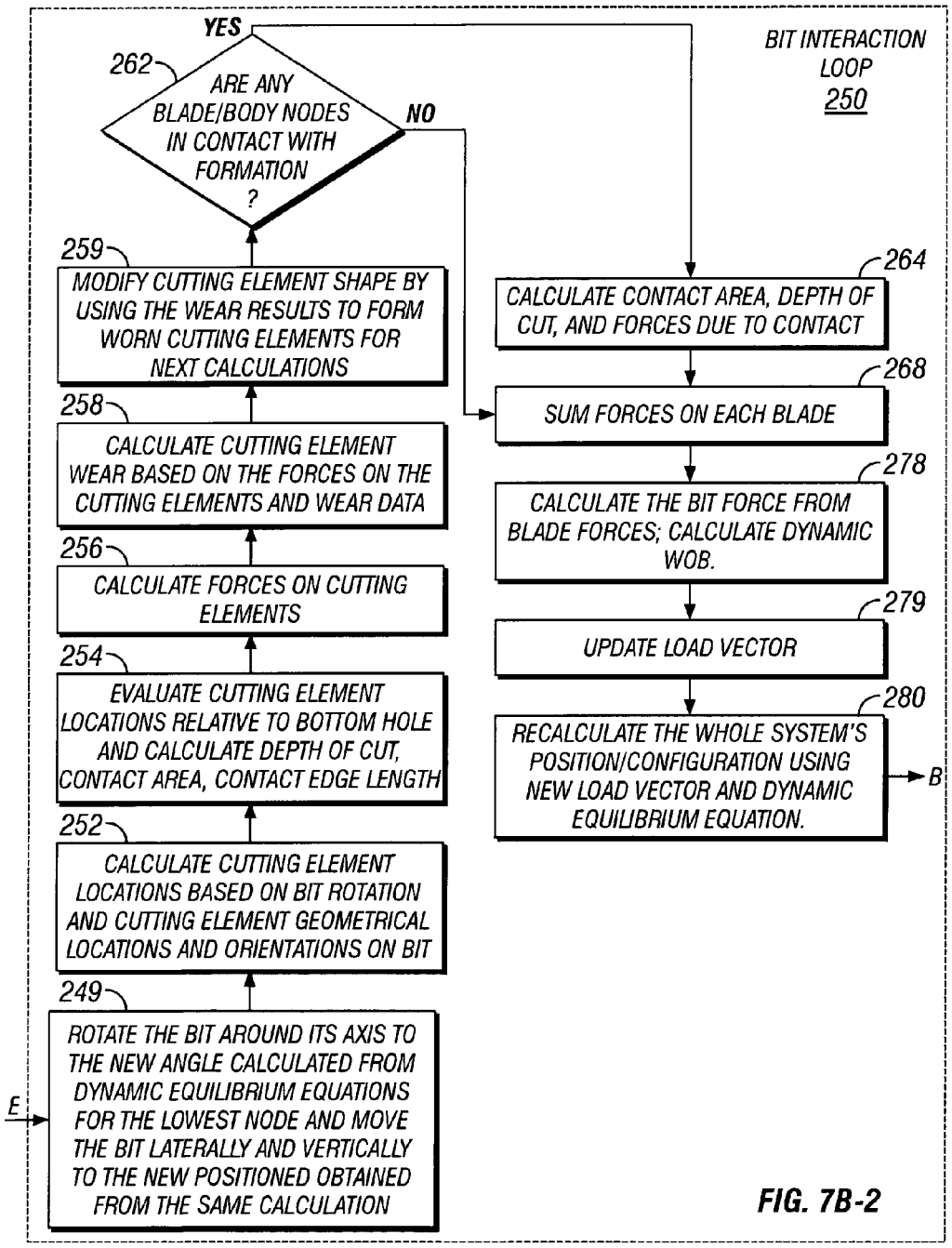

As shown in FIGS. 7A-7B, the parameters provided as input 200 include drilling tool assembly design parameters 202, initial drilling environment parameters 204 and drilling operation parameters 206. Drilling tool assembly/drilling environment interaction parameters are also provided or selected as input 208.

Figure 8:
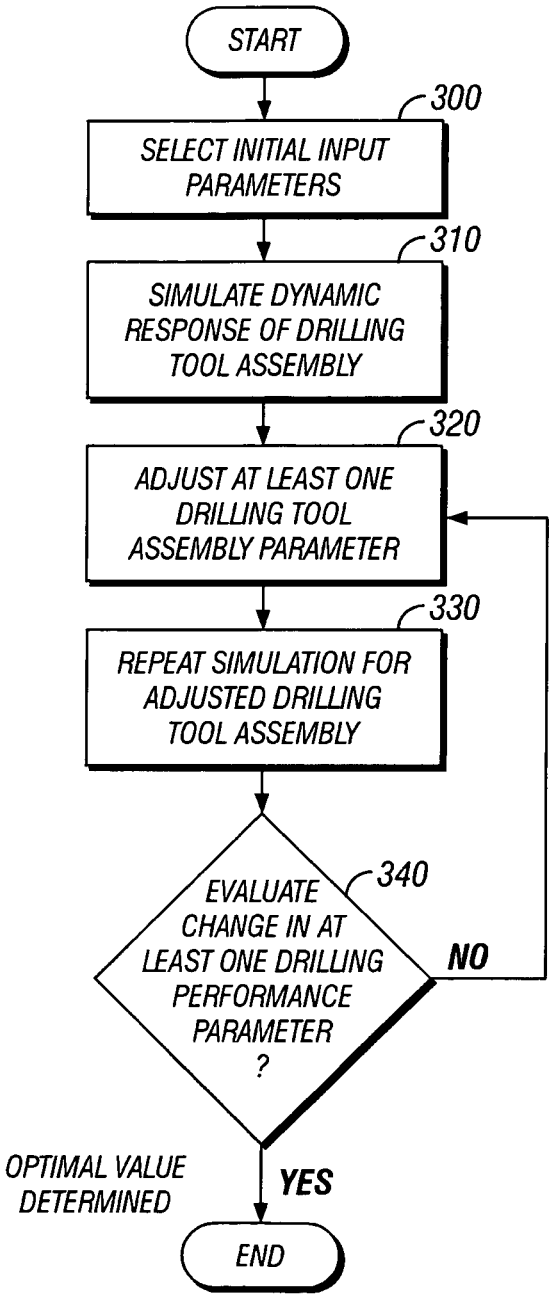
FIG. 8 shows a flow chart of a method for determining an optimal value of at least one drilling tool assembly design parameter.

Drilling tool assembly design parameters 202 include drill string design parameters and BHA design parameters. As illustrated in FIG. 8, the drill string can be defined as a plurality of segments of drill pipe with tool joints and the BHA may be defined as including a number of drill collars, stabilizers, and other downhole components, such as a bent housing motor, MWD tool, LWD tool, thruster, point the bit directional drilling tool, push the bit directional drilling tool, shock absorber, point stab, and a drill bit. One or more of these items may be selected from a library list of tools and used in the design of a drilling tool assembly model, as shown in FIG. 8. Also, while the drill bit is generally considered part of the BHA, the drill bit design parameters are defined in a bit parameter input screen and used separately in a detailed modeling of bit interaction with the earth formation that can be coupled to the drilling tool assembly design model and described below. Considering the detailed interaction of the bit with the earth formation separately in a bit calculation subroutine coupled to the drilling tool assembly model advantageously allows for the interchangeable use of any type of drill bit which can be defined and modeled using any desired drill bit analysis model. The calculated response of the bit interacting with the formation is coupled to the drilling tool assembly design model so that the effect of the selected drill bit interacting with the formation during drilling can be directly determined for the selected drilling tool assembly.

As previously discussed above, drill string design parameters may include the length, inside diameter (ID), outside diameter (OD), weight (or density), and other material properties of the drill string in the aggregate. Alternatively, in one or more embodiments, drill string design parameters may include the properties of each component of the drill string and the number of components and location of each component of the drill string. In the example shown in FIG. 8, the length, ID, OD, weight, and material properties of a segment of drill pipe may be provided as input along with the number of segments of drill pipe that make up the drill string. Material properties of the drill string provided as input may also include the type of material and/or the strength, elasticity and density of the material. The weight of the drill string, or individual segment of the drill string may be provided as its "air" weight or as "weight in drilling fluids" (the weight of the component when submerged in the selected drilling fluid).

BHA design parameters include, for example, the bent angle and orientation of the motor, the length, equivalent inside diameter (ID), outside diameter (OD), weight (or density), and other material properties of each of the various components of the BHA. In the example shown, the drill collars, stabilizers, and other downhole components are defined by their lengths, equivalent IDs, ODs, material properties, and eccentricity of the various parts, their weight in drilling fluids, and their position in the drilling tool assembly recorded.

Drill bit design parameters are also provided as input and used to construct a model for the selected drill bit. Drill bit design parameters include, for example, the bit type (roller cone, fixed-cutter, etc.) and geometric parameters of the bit. Geometric parameters of the bit may include the bit size (e.g., diameter), number of cutting elements, and the location, shape, size, and orientation of the cutting elements. In the case of a roller cone bit, drill bit design parameters may further include cone profiles, cone axis offset (offset from perpendicular with the bit axis of rotation), the number of cutting elements on each cone, the location, size, shape, orientation, etc. of each cutting element on each cone, and any other bit geometric parameters (e.g., journal angles, element spacings, etc.) to completely define the bit geometry. In the case of a fixed cutter bit, the drill bit design parameters may further include the size of the bit, parameters defining the profile and location of each of the blades on the cutting face of the drill bit, the number and location of cutting elements on each blade, the back rake and side rake angles for each cutting element. In general, drill bit, cutting element, and cutting structure geometry may be converted to coordinates and provided as input to the simulation program. In one or more embodiments, the method used for obtaining bit design parameters is the uploading of 3-dimensional CAD solid or surface model of the drill bit to facilitate the geometric input. Drill bit design parameters may further include material properties of the various components that make up the drill bit, such as strength, hardness, and thickness various materials forming the cutting elements, blades, and bit body.

In one or more embodiments, drilling environment parameters 204 include one or more parameters characterizing aspects of the wellbore. Wellbore parameters may include wellbore trajectory parameters and wellbore formation parameters. Wellbore trajectory parameters may include any parameter used in characterizing a wellbore trajectory, such as an initial wellbore depth (or length), diameter, inclination angle, and azimuth direction of the trajectory or a segment of the trajectory. In the typical case of a wellbore comprising different segments having different diameters or directional orientations, wellbore trajectory parameters may include depths, diameters, inclination angles, and azimuth directions for each of the various segments. Wellbore trajectory information may also include an indication of the curvature of each segment, and the order or arrangement of the segments in wellbore. Wellbore formation parameters may also include the type of formation being drilled and/or material properties of the formation such as the formation compressive strength, hardness, plasticity, and elastic modulus. An initial bottom surface of the wellbore may also be provided or selected as input. The bottomhole geometry may be defined as flat or contour and provided as wellbore input. Alternatively, the initial bottom surface geometry may be generated or approximated based on the selected bit geometry. For example, the initial bottomhole geometry may be selected from a "library" (i.e., database) containing stored bottomhole geometries resulting from the use of various drill bits.

In one or more embodiments, drilling operation parameters 206 include the rotary speed (RPM) at which the drilling tool assembly is rotated at the surface and/or a downhole motor speed if a downhole motor is used. The drilling operation parameters also include a weight on bit (WOB) parameter, such as hook load and/or a rate of penetration (ROP). Other drilling operation parameters 206 may include drilling fluid parameters, such as the viscosity and density of the drilling fluid, rotary torque and drilling fluid flow rate. The drilling operating parameters 206 may also include the number of bit revolutions to be simulated or the drilling time to be simulated as simulation ending conditions to control the stopping point of simulation. However, such parameters are not necessary for calculation required in the simulation. In other embodiments, other end conditions may be provided, such as a total drilling depth to be simulated or operator command.

In one or more embodiments, input is also provided to determine the drilling tool assembly/drilling environment interaction models 208 to be used for the simulation. As discussed in U.S. Pat. No. 6,516,293 and U.S. Provisional Application No. 485,642, cutting element/earth formation interaction models may include empirical models or numerical data useful in determining forces acting on the cutting elements based on calculated displacements, such as the relationship between a cutting force acting on a cutting element, the corresponding scraping distance of the cutting element through the earth formation, and the relationship between the normal force acting on a cutting element and the corresponding depth of penetration of the cutting element in the earth formation. Cutting element/earth formation interaction models may also include wear models for predicting cutting element wear resulting from prolonged contact with the earth formation, cutting structure/formation interaction models and bit body/formation interaction models for determining forces on the cutting structure and bit body when they are determined to interact with earth formation during drilling. In one or more embodiments, coefficients of an interaction model may be adjustable by a user to adapt a generic model to more closely fit characteristics of interaction as seen during drilling in the field. For example, coefficients of the wear model may be adjustable to allow for the wear model to be adjusted by a designer to calculate cutting element wear more consistent with that found on dull bits run under similar conditions.

Drilling tool assembly/earth formation impact, friction, and damping models or parameters can be used to characterize impact and friction on the drilling tool assembly due to contact of the drilling tool assembly with the wall of the wellbore and due to viscous damping effects of the drilling fluid. These models may include drill string-BHA/formation impact models, bit body/formation impact models, drill string-BHA/formation friction models, and drilling fluid viscous damping models. One skilled in the art will appreciate that impact, friction and damping models may be obtained through laboratory experimentation. Alternatively, these models may also be derived based on mechanical properties of the formation and the drilling tool assembly, or may be obtained from literature. Prior art methods for determining impact and friction models are shown, for example, in papers such as the one by Yu Wang and Matthew Mason, entitled "Two-Dimensional Rigid-Body Collisions with Friction", Journal of Applied Mechanics, September 1992, Vol. 59, pp. 635-642.

Input data may be provided as input to a simulation program by way of a user interface which includes an input device coupled to a storage means, a data base and a visual display, wherein a user can select which parameters are to be defined, such as operation parameters, drill string parameters, well parameters, etc. Then once the type of parameters to be defined is selected, the user selected the component or value desired to be changed and enter or select a changed value for use in performing the simulation.

In one or more embodiments, the user may select to change simulation parameters, such as the type of simulation mode desired (such as from ROP control to WOB control, etc.), or various calculation parameters, such as impact model modes (force, stiffness, etc.), bending-torsion model modes (coupled, decoupled), damping coefficients model, calculation incremental step size, etc. The user may also select to define and modify drilling tool assembly parameters. First the user may construct a drilling tool assembly to be simulated by selecting the component to be included in the drilling tool assembly from a database of components and then adjusting the parameters for each of the components as needed to create a drilling tool assembly model that very closely represents the actual drilling tool assembly being considered for use.

In one embodiment, the specific parameters for each component selected from the database may be adjustable by selecting a component added to the drilling tool assembly and changing the geometric or material property values defined for the component in a menu screen so that the resulting component selected more closely matches with the actual component included in the actual drilling tool assembly. For example, referring to FIG. 7, in one embodiment, a stabilizer in the drilling tool assembly may be selected and any one of the overall length, outside body diameter, inside body diameter, weight, fish (leading) neck length, NE of the fish neck, blade length blade OD, blade width, number of blades, NE for blades, NE for tong end, eccentricity offset, and eccentricity angle may be provided as well as values relating to the material properties (e.g., Young's modulus, Poisson's ratio, etc.) of the tool may be specifically defined to more accurately represent the stabilizer to be used in the drilling tool assembly being modeled. Similar features may also be provided for each of the drill collars, drill pipe, cross over subs, etc., included in the drilling tool assembly. In the case of drill pipe, and similar components, additional features defined may include the length and outside diameter of each tool connection joint, so that the effect of the actual tool joints on stiffness and mass throughout the system can be taken into account during calculations to provide a more accurate prediction of the dynamic response of the drilling tool assembly being modeled.

The user may also select and define the well by selecting well survey data and wellbore data. For example, for each segment a user may define the measured depth in, inclination angle, azimuth angle, of each segment of the wellbore, and the diameter, well stiffness, coefficient of restitution, axial and transverse damping coefficients of friction, axial and transverse scraping coefficient of friction, and mud density.

As shown in FIG. 7A, once input data 200 are selected, determined, or otherwise provided, a two-part mechanics analysis model of the drilling tool assembly is constructed 210 and used to determine the initial static state 232 of the drilling tool assembly in the wellbore. The first part of the mechanics analysis model takes into consideration the overall structure of the drilling tool assembly, with the drill bit being only generally represented. In this embodiment, a finite element method is used wherein an arbitrary initial state (such as hanging in the vertical mode free of bending stresses) is defined for the drilling tool assembly as a reference and the drilling tool assembly is divided into N elements of specified element dimensions (i.e., meshed) 212. The static load vector for each element due to gravity is calculated. Then element stiffness matrices are constructed based on the material properties, element length, and cross sectional geometrical properties of drilling tool assembly components provided as input and are used to construct a stiffness matrix for the entire drilling tool assembly (wherein the drill bit is generally represented by a single node) (also at 212). Similarly, element mass matrices are constructed by determining the mass of each element (based on material properties, etc.) and are used to construct a mass matrix for the entire drilling tool assembly 214. Additionally, element damping matrices can be constructed (based on experimental data, approximation, or other method) and used to construct a damping matrix for the entire drilling tool assembly 216. Methods for dividing a system into finite elements and constructing corresponding stiffness, mass, and damping matrices are known in the art and thus are not explained in detail here. Examples of such methods are shown, for example, in "Finite Elements for Analysis and Design" by J. E. Akin (Academic Press, 1994). Those skilled in the art will appreciate that selected BHA components segments of the drill string nearest the BHA may be meshed using finer or higher order finite elements that used for other parts of the drill string so that the dynamic response, forces, and stresses at these locations in the drilling tool assembly can be more accurately determined.

The second part of the mechanics analysis model 210 of the drilling tool assembly is a mechanics analysis model of the drill bit which takes into account details of selected drill bit design at 218. The drill bit mechanics analysis model is constructed by creating a mesh of the cutting elements and establishing a coordinate relationship (coordinate system transformation) between the cutting elements and the bit, and between the bit and the tip of the BHA at 218. As previously noted, examples of methods for modeling fixed cutter bits are disclosed in SPE Paper No. 15618 by T. M. Warren et. al., entitled "Drag Bit Performance Modeling," U.S. Pat. No. 4,815,342, U.S. Pat. No. 5,010,789, U.S. Pat. No. 5,042,596, and U.S. Pat. No. 5,131,479 to Brett et al, and U.S. Provisional Application No. 60/485,642.

Because the response of the drilling tool assembly is subject to the constraint within the wellbore, wellbore constraints for the drilling tool assembly are determined, at 222, 224. First, the trajectory of the wall of the wellbore, which constrains the drilling tool assembly and forces it to conform to the wellbore path, is constructed at 220 using wellbore trajectory parameters provided as input. For example, a cubic B-spline method or other interpolation method can be used to approximate wellbore wall coordinates at depths between the depths provided as input data. The wall coordinates are then discretized (or meshed), at 224 and stored. Similarly, an initial wellbore bottom surface geometry is also discretized, at 222, and stored. The initial bottom surface of the wellbore may be selected as flat or as any other contour and provided as input at 204. Alternatively, the initial bottom surface geometry may be generated or approximated based on the selected bit geometry. For example, the initial bottomhole geometry may be selected from a "library" (i.e., database) containing stored bottomhole geometries resulting from the use of various bits.

In this embodiment, a coordinate mesh size of 1 millimeter is selected for the wellbore surfaces (wall and bottomhole); however, the coordinate mesh size is not intended to be a limitation on the invention. Once meshed and stored, the wellbore wall and bottomhole geometry, together, comprise the initial wellbore constraints within which the drilling tool assembly operates, and, thus, within which the drilling tool assembly response is constrained.

Once the mechanics analysis model for the drilling tool assembly including the bit is constructed 210 and the wellbore constraints are specified 222, 224, the mechanics model and constraints can be used to determine the constraint forces on the drilling tool assembly when forced to the wellbore trajectory and bottomhole from its original "stress free" state. In this embodiment, the constraint forces on the drilling tool assembly are determined by first displacing and fixing the nodes of the drilling tool assembly so the centerline of the drilling tool assembly corresponds to the centerline of the wellbore, at 226. Then, the corresponding constraining forces required on each node (to fix it in this position) are calculated at 228 from the fixed nodal displacements using the drilling tool assembly (i.e., system or global) stiffness matrix from 212. Once the "centerline" constraining forces are determined, the hook load is specified, and initial wellbore wall constraints and bottomhole constraints are introduced at 230 along the drilling tool assembly and at the bit (lowest node). The centerline constraints are used as the wellbore wall constraints. The hook load and gravitational force vector are used to determine the WOB.

As previously noted, the hook load is the load measured at the hook from which the drilling tool assembly is suspended. Because the weight of the drilling tool assembly is known, the bottomhole constraint force (i.e., WOB) can be determined as the weight of the drilling tool assembly minus the hook load and the frictional forces and reaction forces of the hole wall on the drilling tool assembly.

Once the initial loading conditions are introduced, the "centerline" constraint forces on all of the nodes are removed, a gravitational force vector is applied, and the static equilibrium position of the assembly within the wellbore is determined by iteratively calculating the static state of the drilling tool assembly 232. Iterations are necessary since the contact points for each iteration may be different. The convergent static equilibrium state is reached and the iteration process ends when the contact points and, hence, contact forces are substantially the same for two successive iterations. Along with the static equilibrium position, the contact points, contact forces, friction forces, and static WOB on the drilling tool assembly are determined. Once the static state of the system is obtained, it can be used as the staring point for simulation of the dynamic response of the drilling tool assembly drilling earth formation 234.

Figure 6:
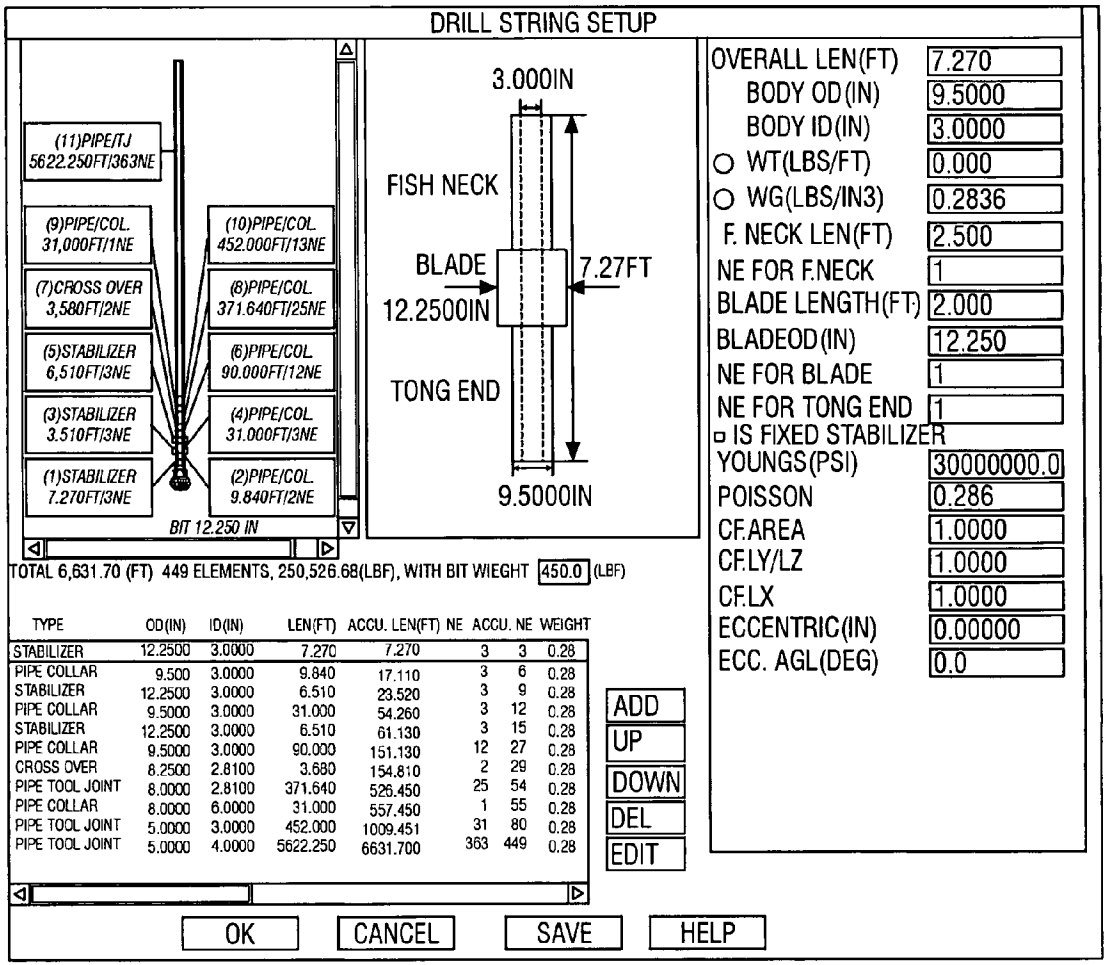
FIG. 6 shows a graphical display illustrating an embodiment of setup parameters.

Referring now to FIG. 6, in one example, incrementally calculating the dynamic response 116 may not only include solving the mechanics analysis model for the dynamic response to an incremental rotation, at 120, but may also include determining, from the response obtained, loads (e.g., drilling environment interaction forces) on the drilling tool assembly due to interaction between the drilling tool assembly and the drilling environment during the incremental rotation, at 122, and resolving for the response of the drilling tool assembly to the incremental rotation, at 124, under the newly determined loads. The determining and resolving may be repeated in a constraint update loop 128 until a response convergence criterion 126 is satisfied. Once a convergence criterion is satisfied, the entire incremental solving process 116 may be repeated for successive increments until an end condition for simulation is reached.

During the simulation, the constraint forces initially used for each new incremental calculation step may be the constraint forces determined during the last incremental rotation. In the simulation, incremental rotation calculations are repeated for a select number of successive incremental rotations until an end condition for simulation is reached.

Figure 7C:
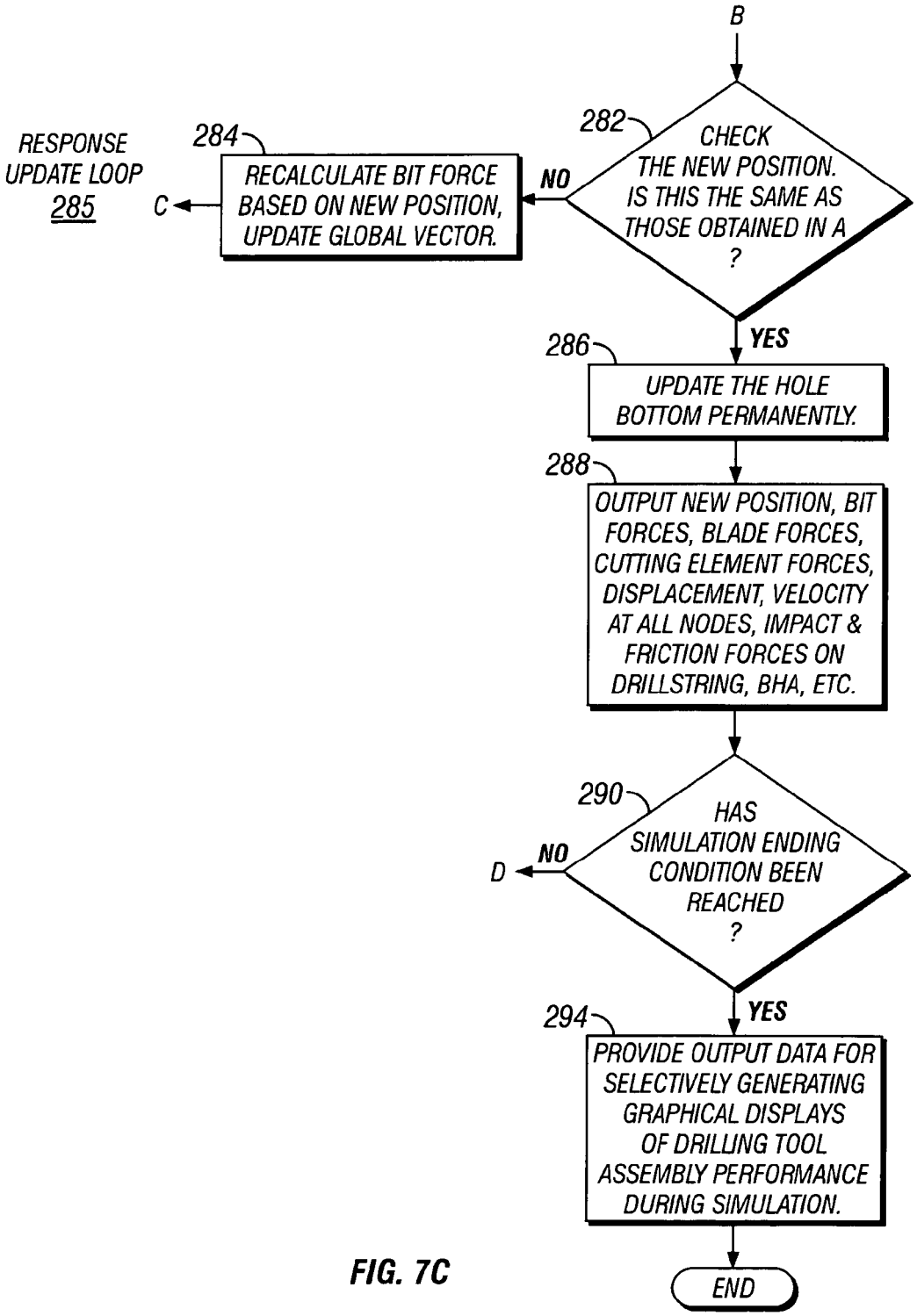

As shown in FIG. 7A-C, once input data are provided and the static state of the drilling tool assembly in the wellbore is determined, calculations in the dynamic response simulation loop can be carried out. Briefly summarizing the functions performed in the dynamic response loop, the drilling tool assembly drilling earth formation is simulated by "rotating" the top of the drilling tool assembly (and at the location corresponding to a downhole motor, if used) through an incremental angle (at 242) corresponding to a selected time increment, and then calculating the response of the drilling tool assembly under the previously determined loading conditions 244 to the incremental rotation(s). The constraint loads on the drilling tool assembly resulting from interaction with the wellbore wall during the incremental rotation are iteratively determined (in loop 245) and are used to update the drilling tool assembly constraint loads (i.e., global load vector), at 248, and the response is recalculated under the updated loading condition. The new response is then rechecked to determine if wall constraint loads have changed and. If necessary, wall constraint loads are redetermined, the load vector updated, and a new response calculated. Then the bottomhole constraint loads resulting from bit interaction with the formation during the incremental rotation are evaluated based on the new response (loop 252), the load vector is updated (at 279), and a new response is calculated (at 280). The wall and bottomhole constraint forces are repeatedly updated (in loop 285) until convergence of a dynamic response solution is determined (i.e., changes in the wall constraints and bottomhole constraints for consecutive solutions are determined to be negligible). The entire dynamic simulation loop is then repeated for successive incremental rotations until an end condition of the simulation is reached (at 290) or until simulation is otherwise terminated. A more detailed description of the elements in the simulation loop follows.

Prior to the start of the simulation loop, drilling operation parameters 206 are specified. As previously noted, the drilling operation parameters 206 may include the rotary table speed, downhole motor speed (if a downhole motor is included in the BHA) and a rate of penetration (ROP) or hook load. In this example, the end condition for simulation is also provided at 204, as either the total number of revolutions to be simulated or the total time for the simulation. Additionally, the incremental step desired for calculations should be defined, selected, or otherwise provided. In the embodiment shown, an incremental time step of $\Delta t=10^{-3}$ seconds is selected. However, it should be understood that the incremental time step is not intended to be a limitation on the invention.

Once the static state of the system is known (from 232) and the operational parameters are provided, the dynamic response simulation loop can begin. First, the current time increment is calculated at 241, wherein $t_{i+1}=t_i+\Delta t$. Then, the incremental rotation occurring during that time increment is calculated at 242. In this embodiment, RPM is considered an input parameter, therefore the formula used to calculate the incremental rotation angle at time $t_{i+1}$ is $\Delta\theta_{i+1}=RPM*\Delta t/60$, wherein RPM is the rotational speed (in RPM) of the rotary table or top drive provided as input data (at 204). The calculated incremental rotation angle is applied proximal to the top of the drilling tool assembly (at the node(s) corresponding to the position of the rotary table). If a downhole motor is included in the BHA, the downhole motor incremental rotation is also calculated and applied at the nodes corresponding to the downhole motor. The additional operation parameters, such as the hook load or ROP are also applied.

Once the incremental rotation angle and current time are determined, the system's new configuration (nodal positions) under the extant loads and the incremental rotation is calculated (at 244) using the drilling tool assembly mechanics analysis model and the rotational input as an excitation. A direct integration scheme can be used to solve the resulting dynamic equilibrium equations for the drilling tool assembly. The dynamic equilibrium equation (like the mechanics analysis equation) can be derived using Newton's second law of motion, wherein the constructed drilling tool assembly mass, stiffness, and damping matrices along with the calculated static equilibrium load vector can be used to determine the response to the incremental rotation. For the example shown in FIG. 7A-C, it should be understood that at the first time increment $t_1$ the extant loads on the system are the static equilibrium loads (calculated for $t_0$) which include the static state WOB and the constraint loads resulting from drilling tool assembly contact with the wall and bottom of the wellbore.

Those having ordinary skill in the art that accounting for the calculations may be done by defining forces $F_x$, $F_y$, $F_z$ displacements $U_x$, $U_y$, and $U_z$ (positional displacement) and $\Theta_x$, $\Theta_y$, $\Theta_z$ (angular displacements) From these values, those of ordinary skill in the art will appreciate that the $M_x$, $M_y$ & $M_z$ (the torque) may be calculated for all positions.

Balance conditions may be established via a number of criteria such as defining terms such that:

$$F_x=F_y=F_z$$

Also, those having ordinary skill will appreciate that each element has forces, torsional displacement and rotational components associated with them that may be calculated based on the above information, using known finite element analysis. In one example, the bending associated with the string may be determined from adjacent nodes.

As the drilling tool assembly is incrementally "rotated", constraint loads acting on the bit may change. For example, points of the drilling tool assembly in contact with the borehole surface prior to rotation may be moved along the surface of the wellbore resulting in friction forces at those points. Similarly, some points of the drilling tool assembly, which were close to contacting the borehole surface prior to the incremental rotation, may be brought into contact with the formation as a result of the incremental rotation. This may result in impact forces on the drilling tool assembly at those locations. As shown in FIG. 7A-C, changes in the constraint loads resulting from the incremental rotation of the drilling tool assembly can be accounted for in the wall interaction update loop 245.

In the example shown, once the system's response (i.e., new configuration) under the current loading conditions is obtained, the positions of the nodes in the new configuration are checked at 244 in the wall constraint loop 245 to determine whether any nodal displacements fall outside of the bounds (i.e., violate constraint conditions) defined by the wellbore wall. If nodes are found to have moved outside of the wellbore wall, the impact and/or friction forces which would have occurred due to contact with the wellbore wall are approximated for those nodes at 248 using the impact and/or friction models or parameters provided as input at 208. Then the global load vector for the drilling tool assembly is updated, also at 208, to reflect the newly determined constraint loads. Constraint loads to be calculated may be determined to result from impact if, prior to the incremental rotation, the node was not in contact with the wellbore wall. Similarly, the constraint load can be determined to result from frictional drag if the node now in contact with the wellbore wall was also in contact with the wall prior to the incremental rotation. Once the new constraint loads are determined and the global load vector is updated, at 248, the drilling tool assembly response is recalculated (at 244) for the same incremental rotation under the newly updated load vector (as indicated by loop 245). The nodal displacements are then rechecked (at 246) and the wall interaction update loop 245 is repeated until a dynamic response within the wellbore constraints is obtained.

Once a dynamic response conforming to the borehole wall constraints is determined for the incremental rotation, the constraint loads on the drilling tool assembly due to interaction with the bottomhole during the incremental rotation are determined in the bit interaction loop 250. Those skilled in the art will appreciate that any method for modeling drill bit/earth formation interaction during drilling may be used to determine the forces acting on the drill bit during the incremental rotation of the drilling tool assembly. An example of one method is illustrated in the bit interaction loop 250 in FIG. 7A-C.

In the bit interaction loop 250, the mechanics analysis model of the drill bit is subjected to the incremental rotation angle calculated for the lowest node of the drilling tool assembly, and is then moved laterally and vertically to the new position obtained from the same calculation, as shown at 249. As previously noted, the drill bit in this example is a fixed cutter drill bit. The interaction of the drill bit with the earth formation is modeled in accordance with a method disclosed in U.S. Provisional Application No. 60/485,642, which as been incorporated herein by reference. Thus, in this example, once the rotation and new position for the bit node are known, they are used as input to the drill bit model and the drill bit model is used to calculate the new position for each of the cutting elements on the drill bit 252. The location of each cutting element relative to the bottomhole and wall of the wellbore is evaluated, at 254, to determine for each cutting element whether cutting element interference with the formation occurred during the incremental movement of the bit.

If cutting element contact is determined to have occurred with the earth formation, surface contact area between the cutter and the earth formation is calculated along with the depth of cut and the contact edge length of the cutter, and the orientation of the cutting face with respect to the formation (e.g., back rake angle, side rake angle, etc.). The depth of cut is the depth below the formation surface that a cutting element contacts earth formation, which can range from zero (no contact) to the full height of the cutting element. Surface area contact is the fractional amount of the cutting surface area out of the entire area corresponding to the depth of cut that actually contacts earth formation. This may be a fractional amount of contact due to cutting element grooves formed in the formation from previous contact with cutting elements. The contact edge length is the distance between furthest points on the edge of the cutter in contact with formation at the formation surface. Scraping distance takes into account the movement of the cutting element in the formation during the incremental rotation.

Once the depth of cut, surface contact area, contact edge length, and scraping distance are determined for a cutting element these parameters can be stored and used along with the cutting element/formation interaction data to determine the resulting forces acting on the cutting element during the incremental movement of the bit (at 256). For example, in accordance a simulation method described in U.S. Provisional Application No. 60/485,642 noted above, resulting forces on each of the cutters can be determined using cutter/formation interaction data stored in a data library involving a cutter and formation pair similar to the cutter and earth formation interacting during the simulated drilling. Values calculated for interaction parameters (depth of cut, interference surface area, contact edge length, back rack, side rake, and bevel size) during drilling are used to determine the corresponding forces required on the cutters to cut through the earth formation. In cases where the cutting element makes less than full contact with the earth formation due to grooves in the formation surface, an equivalent depth of cut and equivalent contact edge length is calculated to correspond to the interference surface area and these values are used to determine the forces required on the cutting element during drilling.

Using the cutting element/formation interaction variables (contact area, depth of cut, force, etc.) determined for cutting elements, the geometry of the bottom surface of the wellbore is temporarily updated, at 264, to reflect the removal of formation by each cutting element during the incremental rotation of the drill bit.

After the bottomhole geometry is temporarily updated, cutting element wear and strength can also be analyzed, as shown at 259, based on wear models and calculated loads on the cutting elements to determine wear on the cutting elements resulting from contact with the formation and the resulting reduction in cutting element strength.

Once interaction of all of the cutting elements on a blade is determined, blade interaction with the formation may be determined by checking the node displacements at the blade surface at 262, to determine if any of the blade nodes are out of bounds or make contact with the wellbore wall or bottomhole surface. If blade contact is determined to occur during the incremental rotation, the contact area and depth of penetration of the blade are calculated (at 264) and used to determine corresponding interaction forces on the blade surface resulting from the contact. Once forces resulting from blade contact with the formation are determined, or it is determined that no blade contact has occurred, the total interaction forces on the blade during the incremental rotation are calculated by summing all of the cutting element forces and any blade surface forces on the blade, 268.

Once the interaction forces on each blade are determined, any forces resulting from contact of the bit body with the formation may also be determined and then the total forces acting on the bit during the incremental rotation calculated and used to determine the dynamic weight on bit 278. The newly calculated bit interaction forces are then used to update the global load vector at 279, and the response of the drilling tool assembly is recalculated at 280 under the updated loading condition. The newly calculated response is then compared to the previous response at 282 to determine if the responses are substantially similar. If the responses are determined to be substantially similar, then the newly calculated response is considered to have converged to a correct solution. However, if the responses are not determined to be substantially similar, then the bit interaction forces are recalculated based on the latest response at 284 and the global load vector is again updated at 284. Then, a new response is calculated by repeating the entire response calculation (including the wellbore wall constraint update and drill bit interaction force update) until consecutive responses are obtained which are determined to be substantially similar (indicated by loop 285), thereby indicating convergence to the solution for dynamic response to the incremental rotation.

Once the dynamic response of the drilling tool assembly to an incremental rotation is obtained from the response force update loop 285, the bottomhole surface geometry is then permanently updated at 286 to reflect the removal of formation corresponding to the solution. At this point, output information desired from the incremental simulation step can be stored and/or provided as output. For example, the velocity, acceleration, position, forces, bending moments, torque, of any node in the drill string may be provided as output from the simulation. Additionally, the dynamic WOB, cutting element forces, resulting cutter wear, blade forces, and blade or bit body contact points may be output from the simulation, as indicated at 288.

The dynamic response simulation loop as described above is then repeated for successive incremental rotations of the bit until an end condition of the simulation is satisfied at 290. For example, using the total number of bit revolutions to be simulated as the termination command, the incremental rotation of the drilling tool assembly and subsequent iterative calculations of the dynamic response simulation loop will be repeated until the selected total number of revolutions to be simulated is reached. Repeating the dynamic response simulation loop as described above will result in simulating the performance of an entire drilling tool assembly drilling earth formations with continuous updates of the bottomhole pattern as drilled, thereby simulating the drilling of the drilling tool assembly in the selected earth formation. Results of the simulation may be provided and used to generate graphical displays characterizing the simulated performance information at 294 characterizing the performance of the drilling tool assembly drilling the selected earth formation under the selected drilling conditions. It should be understood that the simulation can be stopped using any desired termination indicator, such as a selected final depth for drilling, an indicated divergence of a solution (if checked), etc.

As noted above, output information from a dynamic simulation of a drilling tool assembly drilling an earth formation may include, for example, the drilling tool assembly configuration (or response) obtained for each time increment, and corresponding cutting element forces, blade forces, bit forces, impact forces, friction forces, dynamic WOB, bending moments, displacements, vibration, resulting bottomhole geometry, and more. This output information may be presented in the form of a visual representation, such as a visual representation of the borehole being drilled through the earth formation with continuous updated bottomhole geometries and the dynamic response of the drilling tool assembly to drilling presented on a computer screen. Alternatively, the visual representation may include graphs of performance parameters calculated or otherwise obtained during the simulation. For example, a time history of the dynamic WOB or the wear on cutting elements during drilling may be graphic displayed to a designer. The means used for visually displaying performance aspects of the simulated drilling is a matter of convenience for the system designer, and not a limitation on the invention.

Figure 12:
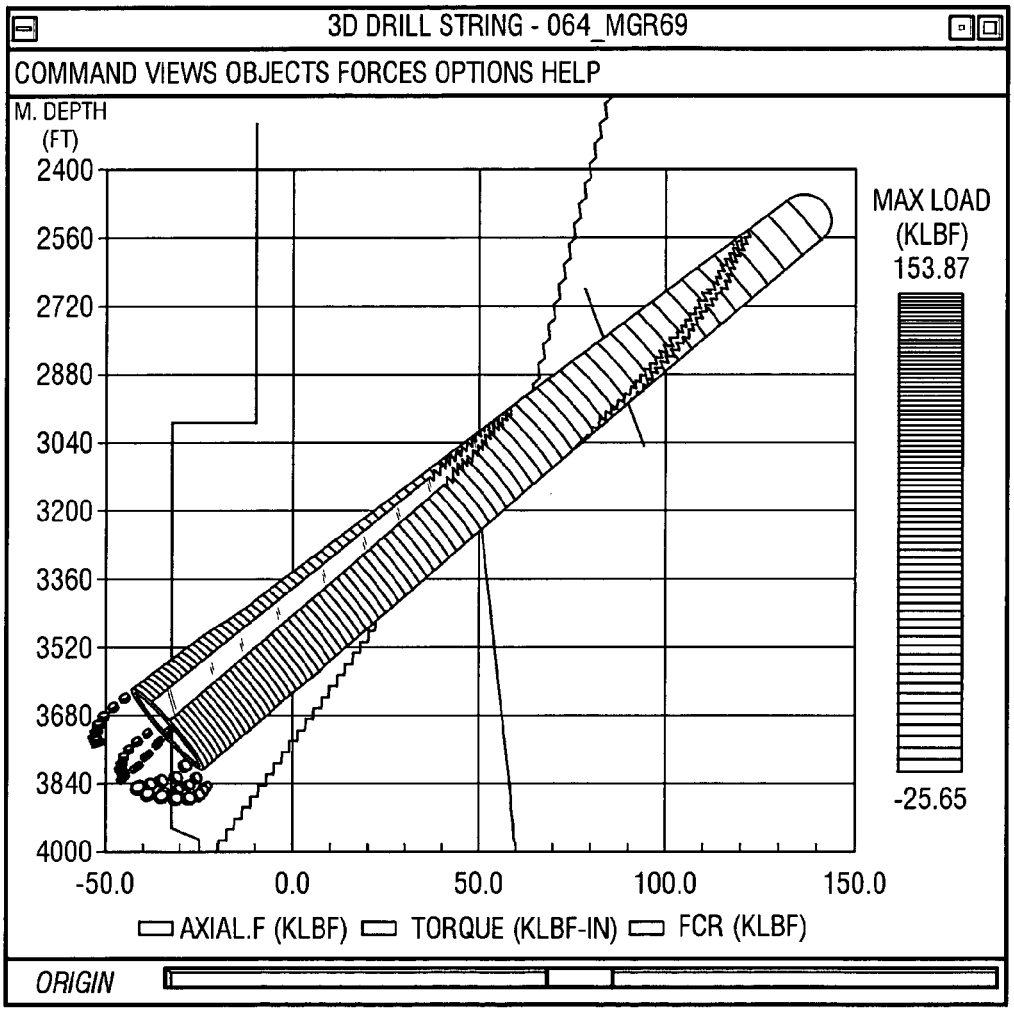
FIG. 12 shows one example of converting output data into a visual representation in accordance with one aspect of the invention.

One example of output data converted to a visual representation is illustrated in FIG. 12, wherein the rotation of the drilling tool assembly and corresponding drilling of the formation is graphically illustrated as a visual display of drilling and desired parameters calculated during drilling can be numerically displayed.

The dynamic model of the drilling tool assembly described above advantageously allows for six degrees of freedom of moment for the drill bit. In one or more embodiments, methods in accordance with the above description can be used to calculate and accurately predict the axial, lateral, and torsional vibrations of drill strings when drilling through earth formation, as well as bit whirl, bending stresses, and other dynamic indicators of performance for components of a drilling tool assembly.

Embodiments of the present invention advantageously provide the ability to model inhomogeneous regions and transition layers. With respect to inhomogeneous regions, sections of formation may be modeled as nodules or beams of different material embedded into a base material, for example. That is, a user may define a section of a formation as including various non-uniform regions, whereby several different types of rock are included as discrete regions within a single section.

Figure 13:
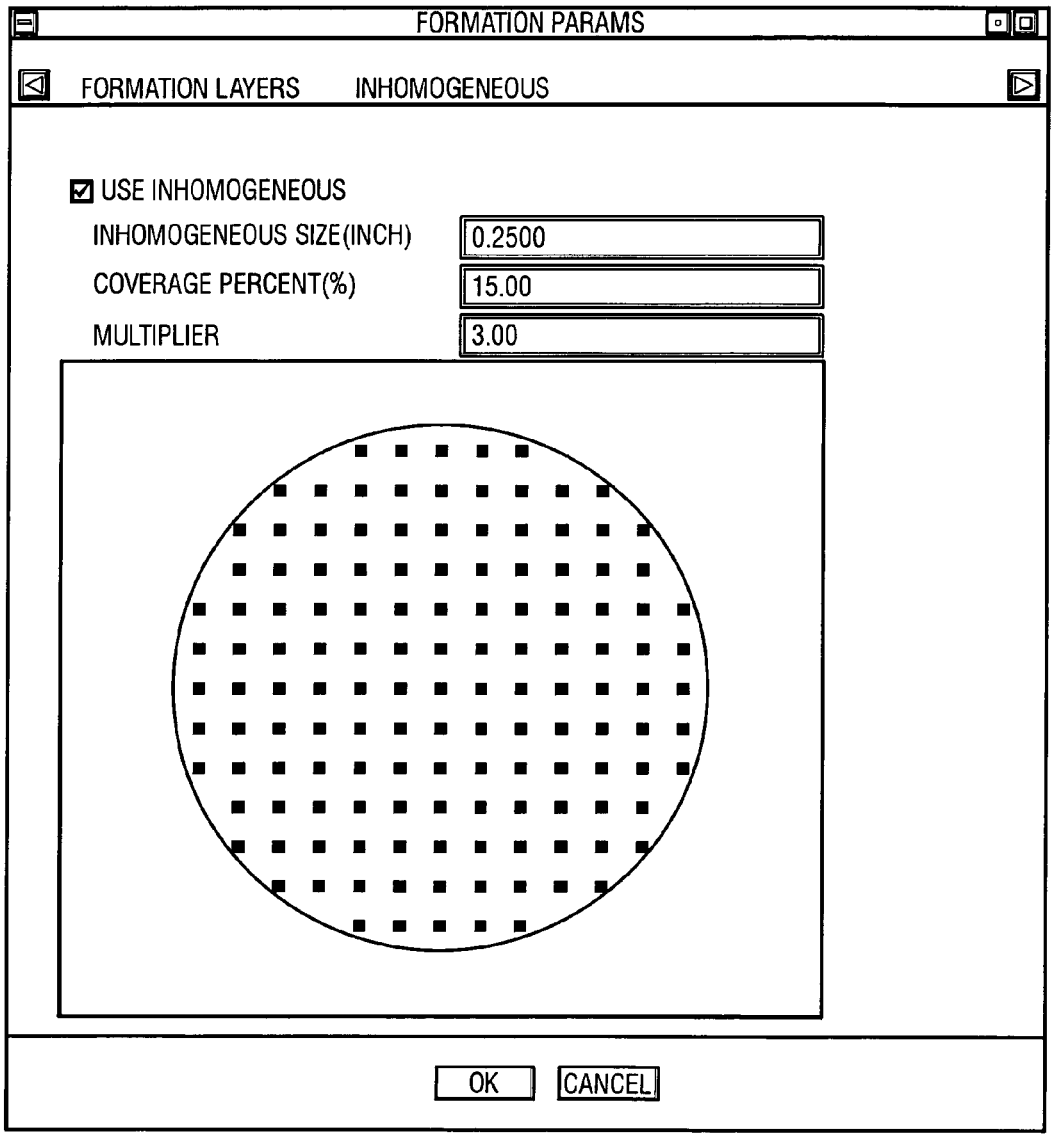
FIG. 13 shows an example of a graphically displaying modeling an inhomogeneous formation in accordance with an embodiment of the present invention.

FIG. 13 shows one example of an input screen that allows a user to input information regarding the inhomogenity of a particular formation. In particular, FIG. 13 shows one example of parameters that a user may input to define a particular inhomogeneous formation. In particular, the user may define the number, size, and material properties of discrete regions (which may be selected to take the form of nodules within a base material), within a selected base region. Those having ordinary skill in the art will appreciate that a number of different parameters may be used to define an inhomogeneous region within a formation, and no restriction on the scope of the present invention is intended by reference to the parameters shown in FIG. 13.

With respect to multilayer formations, embodiments of the present invention advantageously simulate transitional layers appearing between different formation layers. As those having ordinary skill will appreciate, in real world applications, it is often the case that a single bit will drill various strata of rock. Further, the transition between the various strata is not discrete, and can take up to several thousands of feet before a complete delineation of layers is seen. This transitional period between at least two different types of formation is called a "transitional layer," in this application.

Figure 14:
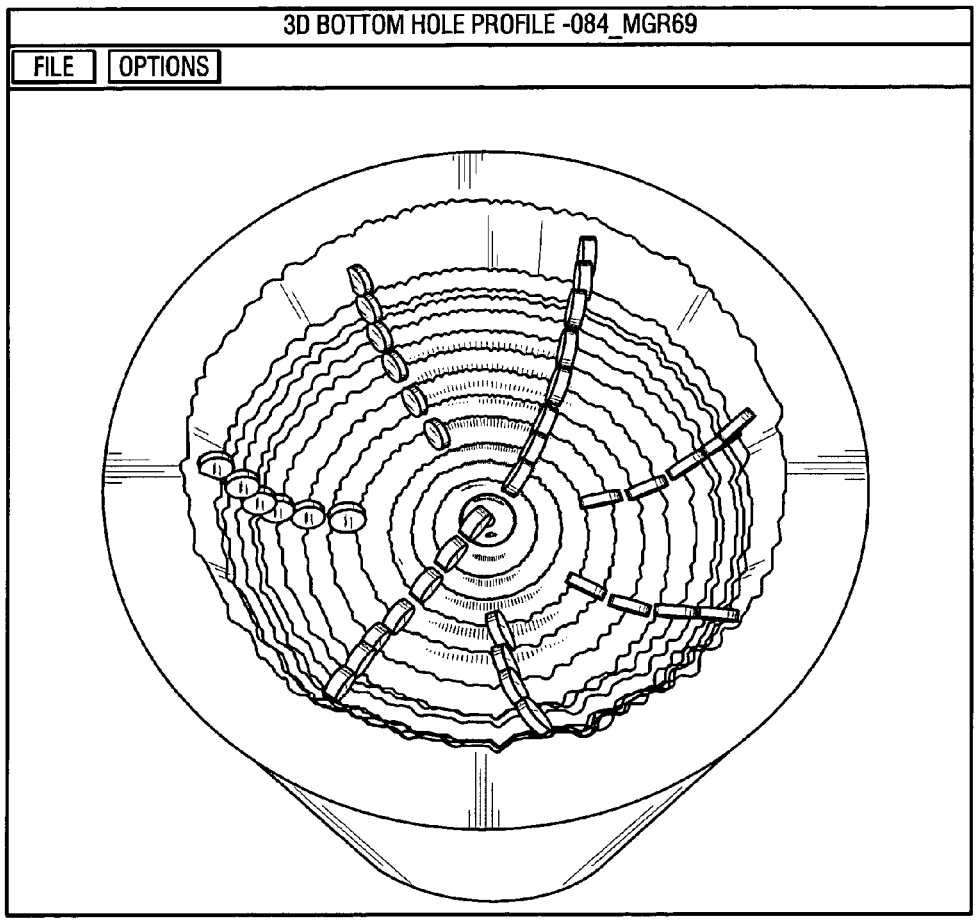
FIG. 14 shows one example of a bottomhole pattern generated during drilling in a transitional layer, in accordance with one embodiment of the present invention.

Significantly, embodiments of the present invention recognize that when drilling through a transitional layer, the bit will "bounce" up and down as cutters start to hit the new layer, until all of the cutters are completely engaged with the new layer. As a result, drilling through the transitional layer mimics the behavior of a dynamic simulation. As a result, forces on the cutter, blade, and bit dynamically change. FIG. 14 shows a graphic display of a bottomhole pattern generated during drilling of a transitional layer. In particular, FIG. 14 shows that the simulation is dynamic and accounts for response of bit while drilling through transition region.

Figure 15A:
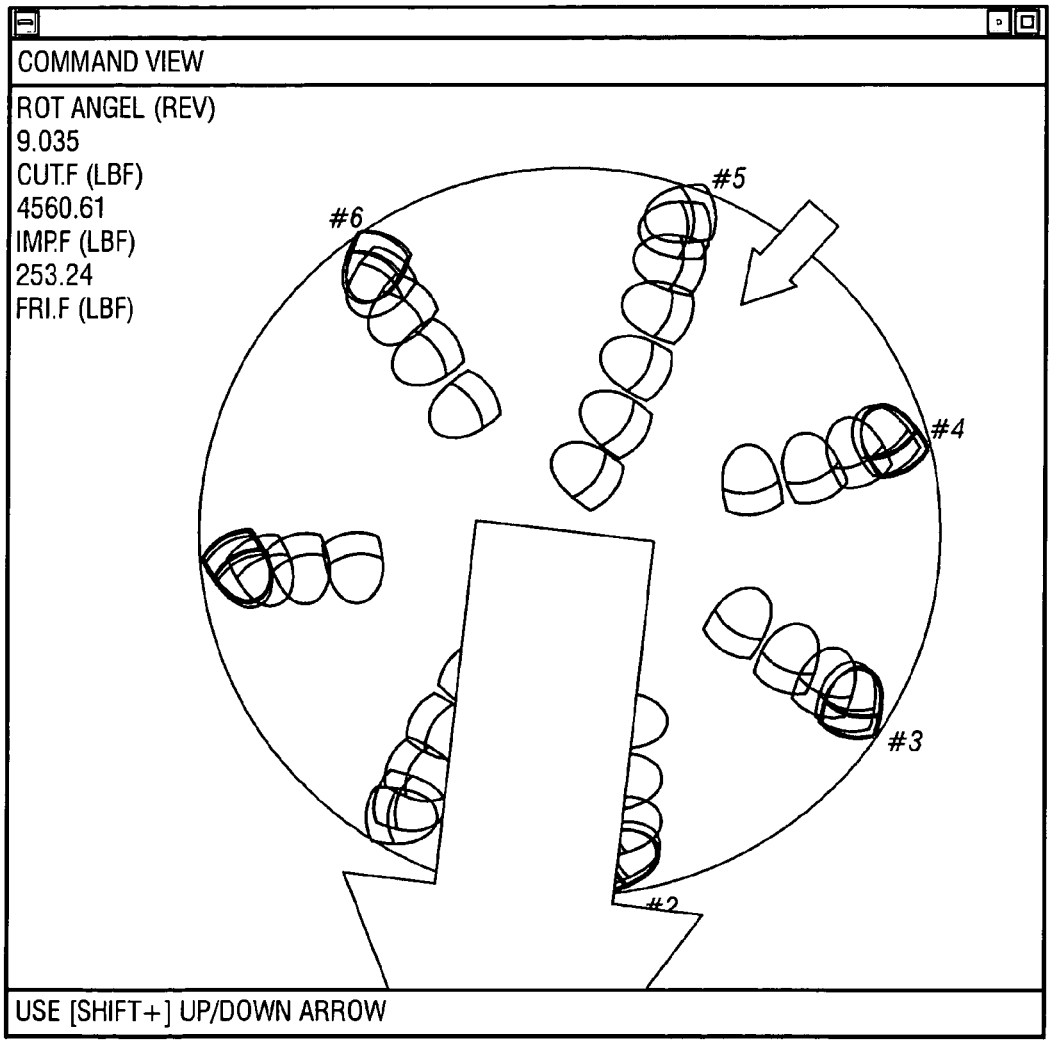
FIGS. 15A and 15B illustrate graphical displays produced in accordance with embodiments of the present invention.
Figure 15B:
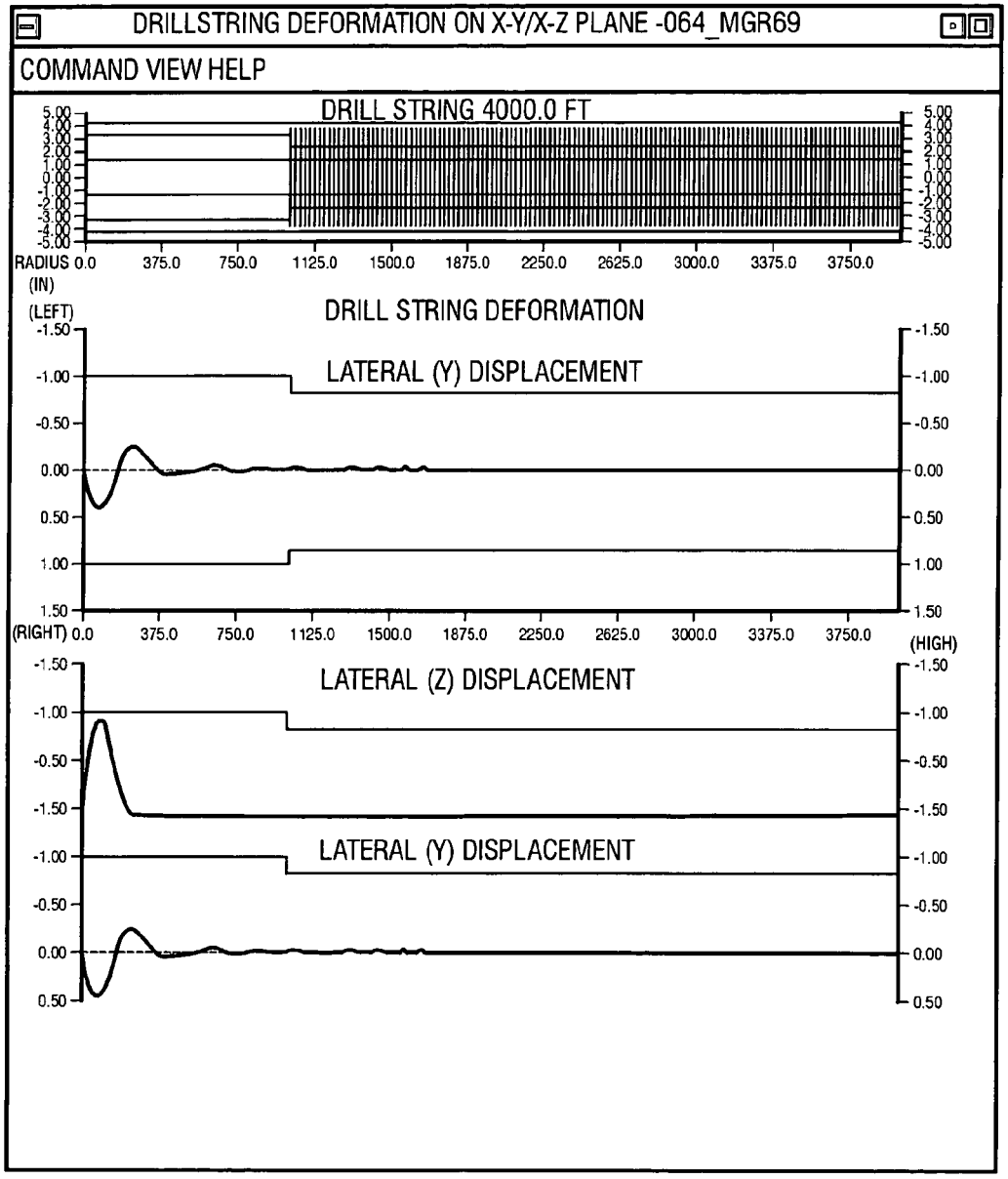

FIGS. 15A and B illustrate other graphical displays that may be produced by embodiments of the present invention. Within the program, the earth formation being drilled may be defined as comprising a plurality of layers of different types of formations with different orientation for the bedding planes, similar to that expected to be encountered during drilling. One example the earth formation being drilled being defined as layers of different types of formations is illustrated in FIGS. 16B and 16C. In these illustrations, the boundaries (bedding orientations) separating different types of formation layers are shown. The location of the boundaries for each type of formation is known. During drilling the location of each of the cutters is also known. Therefore, a simulation program having an earth formation defined as shown will accesses data from the cutter/formation interaction database based on the type of cutter on the bit and the particular formation type being drilled by the cutter at that point during drilling. The type of formation being drilled will change during the simulation as the bit penetrates through the earth formations during drilling. In addition to showing the different types of formation being drilled, the graph in FIG. 6C also shows the calculated ROP.

Visual representation generated by a program in accordance with one or more embodiments of the invention may include graphs and charts of any of the parameters provided as input, any of the parameters calculated during the simulation, or any parameters representative of the performance of the selected drill bit drilling through the selected earth formation. In addition to the graphical displays discussed above, other examples of graphical displays generated by one implementation of a simulation program in accordance with an embodiment of the invention are shown in FIGS. 16D-16G. FIG. 16D shows a visual display of the overlapping cutter profile for the bit provided as input, a layout for cutting elements on blade one of the bit, and a user interface screen that accepts as input bit geometry data from a user.

Figure 16A:
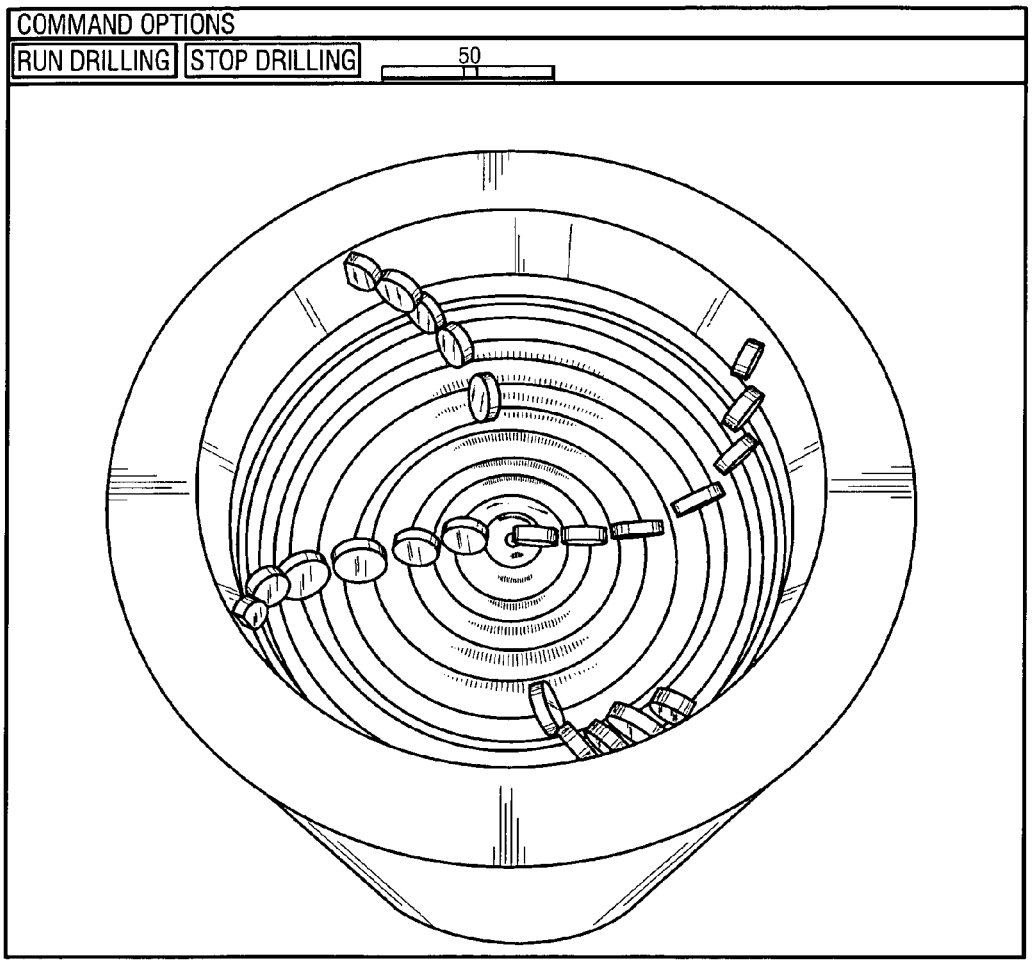
FIGS. 16A-16G show examples visual representations generated for one embodiment of the invention.
Figure 16B:
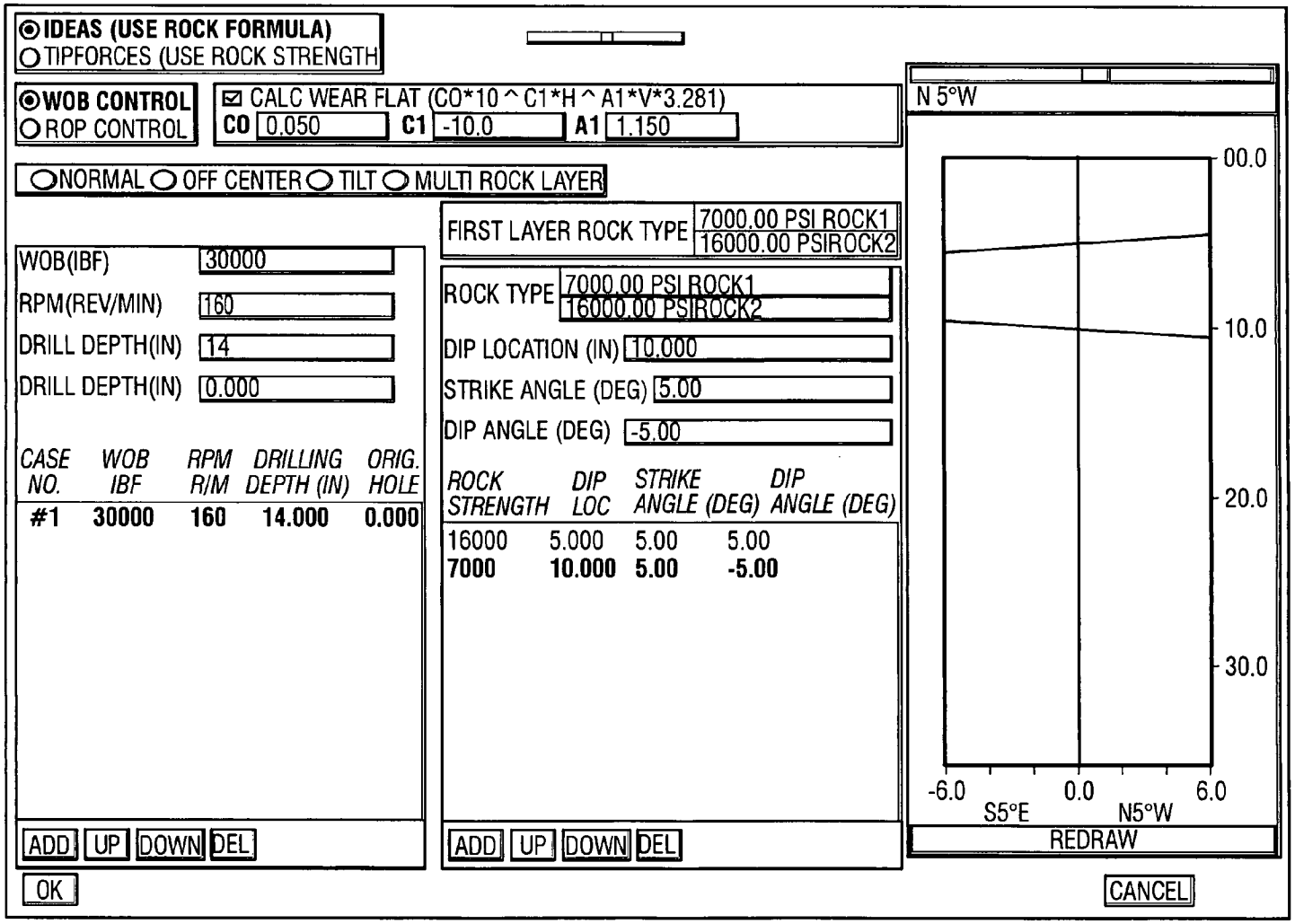
Figure 16C:
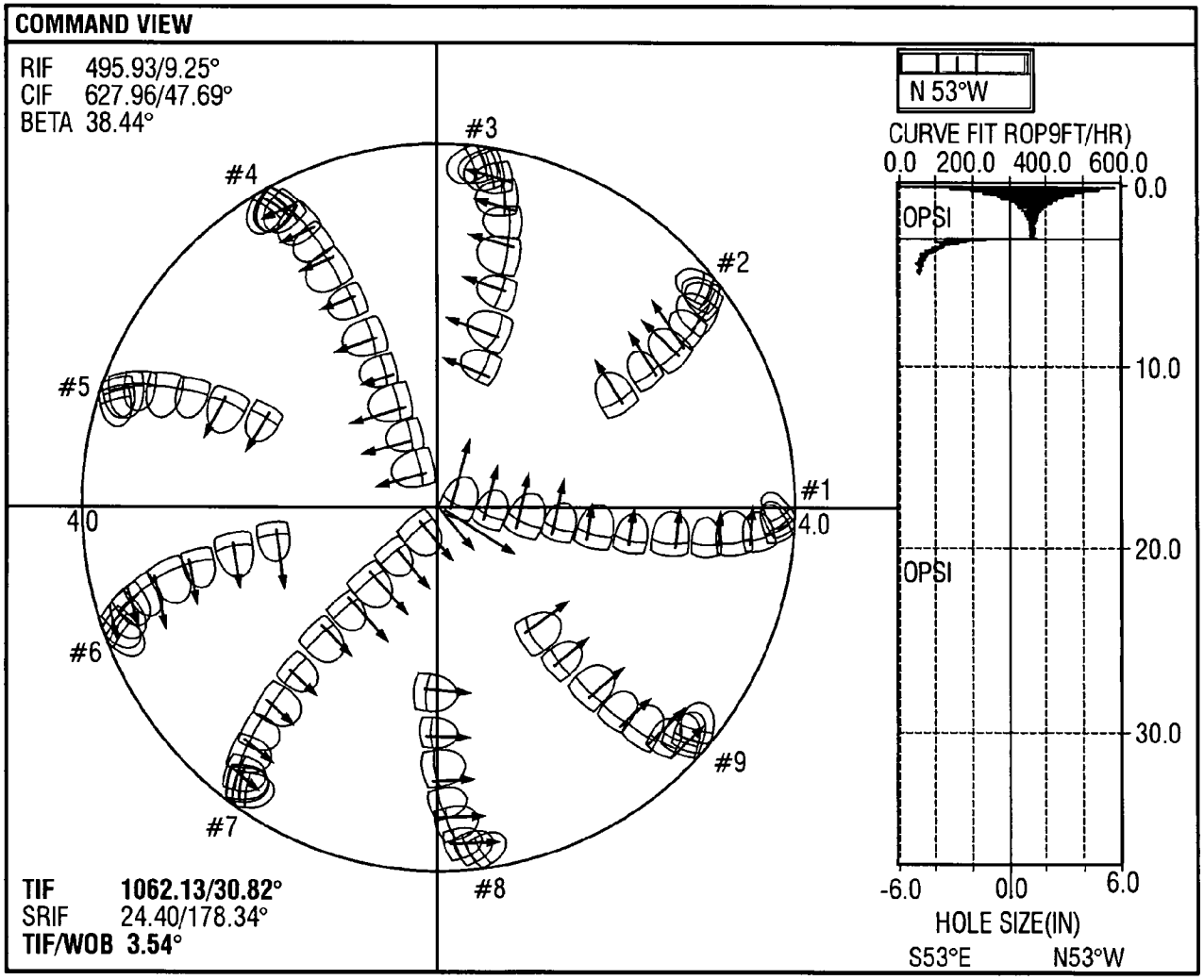
Figure 16D:
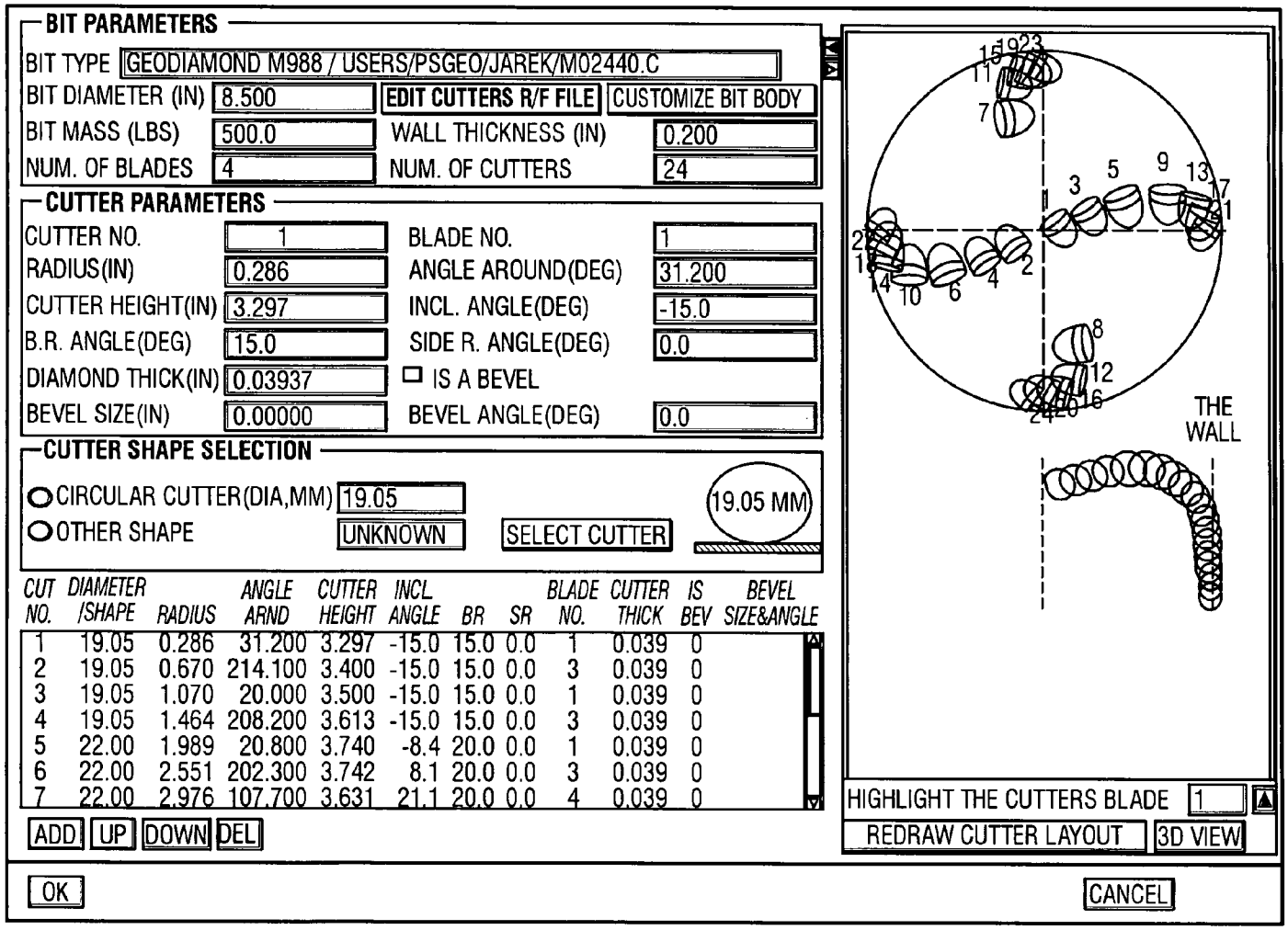
Figure 16E:
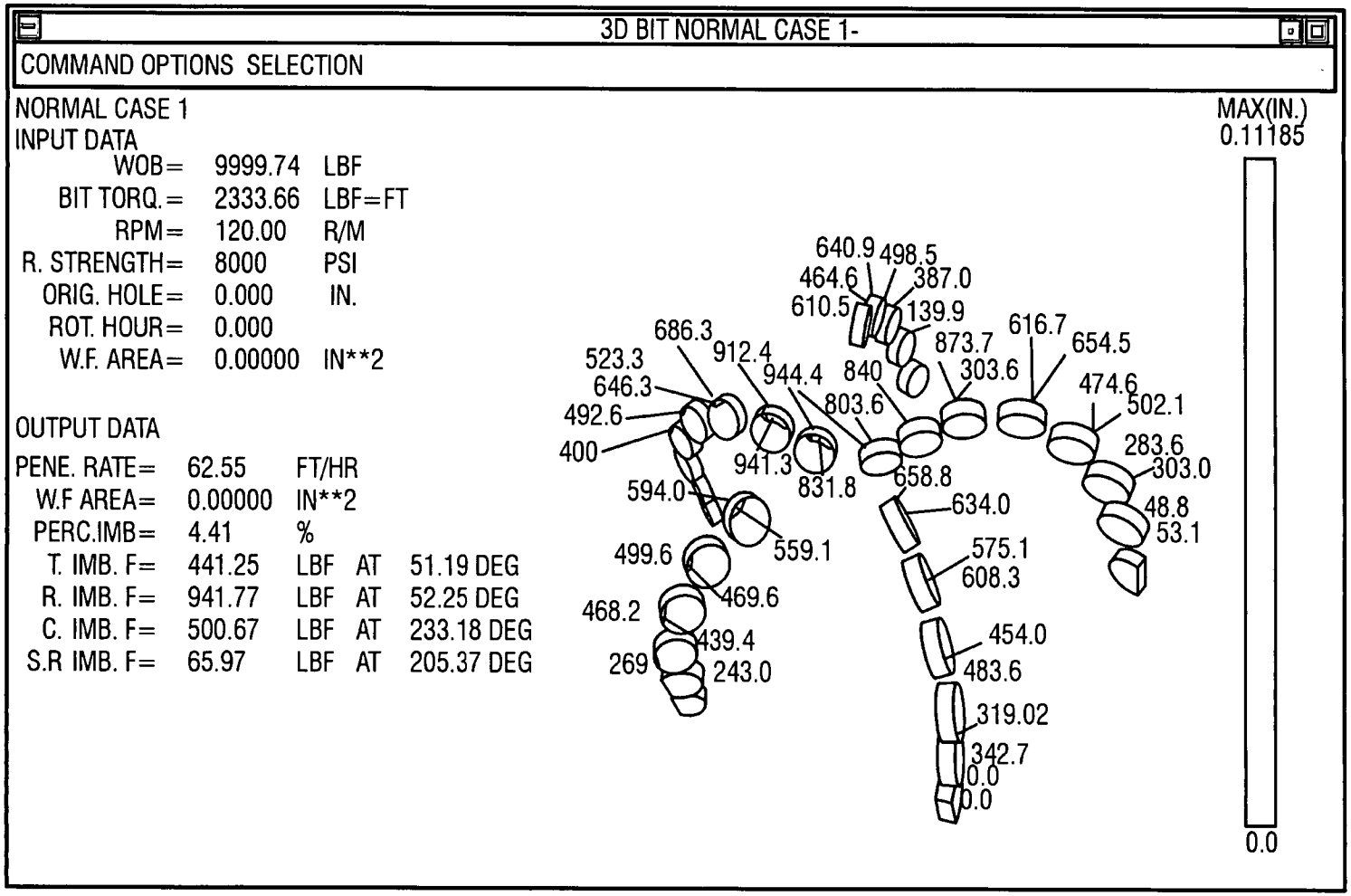

FIG. 16E shows a perspective view (with the bit body not shown for clarity) of the cutters on the bit with the forces on the cutters of the bit indicated. In this implementation, the cutters was meshed as is typically done in finite element analysis and the forces on each element of the cutters was determined and the interference areas for each element are illustrated by colors indicating the magnitude of the depth of cut on the element and forces on each cutter are represented by color arrows and digital numbers adjacent to the arrows. The visual display shown in FIG. 16E also includes a display of drilling parameter values, including the weight on bit, bit torque, RPM, interred rock strength, hole origin depth, rotation hours, penetration rate, percentage of the imbalance force with respect to weight on bit, and the tangential (axial), radial and circumferential imbalance forces. The side rake imbalance force is the imbalance force caused by the side rake angle only, which is included in the tangential, radial, and circumferential imbalance force.

Figure 16F:
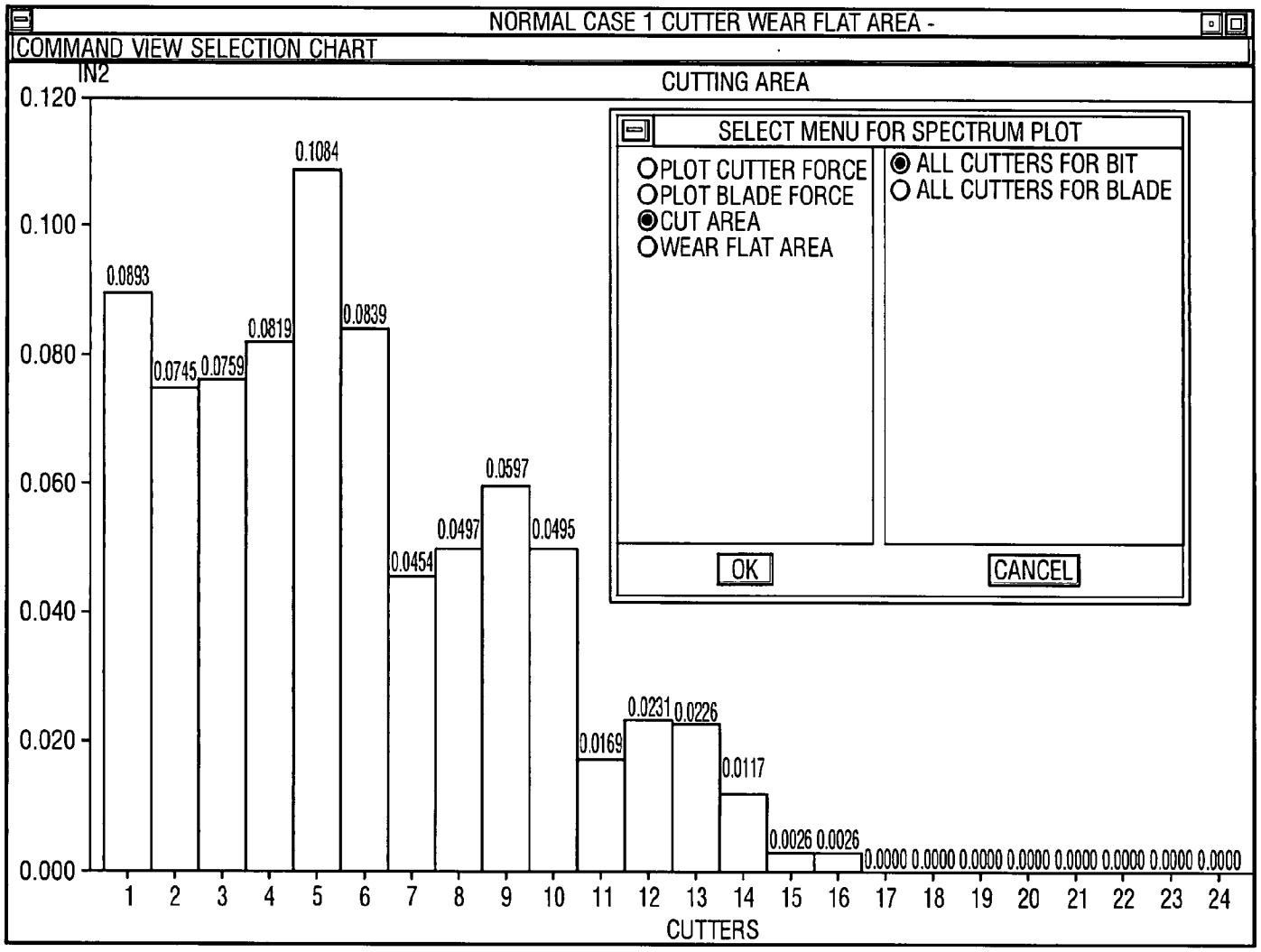
Figure 16G:
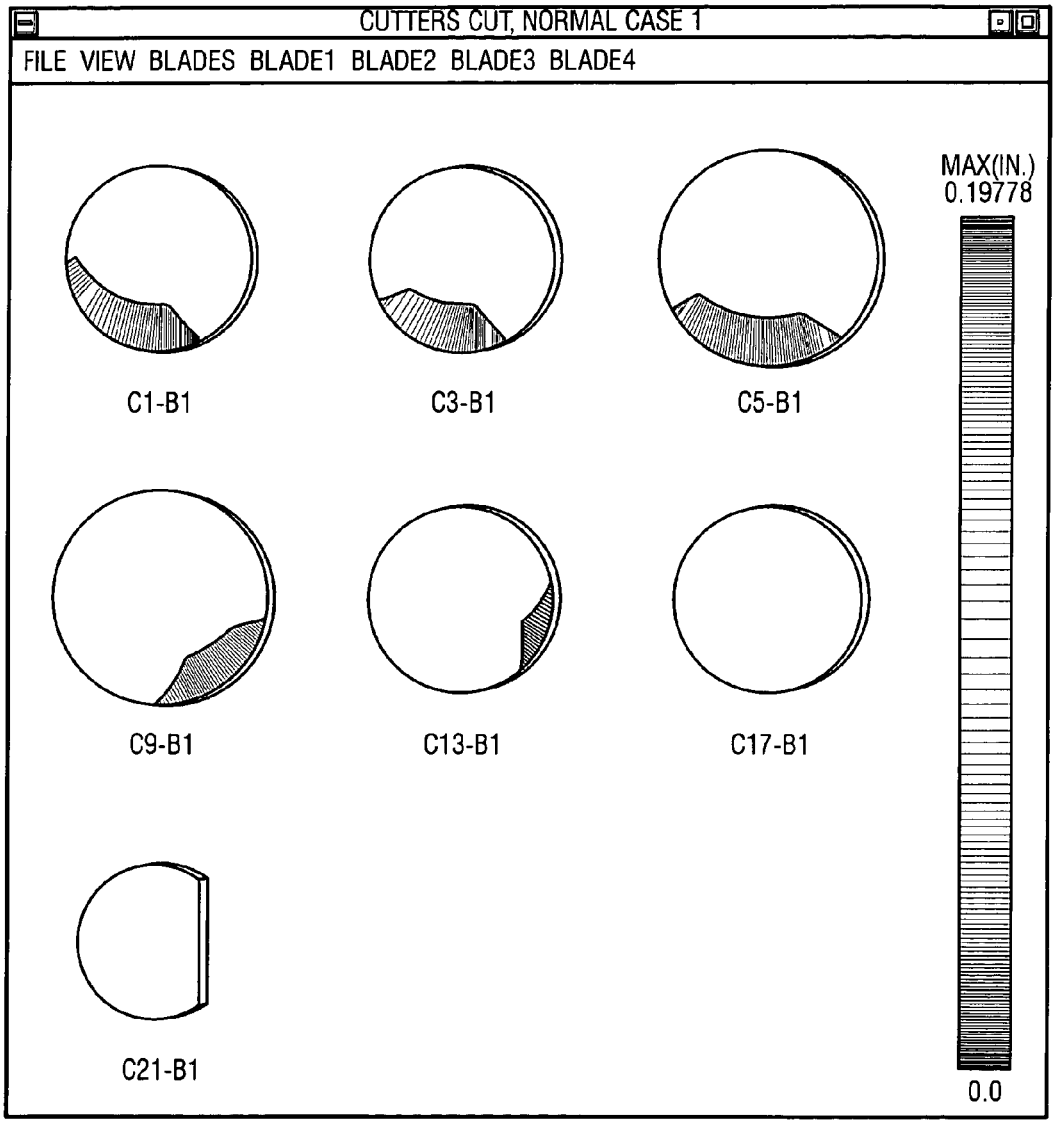
Figure 17:
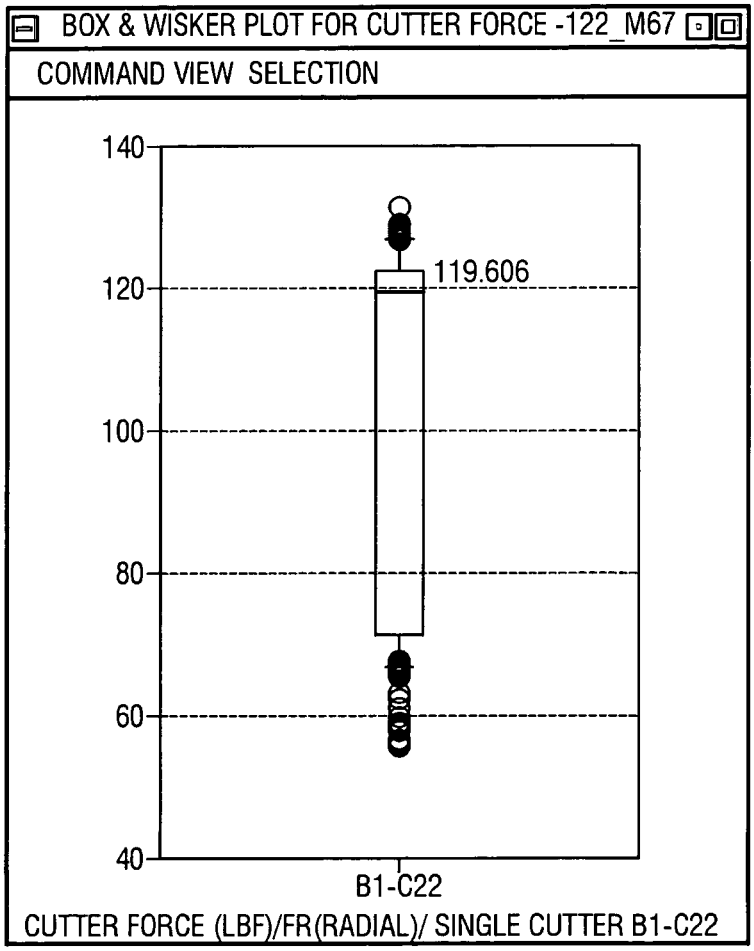
FIG. 17 shows a box and wisker plot illustrating the radial force acting on a selected cutter, in accordance with an embodiment of the present invention.
Figure 18:
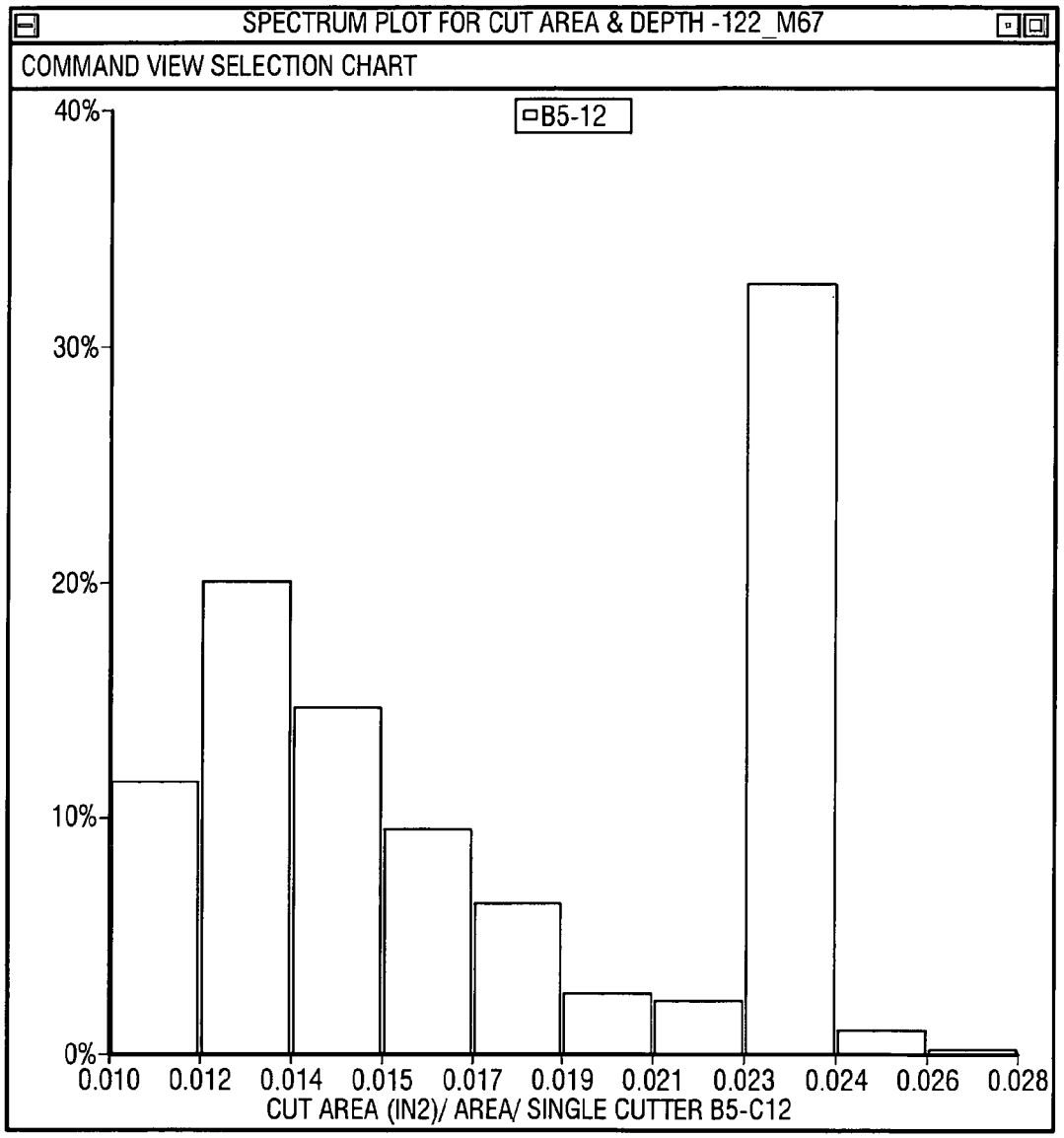
FIG. 18 shows a spectrum plot for cut area & depth for given cutters in accordance with an embodiment of the present invention.
Figure 19:
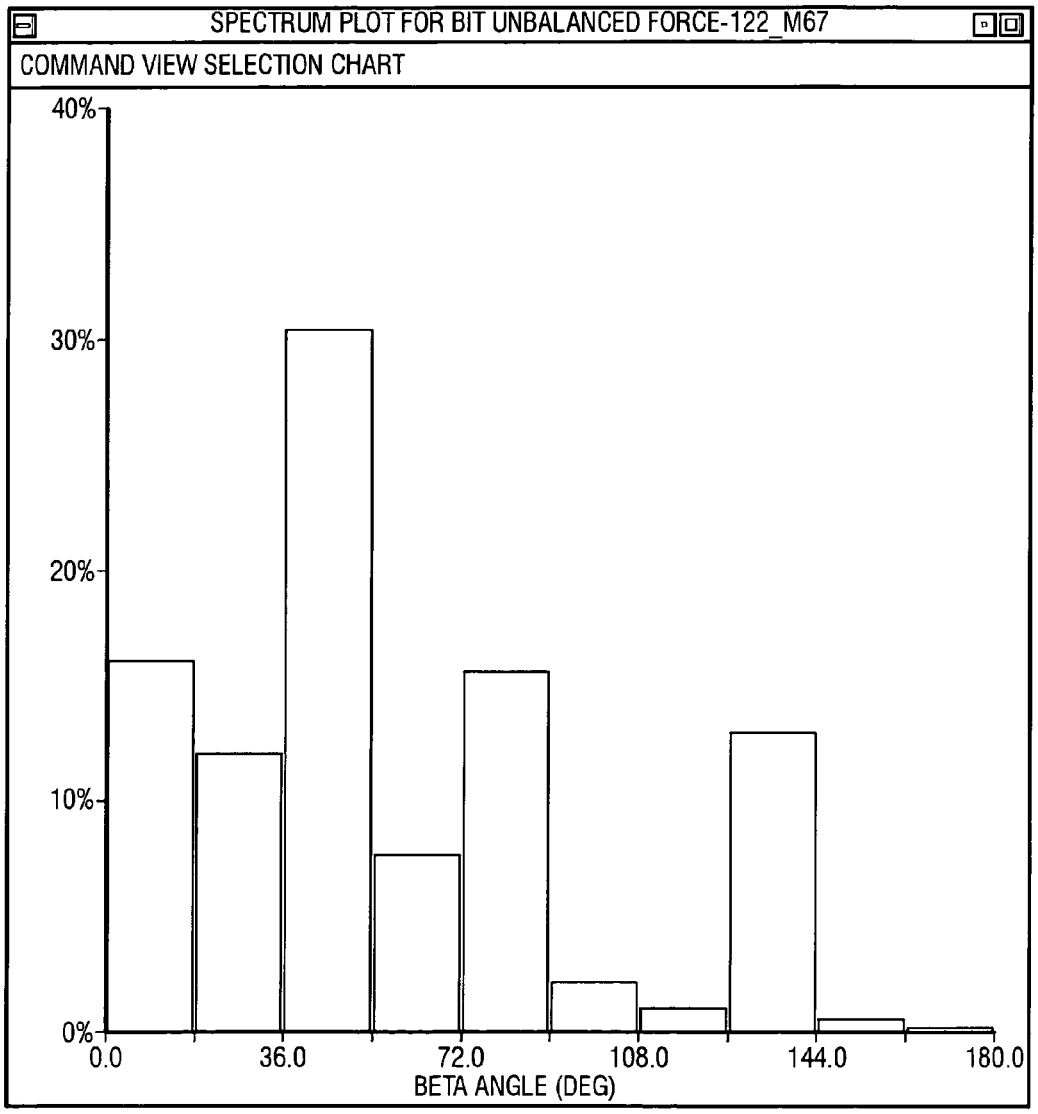
FIG. 19 shows a spectrum plot for bit imbalance force as a function of a beta angle in accordance with embodiments of the present invention.
Figure 20:
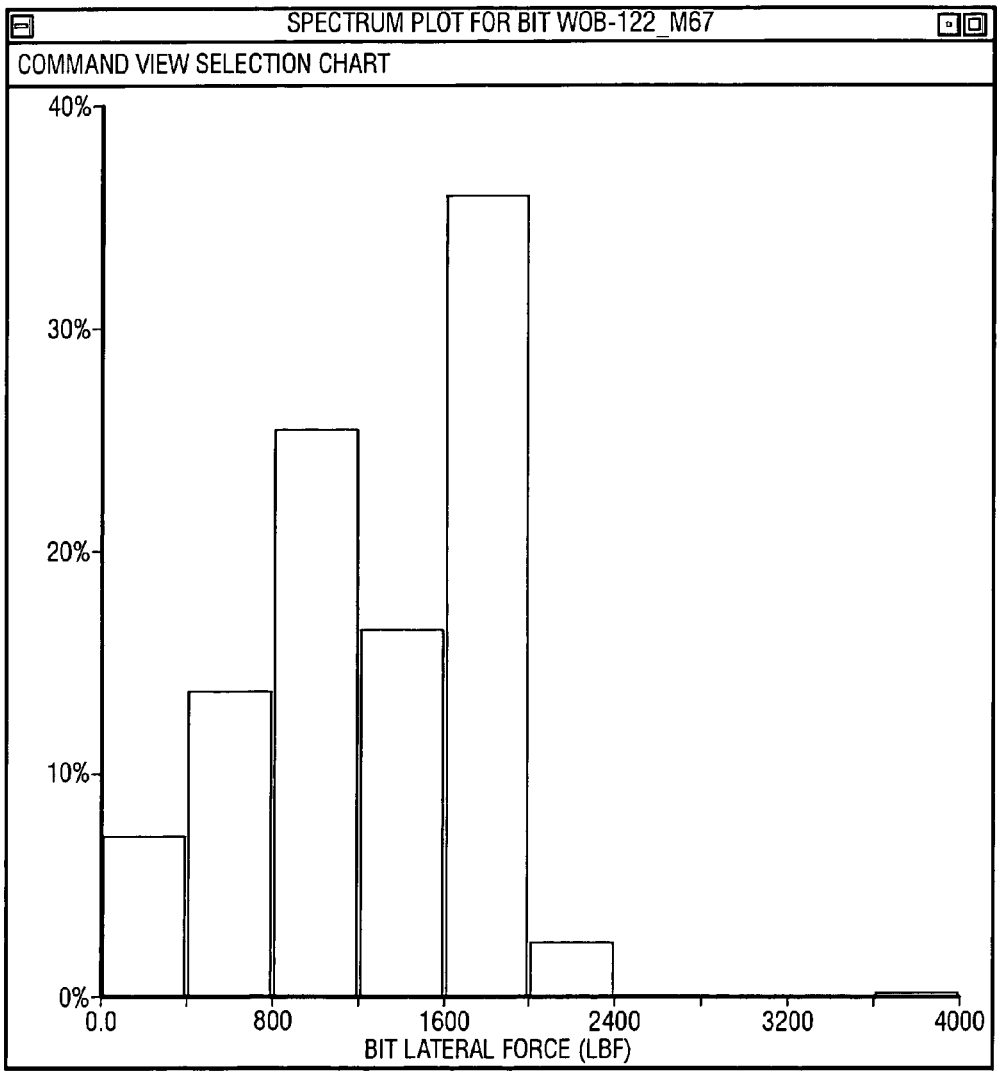
FIG. 20 shows a spectrum plot of lateral force in accordance with an embodiment of the present invention.
Figure 21:
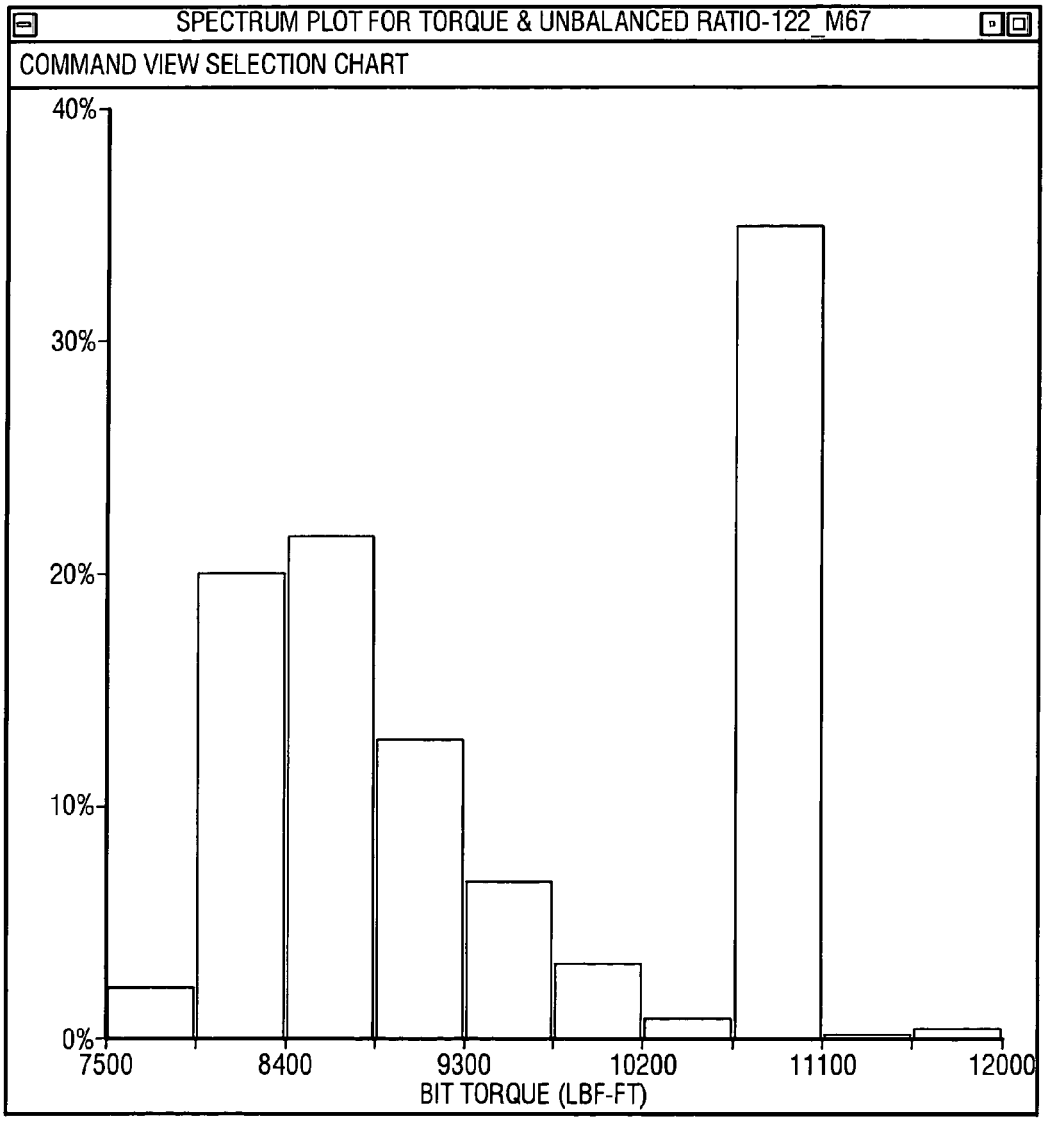
FIG. 21 shows a spectrum plot of torque on bit in accordance with an embodiment of the present invention.
Figure 22:
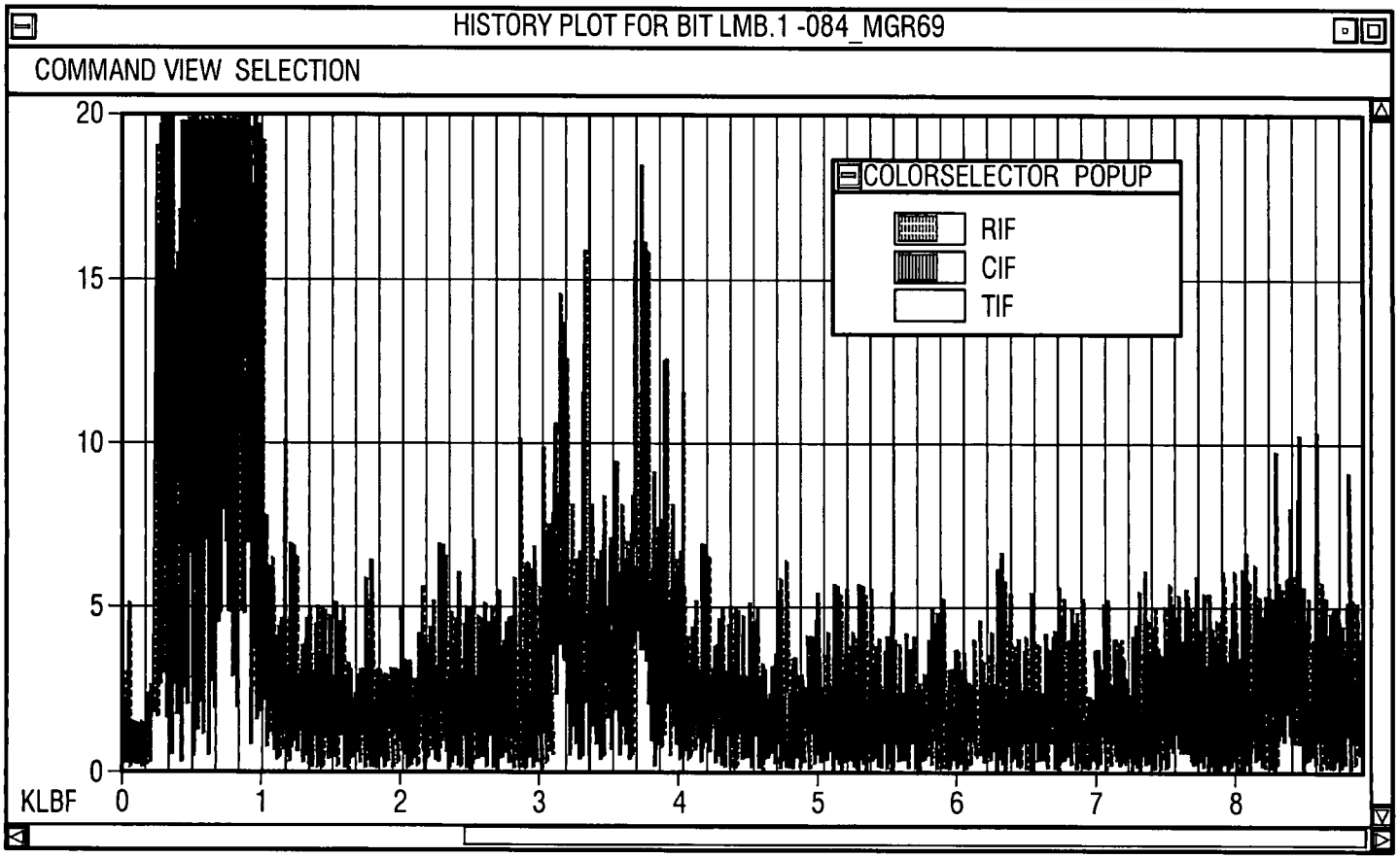
FIGS. 22-25 show history plots in accordance with embodiments of the present invention.
Figure 23:
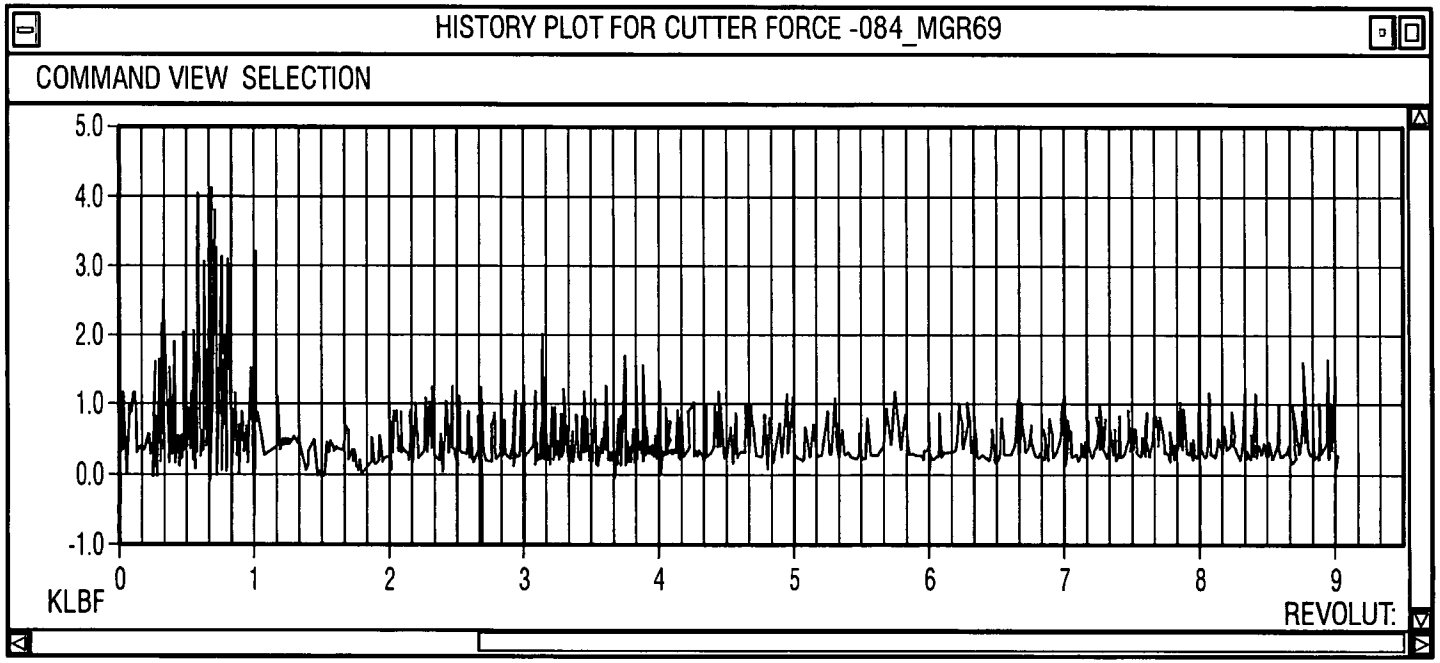
Figure 24:
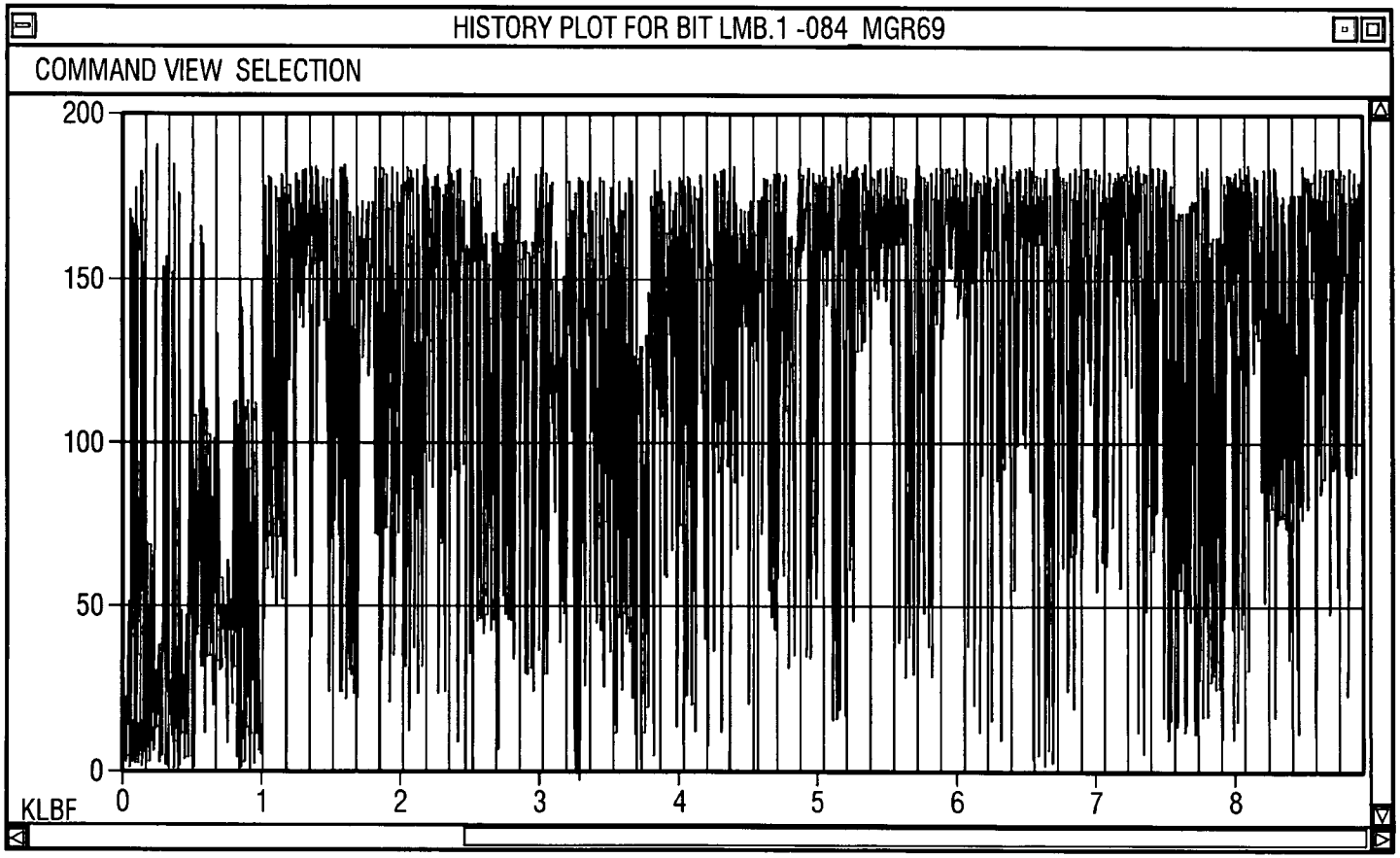
Figure 25:
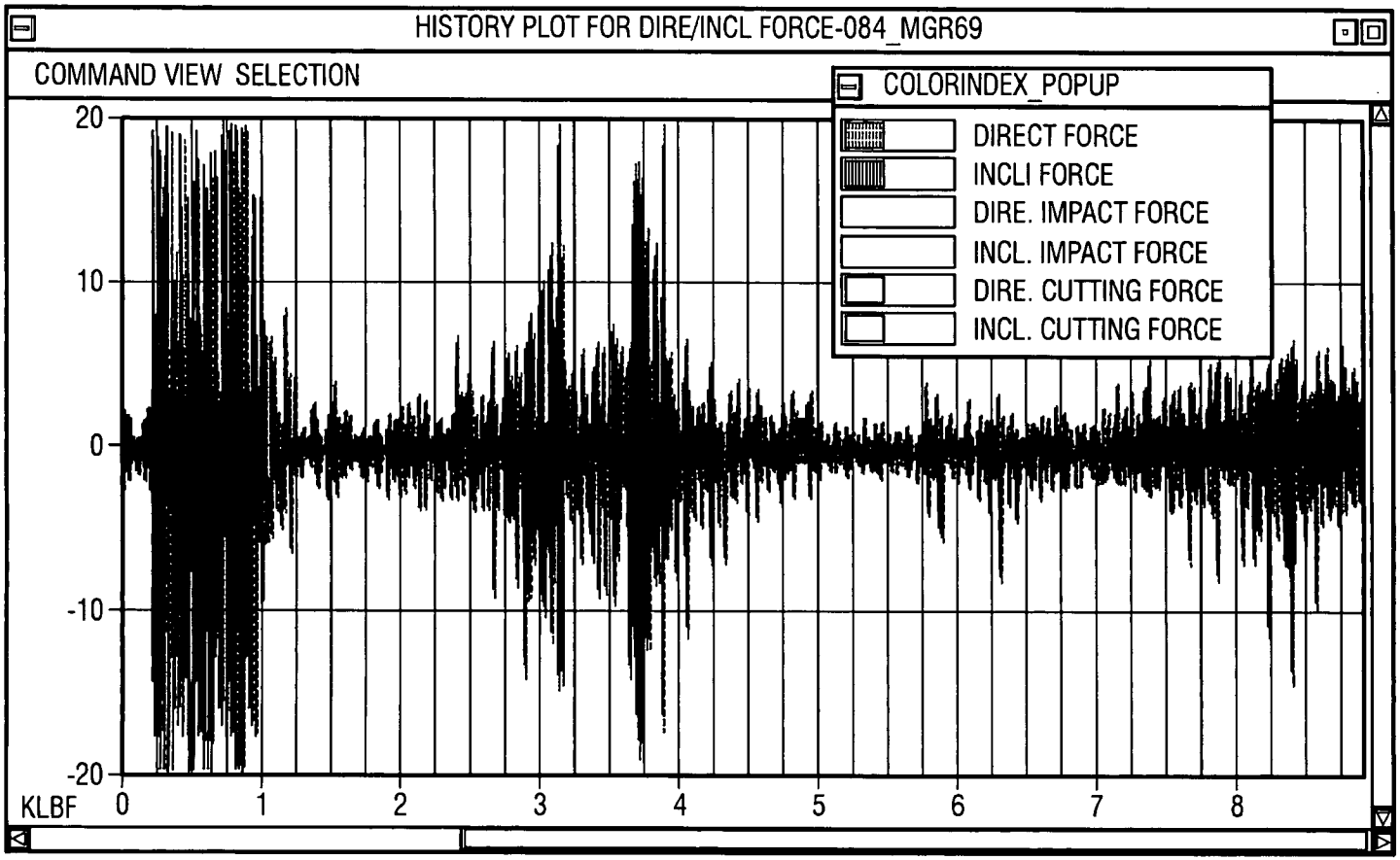

A visual display of the force on each of the cutters is shown in closer detail in FIG. 16G, wherein, similar to display shown FIG. 16E, the magnitude or intensity of the depth of cut on each of the element segments of each of the cutters is illustrated by color. In this display, the designations "C1-B1" provided under the first cutter shown indicates that this is the calculated depth of cut on the first cutter ("cutter 1") on blade 1. FIG. 6F shows a graphical display of the area cut by each cutter on a selected blade. In this implementation, the program is adapted to allow a user to toggle between graphical displays of cutter forces, blade forces, cut area, or wear flat area for cutters on any one of the blades of the bit. In addition to graphical displays of the forces on the individual cutters (illustrated in FIGS. 16E and 16G), visual displays can also be generated showing the forces calculated on each of the blades of the bit and the forces calculated on the drill bit during drilling. The type of displays illustrated herein is not a limitation of the invention. The means used for visually displaying aspects of simulated drilling is a matter of convenience for the system designer, and is not a limitation of the invention.

Examples of geometric models of a fixed cutter drill bit generated in one implementation of the invention are shown in FIGS. 16A, and 16C-16E. In all of these examples, the geometric model of the fixed cutter drill bit is graphically illustrated as a plurality of cutters in a contoured arrangement corresponding to their geometric location on the fixed cutter drill bit. The actual body of the bit is not illustrated in these figures for clarity so that the interaction between the cutters and the formation during simulated drilling can be shown.

Examples of output data converted to visual representations for an embodiment of the invention are provided in FIGS. 16A-16G. These figures include area renditions representing 3-dimensional objects preferably generated using means such as OPEN GL a 3-dimensional graphics language originally developed by Silicon Graphics, Inc., and now a part of the public domain. For one embodiment of the invention, this graphics language was used to create executable files for 3-dimensional visualizations. FIGS. 16C-16D show examples of visual representations of the cutting structure of a selected fixed cutter bit generated from defined bit design parameters provided as input for a simulation and converted into visual representation parameters for visual display. As previously stated, the bit design parameters provided as input may be in the form of 3-dimensional CAD solid or surface models. Alternatively, the visual representation of the entire bit, bottomhole surface, or other aspects of the invention may be visually represented from input data or based on simulation calculations as determined by the system designer.

FIG. 16A shows one example of the characterization of formation removal resulting from the scraping and shearing action of a cutter into an earth formation. In this characterization, the actual cuts formed in the earth formation as a result of drilling is shown.

FIG. 16F-16G show examples of graphical displays of output for an embodiment of the invention. These graphical displays were generated to allow the analysis of effects of drilling on the cutters and on the bit.

FIGS. 16A-16G are only examples of visual representations that can be generated from output data obtained using an embodiment of the invention. Other visual representations, such as a display of the entire bit drilling an earth formation or other visual displays, may be generated as determined by the system designer. Graphical displays generated in one or more embodiments of the invention may include a summary of the number of cutters in contact with the earth formation at given points in time during drilling, a summary of the forces acting on each of the cutters at given instants in time during drilling, a mapping of the cumulative cutting achieved by the various sections of a cutter during drilling displayed on a meshed image of the cutter, a summary of the rate of penetration of the bit, a summary of the bottom of hole coverage achieved during drilling, a plot of the force history on the bit, a graphical summary of the force distribution on the bit, a summary of the forces acting on each blade on the bit, the distribution of force on the blades of the bit.

FIG. 16A shows a three dimensional visual display of simulated drilling calculated by one implementation of the invention. Clearly depicted in this visual display are expected cuts in the earth formation resulting from the calculated contact of the cutters with the earth formation during simulated drilling. This display can be updated in the simulation loop as calculations are carried out, and/or visual representation parameters, such as parameters for a bottom-hole surface, used to generate this display may be stored for later display or for use as determined by the system designer. It should be understood that the form of display and timing of display is a matter of convenience to be determined by the system designer, and, thus, the invention is not limited to any particular form of visual display or timing for generating displays.

Those skilled in the art will appreciate that numerous other embodiments of the invention can be devised which do not depart from the scope of the invention as claimed. For example, alternative method can be used to account for dynamic load changes in constraint forces during incremental rotation of a drill string drilling through earth formation. For example, instead of using a finite element method, a finite difference method or a weighted residual method can be used to model the drilling tool assembly. Similarly, embodiments of the invention may be developed using other methods to determining the forces on a drill bit interacting with earth formation or other methods for determining the dynamic response of the drilling tool assembly to the drilling interaction of a bit with earth formation. For example, other method may be used to predict constraint forces on the drilling tool assembly or to determine values of the constraint forces resulting from impact or frictional contact with the wellbore.

FIGS. 17-25 illustrate various graphical displays that can be produced in embodiments of the present invention. Those having ordinary skill in the art will recognize that a number of different means may be used to visually display the various data calculated by the methods disclosed. In particular, spectrum plots, box and whisker plots, and history plots may be used in various embodiments of the present invention.

Additionally, in another embodiment, a desired WOB can be provided as input instead of a hook load and used to calculate the load required at the top of the drill string to obtain a WOB close to that desired. The corresponding ROP can also be calculated.

Additionally, any wear model known in the art may be used with embodiments of the invention. Further, modified versions of the method described above for determining forces resulting from cutting element interaction with the bottomhole surface may be used, including analytical, numerical, or experimental methods. Additionally, methods in accordance with the invention described above may be adapted and used with any model of a downhole cutting tool to determine the dynamic response of a drilling tool assembly to the cutting interaction of the downhole cutting tool.

Methods for Designing a Drilling Tool Assembly

In another aspect, the invention provides a method for designing a drilling tool assembly for drilling earth formations. For example, the method may include simulating a dynamic response of a drilling tool assembly, adjusting the value of at least one drilling tool assembly design parameter, repeating the simulating, and repeating the adjusting and the simulating until a value of at least one drilling performance parameter is determined to be an optimal value.

Methods in accordance with this aspect of the invention may be used to analyze relationships between drilling tool assembly design parameters and drilling performance of a drilling tool assembly. This method also may be used to design a drilling tool assembly having enhanced drilling characteristics. Further, the method may be used to analyze the effect of changes in a drilling tool configuration on drilling performance. Additionally, the method may enable a drilling tool assembly designer or operator to determine an optimal value of a drilling tool assembly design parameter for drilling at a particular depth or in a particular formation.

Examples of drilling tool assembly design parameters include the type and number of components included in the drilling tool assembly; the length, ID, OD, weight, and material properties of each component; and the type, size, weight, configuration, and material properties of the drill bit; and the type, size, number, location, orientation, and material properties of the cutting elements on the bit. Material properties in designing a drilling tool assembly may include, for example, the strength, elasticity, density, wear resistance, hardness, and toughness of the material. It should be understood that drilling tool assembly design parameters may include any other configuration or material parameter of the drilling tool assembly without departing from the spirit of the invention.

Examples of drilling performance parameters include rate of penetration (ROP), rotary torque required to turn the drilling tool assembly, rotary speed at which the drilling tool assembly is turned, drilling tool assembly vibrations induced during drilling (e.g., lateral and axial vibrations), weight on bit (WOB), and forces acting on the bit, cutting support structure, and cutting elements. Drilling performance parameters may also include the inclination angle and azimuth direction of the borehole being drilled. One skilled in the art will appreciate that other drilling performance parameters exist and may be considered as determined by the drilling tool assembly designer without departing from the scope of the invention.

In one application of this aspect of the invention, illustrated in FIG. 8, the method comprises defining, selecting or otherwise providing initial input parameters at 300 (including drilling tool assembly design parameters). The method further comprises simulating the dynamic response of the drilling tool assembly at 310, adjusting at least one drilling tool assembly design parameter at 320, and repeating the simulating of the drilling tool assembly 330. The method also comprises evaluating the change in value of at least one drilling performance parameter 340, and based on that evaluation, repeating the adjusting, the simulating, and the evaluating until at least one drilling performance parameter is optimized.

Figure 9:
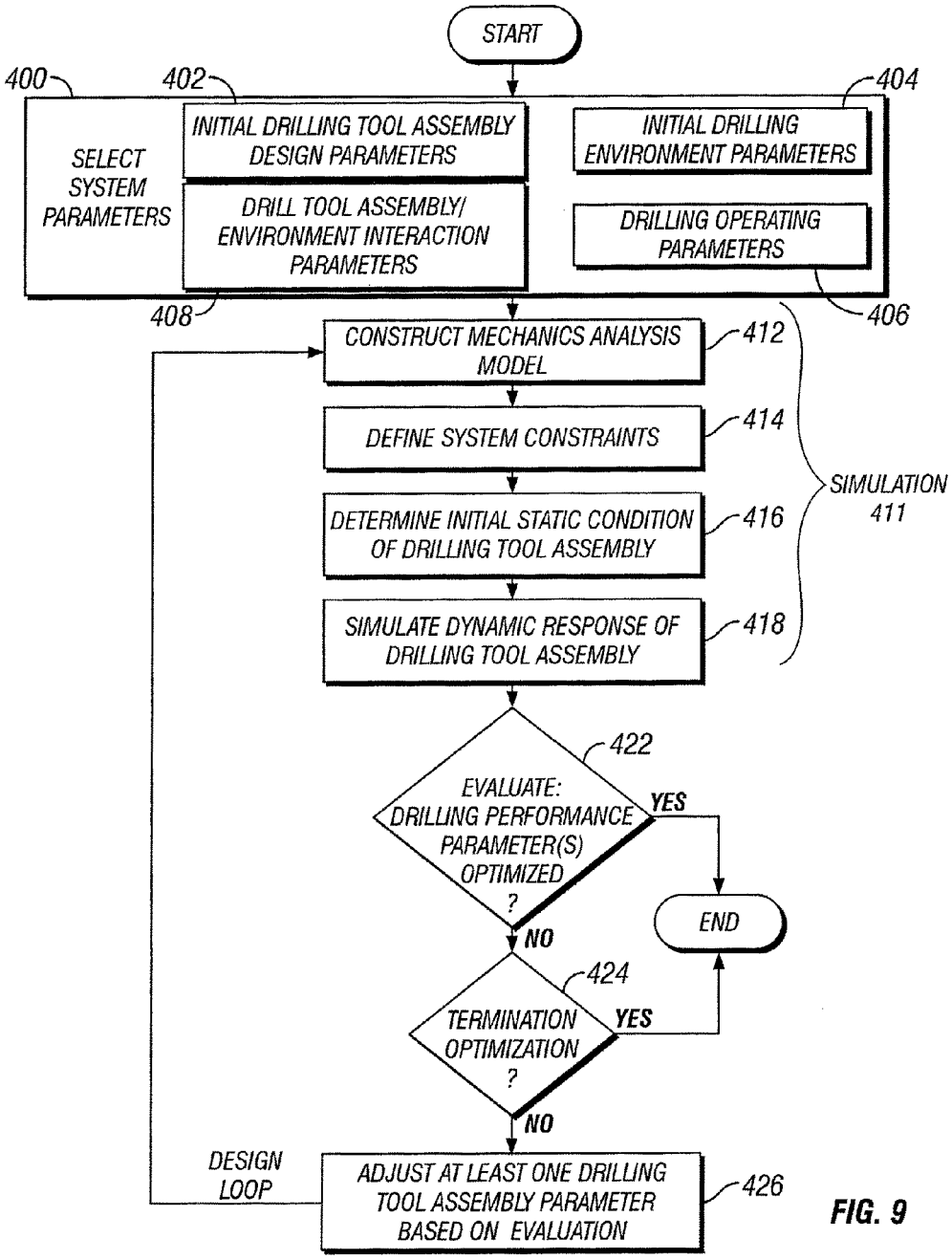
FIG. 9 shows a flow chart of one embodiment of the method for determining an optimal value of at least one drilling tool assembly design parameter in accordance with the method shown in FIG. 8.

As shown in the more detailed example of FIG. 9, the initial parameters 400 may include initial drilling tool assembly parameters 402, initial drilling environment parameters 404, drilling operating parameters 406, and drilling tool assembly/drilling environment interaction parameters and/or models 408. These parameters may be substantially the same as the input parameters described above for the previous aspect of the invention.

In this example, simulating 411 comprises constructing a mechanics analysis model of the drilling tool assembly 412 based on the drilling tool assembly parameters 402, determining system constraints at 414 using the drilling environment parameters 404, and then using the mechanics analysis model along with the system constraints to solve for the initial static state of the drilling tool assembly in the drilling environment 416. Simulating 411 further comprises using the mechanics analysis model along with the constraints and drilling operation parameters 406 to incrementally solve for the response of the drilling tool assembly to rotational input from a rotary table 418 and/or downhole motor, if used. In solving for the dynamic response, the response is obtained for successive incremental rotations until an end condition signaling the end of the simulation is detected.

Incrementally solving for the response may also include determining, from drilling tool assembly/environment interaction information, loads on the drilling tool assembly during the incremental rotation resulting from changes in interaction between the drilling tool assembly and the drilling environment during the incremental rotation, and then recalculating the response of the drilling tool assembly under the new constraint loads. Incrementally solving may further include repeating, if necessary, the determining loads and the recalculating of the response until a solution convergence criterion is satisfied.

Examples for constructing a mechanics analysis model, determining initial system constraints, determining the initial static state, and incrementally solving for the dynamic response of the drilling tool assembly are described in detail for the previous aspect of the invention.

In the present example shown in FIG. 9, adjusting at least one drilling tool assembly design parameter 426 comprises changing a value of at least one drilling tool assembly design parameter after each simulation by data input from a file, data input from an operator, or based on calculated adjustment factors in a simulation program, for example.

Drilling tool assembly design parameters may include any of the drilling tool assembly parameters noted above. Thus in one example, a design parameter, such as the length of a drill collar, can be repeatedly adjusted and simulated to determine the effects of BHA weight and length on a drilling performance parameter (e.g., ROP). Similarly, the inner diameter or outer diameter of a drilling collar may be repeatedly adjusted and a corresponding change response obtained. Similarly, a stabilizer or other component can be added to the BHA or deleted from the BHA and a corresponding change in response obtained. Further, a bit design parameter may be repeatedly adjusted and corresponding dynamic responses obtained to determine the effect of changing one or more drill bit design parameters, such as the cutting support structure profile (e.g., cone or blade profile), cutting element shape and size, and/or orientation, on the drilling performance of the drilling tool assembly.

In the example of FIG. 9, repeating the simulating 411 for the "adjusted" drilling tool assembly comprises constructing a new (or adjusted) mechanics analysis model (at 412) for the adjusted drilling tool assembly, determining new system constraints (at 414), and then using the adjusted mechanics analysis model along with the corresponding system constraints to solve for the initial static state (at 416) of the of the adjusted drilling tool assembly in the drilling environment. Repeating the simulating 411 further comprises using the mechanics analysis model, initial conditions, and constraints to incrementally solve for the response of the adjusted drilling tool assembly to simulated rotational input from a rotary table and/or a downhole motor, if used.

Once the response of the previous assembly design and the response of the current assembly design are obtained, the effect of the change in value of at least one design parameter on at least one drilling performance parameter can be evaluated (at 422). For example, during each simulation, values of desired drilling performance parameters (WOB, ROP, impact loads, axial, lateral, or torsional vibration, etc.) can be calculated and stored. Then, these values or other factors related to the drilling response, can be analyzed to determine the effect of adjusting the drilling tool assembly design parameter on the value of the at least one drilling performance parameter.

Once an evaluation of at least one drilling parameter is made, based on that evaluation the adjusting and the simulating may be repeated until it is determined that the at least one drilling performance parameter is optimized or an end condition for optimization has been reached (at 424). A drilling performance parameter may be determined to be at an optimal value when a maximum rate of penetration, a minimum rotary torque for a given rotation speed, and/or most even weight on bit is determine for a set of adjustment variables. Other drilling performance parameters, such as minimized axial or lateral impact force or evenly distributing forces bout the cutting structure of a bit can also be used. A simplified example of repeating the adjusting and the simulating based on evaluation of consecutive responses is as follows.

Assume that the BHA weight is the drilling tool assembly design parameter to be adjusted (for example, by changing the length, equivalent ID, OD, adding or deleting components), and ROP is the drilling performance parameter to be optimized. Therefore, after obtaining a first response for a given drilling tool assembly configuration, the weight of the BHA can be increased and a second response can be obtained for the adjusted drilling tool assembly. The weight of the BHA can be increased, for example, by changing the ID for a given OD of a collar in the BHA (will ultimately affect the system mass matrix). Alternatively, the weight of the BHA can be increased by increasing the length, OD, or by adding a new collar to the BHA (will ultimately affect the system stiffness matrix). In either case, changes to the drilling tool assembly will affect the mechanics analysis model for the system and the resulting initial conditions. Therefore, the mechanics analysis model and initial conditions will have to be re-determined for the new configuration before a solution for the second response can be obtained. Once the second response is obtained, the two responses (one for the old configuration, one for the new configuration) can be compared to determine which configuration (BHA weight) resulted in the most favorable (or greater) ROP. If the second configuration is found to result in a greater ROP, then the weight of the BHA may be further increased, and a (third) response for the newer configuration) may be obtained and compared to the second. Alternatively, if the increase in the weight of the BHA is found to result in a decrease in the ROP, then the drilling tool assembly design may be readjusted to decrease the BHA weight to a value lower than that set for the first drilling tool assembly configuration and a (third) response may be obtained and compared to the first. This adjustment, recalculation, evaluation may be repeated until it is determined that an optimal or desired value of at least one drilling performance parameter, such as ROP in this case, is obtained.

Advantageously, embodiments of the invention may be used to analyze the relationship between drilling tool assembly design parameters and drilling performance in a selected drilling environment. Additionally, embodiments of the invention may be used to design a drilling tool assembly having optimal drilling performance for a given set of drilling conditions. Those skilled in the art will appreciate that other embodiments of the invention exist which do not depart from the spirit of this aspect of the invention.

Method for Optimizing Drilling Performance

In another aspect, the invention provides a method for determining optimal drilling operating parameters for a selected drilling tool assembly. In one embodiment, this method includes simulating a dynamic response of a drilling tool assembly, adjusting the value of at least one drilling operating parameters, repeating the simulating, and repeating the adjusting and the simulating until a value of at least one drilling performance parameter is determined to be an optimal value.

The method in accordance with this aspect of the invention may be used to analyze relationships between drilling operating parameters and the drilling performance of a selected drilling tool assembly. The method also may be used to improve the drilling performance of a selected drilling tool assembly. Further, the method may be used to analyze the effect of changes in drilling operating parameters on the drilling performance of the selected drilling tool assembly. Additionally, the method in accordance with this aspect of the invention may enable the drilling tool assembly designer or operator to determine optimal drilling operating parameters for a selected drilling tool assembly drilling a particular depth or in a particular formation.

As previously explained, drilling operating parameters include, for example, rotational speed at which the drilling tool assembly is turned, or rotary torque applied to turn the drilling tool assembly, rate of penetration (ROP), hook load (which is one of the major factors to influence WOB), drilling fluid flow rate, and material properties of the drilling fluid (e.g., viscosity, density, etc.). It should be understood that drilling parameters may include any drilling environment or drilling operating parameters which may affect the drilling performance of a drilling tool assembly without departing from the spirit of the invention.

Drilling performance parameters that may be considered in optimizing the design of a drilling tool assembly may include, for example, the ROP, rotary torque required to turn the drilling tool assembly, rotary speed at which the drilling tool assembly is turned, drilling tool assembly vibrations (in terms of velocities, accelerations, etc.), WOB, lateral force, moments, etc. on the bit, lateral and axial forces, moments, etc. on the cones, and lateral and axial forces on the cutting elements. It should be understood that during simulation velocity and displacement are calculated for each node point and can be used to calculate force/acceleration as an indicator of drilling tool assembly vibrations. One skilled in the art will appreciate that other parameters which can be used to evaluate drilling performance exist and may be used as determined by the drilling tool assembly designer without departing from the spirit of the invention.

Figure 10:
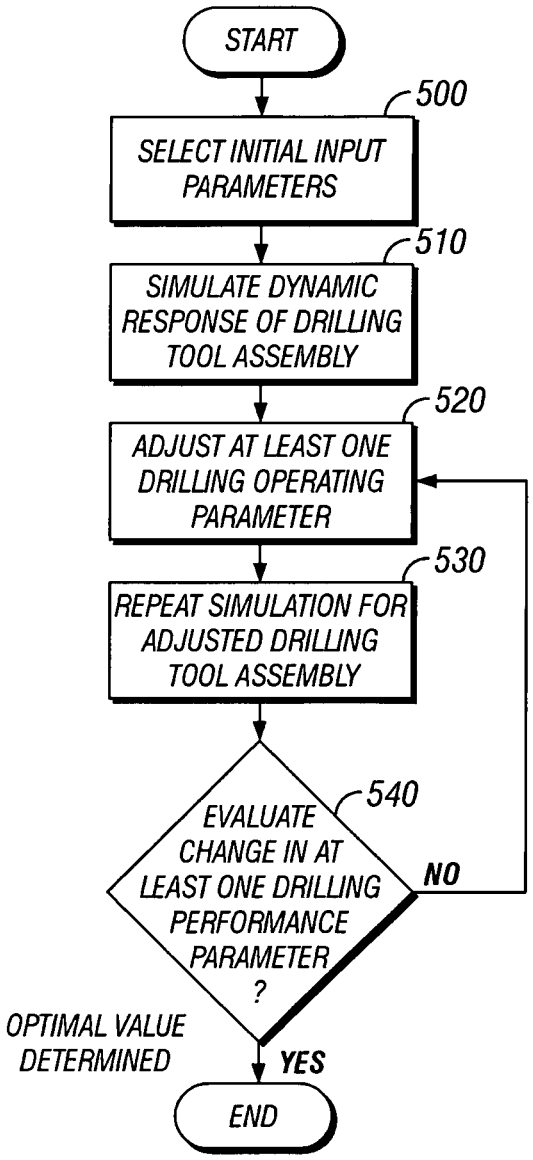
FIG. 10 shows a flow chart of a method for determining an optimal value for at least one drilling operating parameter for a drilling tool assembly.

FIG. 10 shows a flow chart for one example of a method for determining at least one optimal drilling operating parameter for a selected drilling tool assembly. In this example, the method comprises defining, selecting or otherwise providing initial input parameters at 500 (including drilling tool assembly design parameters and drilling operating parameter) which describe various aspects of the initial system. The method further comprises simulating the dynamic response of a drilling tool assembly at 510, adjusting at least one drilling operating parameter at 520, and repeating the simulating of the drilling tool assembly at 530. The method also comprises evaluating the change in value of at least one drilling performance parameter 540, and based on that evaluation, repeating the adjusting 520, the simulating 530, and the evaluating 540 until at least one drilling performance parameter is optimized.

Figure 11:
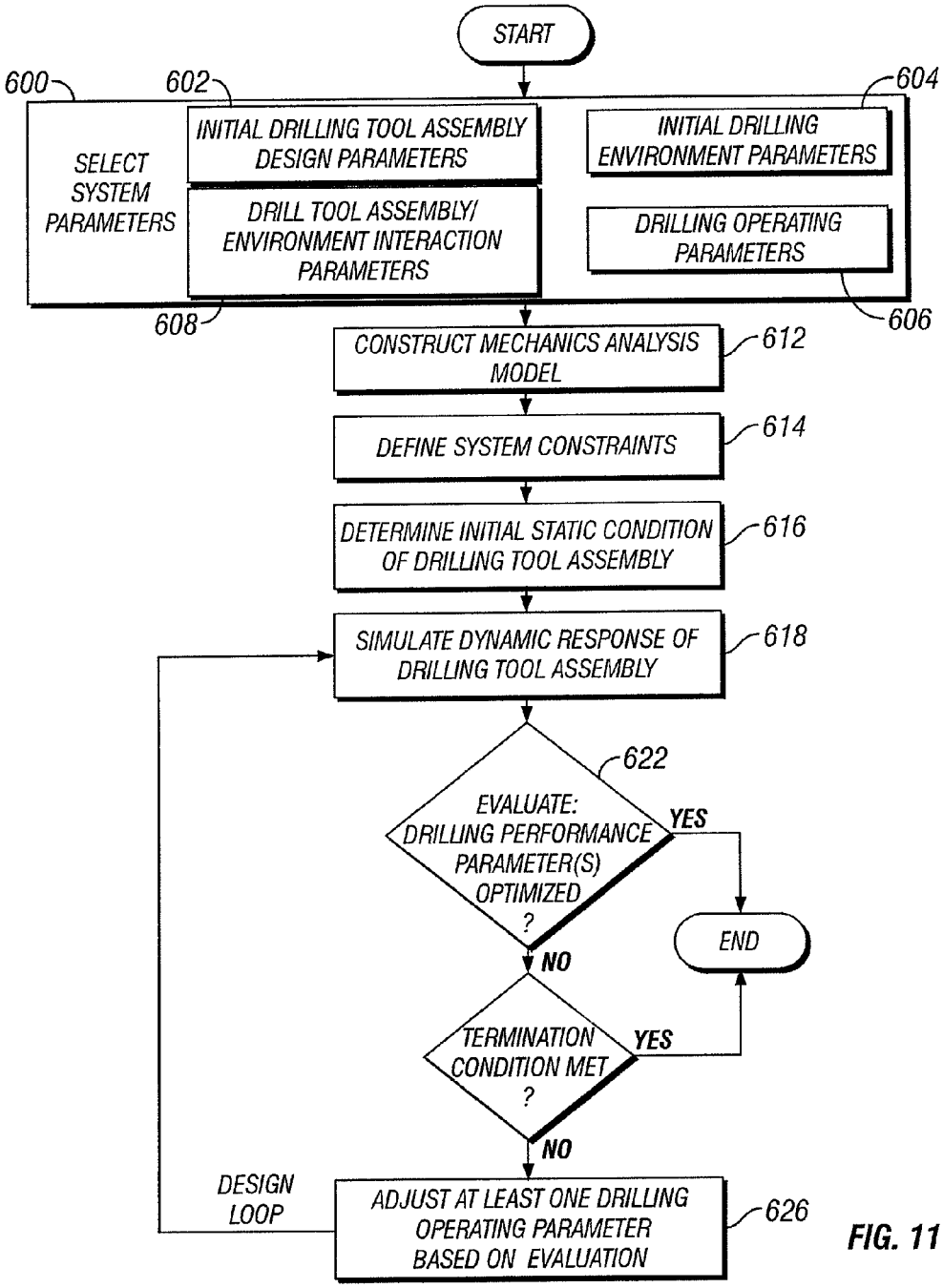
FIG. 11 shows a flow chart of one embodiment of the method for determining an optimal value for at least one drilling operating parameter for a drilling tool assembly in accordance with the method shown in FIG. 10.

Another example of such a method is shown in FIG. 11. In this example, the initial parameters 600 include initial drilling tool assembly parameters 602, initial drilling environment parameters 604, initial drilling operating parameters 606, and drilling tool assembly/drilling environment interaction parameters and/or models 608. These parameters may be substantially the same as those described for the first aspect of the invention discussed above.

In this example, once the input parameters 600 are provided, the input parameters 600 are used to construct a mechanics analysis model (at 612) of the drilling tool assembly and used to determine system constraints (at 614) (wellbore wall and bottom surface constraints). Then, the mechanics analysis model and system constraints are used to determine the initial conditions (at 616) on the drilling tool assembly inserted in the wellbore. Examples for constructing a mechanics analysis model of a drilling tool assembly and determining initial constraints and initial conditions are described in detail above for the first aspect of the invention.

In the example shown in FIG. 11, simulating the dynamic response 618 comprises using the mechanics analysis model along with the initial constraints and initial conditions to incrementally solve for the dynamic response of the drilling tool assembly to simulated rotational input from a rotary table or top drive (at 618) and/or downhole motor. The dynamic response to successive incremental rotations is incrementally obtained until an end condition signaling the end of the simulation is detected.

Incrementally solving for the response may include iteratively determining, from drilling tool assembly/environment interaction data or models, new drilling environment interaction forces on the drilling tool assembly resulting from changes in interaction between the drilling tool assembly and the drilling environment during the incremental rotation, and then recalculating the response of the drilling tool assembly to the incremental rotation under the newly calculated constraint loads. Incrementally solving may further include repeating, if necessary, the determining and the recalculating until a constraint load convergence criterion is satisfied. An example of incrementally solving for the response as described here is presented in detail for the first aspect of the invention.

At least one drilling operating parameter may be adjusted (at 626) as discussed above for the previous aspect of the invention, such as by reading in a new value from a data file, data input from an operator, or calculating adjustment values based on evaluation of responses corresponding to previous values, for example. Similarly, drilling performance parameter(s) adjusted may be any parameter effecting the operation of drilling without departing from the spirit of the invention. In some cases, adjusted drilling parameters may be limited to only particular parameters. For example, the drilling tool assembly designer/operator may concentrate only on the effect of the rotary speed and hook load (or WOB) on drilling performance, in which case only parameters effecting the rotary speed or hook load (or WOB) may be adjustable.

In the example shown in FIG. 11, repeating the simulating 618 comprises at least recalculating the response of the drilling tool assembly to the adjusted drilling operating conditions. However, if an adjustment is made to a drilling operating parameter that affects the drilling environment, such as the viscosity or density of drilling fluid, repeating the simulation may comprise first determining a new system global damping matrix and global load vectors and then using the newly updated mechanics analysis model to incrementally solve for the response of the drilling tool assembly to simulated rotation under the new drilling operating conditions. However, if the adjustment made to a drilling operating parameters does not affect the drilling environment, which may typically be the case (e.g., rotation speed of the rotary table), repeating the simulation may only comprise solving for the dynamic response of the drilling tool assembly to the adjusted operating conditions and the same initial conditions (the static equilibrium state) by using the mechanics analysis model.

Similar to the previous aspect, once a response for the previous adjusted operating parameters and a response for the current adjusted operating parameters are obtained, the effect the change in value of the drilling operating parameter on drilling performance can be evaluated (at 622). For example, during each simulation values of desired drilling performance parameters (WOB, ROP, impact loads, optimized force distribution on cutting elements, optimized/balanced for distribution on cones for roller cone bits, optimized force distribution on lades for PDC bits, etc.) can be calculated. Then, these values or other factors related to the response (such as vibration parameters) can be analyzed to determine the effect of adjusting the drilling operating parameter on the value of at least one drilling performance parameter.

Optimization criteria may include optimizing the force distribution on cutting elements, maximizing the rate of penetration (ROP), minimizing the WOB required to obtain a given ROP, minimizing lateral impact force, etc. In addition, for roller cone drill bits, optimization criteria may also include optimizing or balancing force distribution on cones. For fixed-cutter bits, such as PDC bits, optimization criteria may also include optimizing force distribution on the blades or among the blades.

Once an evaluation of the least one drilling operating parameter is made, based on that evaluation the adjusting and the simulating may be repeated until it is determined that at least one drilling performance parameter is optimized, or until an end condition for optimization is reached. As noted for the previous aspect, a drilling performance parameter may be determined to be at an optimal value when, for example, a maximum rate of penetration, a minimum rotary torque for a given rotation speed, and/or most even weight on bit is determine for a set of adjustment variables. Additionally, an end condition for optimization may include determining when a change in the operation value no long results in an improvement in the drilling performance of the drilling tool assembly. A simplified example of repeating the adjusting, the simulating, and the evaluating until a drilling performance parameter is optimized is as follows.

For example, if after obtaining a first response, the hook load is decreased (which ultimately increases the WOB), and then a second response is obtained for the decreased hook load, the ROP of the two responses can be compared. If the second response is found to have a greater ROP than the first (i.e., decreased hook load is shown to increase ROP), the hook load may be further decrease and a third response may be obtained and compared to the second. This adjustment, resimulation, evaluation may be repeated until the point at which decrease in hook load provides maximum ROP is obtained. Alternatively, if the decrease in hook load is found to result in an decrease in the ROP, then the hook load may be increased to value higher than the value of the hook load for the first simulation, and a third response may be obtained and compared with the first (having the more favorable ROP). This adjustment, resimulation, evaluation may be repeated until it is determined that further increase in hook load provides no further benefit in the ROP.

Advantageously, embodiments of the invention may be used to analyze the relationship between drilling parameters and drilling performance for a select drilling tool assembly drilling a particular earth formation. Additionally, embodiments of the invention may be used to optimize the drilling performance of a given drilling tool assembly. Those skilled in the art will appreciate that other embodiments of the invention exist which do not depart from the spirit of this aspect of the invention.

Further, it should be understood that regardless of the complexity of a drilling tool assembly or the trajectory of the wellbore in which it is to be constrained, the invention provides reliable methods that can be used for predicting the dynamic response of the drilling tool assembly drilling an earth formation. The invention also facilitates designing a drilling tool assembly having enhanced drilling performance, and helps determine optimal drilling operating parameters for improving the drilling performance of a selected drilling tool assembly.

While the invention has been described with respect to a limited number of embodiments and examples, those skilled in the art will appreciate that other embodiments can be devised which do not depart from the scope of the invention as disclosed herein. Accordingly, the scope of the invention should be limited only by the attached claims.

What is claimed is:

1. A method for determining a performance of a drilling tool assembly, comprising:

a. generating a geometric model of the drilling tool assembly and a geometric well trajectory model of an earth formation, wherein the drilling tool assembly includes a drill bit and at least one section of drill pipe;

b. simulating dynamically the drilling tool assembly drilling the earth formation;

c. determining a dynamic response of the drilling tool assembly interaction with the earth formation, wherein the dynamically simulating comprises using at least one datum of a first increment of a simulation in a subsequent increment of the simulation;

d. determining forces acting on the drill bit in the drilling tool assembly;

e. graphically displaying at least one of the drilling tool assembly interaction with the earth formation and the forces acting on the drill bit, and f. adjusting a parameter of the drilling tool assembly based on the graphically displaying, and repeating the simulating, the determining the dynamic response of the drilling tool assembly interaction, and the determining the forces acting on the drill bit wherein the simulating comprises: a. incrementally rotating the drill tool assembly in the earth formation; and b. calculating an interference between the drilling tool assembly and the earth formation during the incremental rotation; wherein the calculating the interference between the drilling tool assembly and the earth formation comprises a. determining interferences between cutting elements on the drill bit and the earth formation; and b. determining forces acting on the cutting elements based on the determined interferences; calculating cutter wears based on the forces on the cutting elements, the interferences between the cutting elements and the earth formation, and a wear model; and modifying a shape of the cutters based on the calculated cutter wears.

2. The method of claim 1, wherein the determining the drilling tool assembly interaction with the earth formation is based on empirical data.

3. The method of claim 1, wherein the drill bit is one selected from a group consisting of a fixed cutter drill bit and a roller cone drill bit.

4. The method of claim 1, wherein the simulation is performed with a constant weight on bit or a constant rate of penetration.

5. The method of claim 1, wherein the determining the forces acting on the cutting elements comprises determining from a collection of cutter/formation interaction data resulting forces on the cutting elements during the incremental rotation.

6. The method of claim 1, further comprising updating cuts from the earth formation based on the interferences between the cutting elements and the earth formation during the incremental rotation.

7. The method of claim 6, further comprising repeating the steps of: the incrementally rotating, the calculating the interferences between the cutting elements and the earth formation, the determining the forces acting on the cutting elements, and the updating the cuts from the earth formation, a number of times to determine the performance of the drill tool assembly during drilling.

8. The method of claim 1, wherein the graphically displaying comprises outputting a graphical representation of at least one selected from the group consisting of a bottomhole profile of the earth formation, the drilling tool assembly, the drill bit, and the cutting elements.

9. The method of claim 8, wherein the graphical representation comprises forces acting on at least one selected from the group consisting of the cutting elements, the drill bit, and the drilling tool assembly.

10. The method of claim 1, wherein the wear model comprises data in the collection of cutter/formation interaction data that is reflective of wears on the cutting elements.

11. The method of claim 5, wherein the collection of cutter/formation interaction data comprises data obtained from laboratory tests involving an engagement of a similar cutter similar to one of the cutters on the bit and a similar formation similar to said earth formation represented as drilled.

12. The method of claim 11, wherein the data is arranged in a database and forces corresponding to said interference determined by retrieving data from a record in said database having parameters of said engagement most similar to parameters calculated for the interference.

13. The method of claim 5, wherein the collection of cutter/formation interaction data comprises data obtained from a numerical model of the cutting interaction between a particular cutter and a particular formation, the numerical model developed to specifically characterize the interaction between the particular cutter similar to one of the cutters on the bit and the particular formation similar to said earth formation represented as drilled.

14. The method of claim 1, wherein the determining a dynamic response of the drilling tool assembly comprises:

calculating a response of the drill bit.

15. The method of claim 14, wherein the calculating comprises:

solving for the dynamic response of the drilling tool assembly using a mechanics analysis model; and repeating the solving for a select number of successive incremental rotations.

* * * * *